US010470633B2

(12) United States Patent
Kim et al.

(10) Patent No.: US 10,470,633 B2
(45) **Date of Patent: *Nov. 12, 2019**

(54) CLEANING DEVICE

(71) Applicant: SAMSUNG ELECTRONICS CO., LTD., Suwon-si, Gyeonggi-do (KR)

(72) Inventors: Hyun Kim, Gwangju (KR); Sang Won Lee, Hwaseong-si (KR); Dong Suk Ko, Gwangju (KR); Jin Hyung Park, Gwangju (KR); Eung Ryeol Seo, Suwon-si (KR); Hyeon Joon Oh, Gwangju (KR); Joo Yong Lee, Gwangju (KR); Jae Ho Choi, Seongnam-si (KR); Kwang Su Heo, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 120 days.

This patent is subject to a terminal disclaimer.

(21) Appl. No.: 15/670,660

(22) Filed: Aug. 7, 2017

(65) Prior Publication Data

US 2017/0332861 A1 Nov. 23, 2017

Related U.S. Application Data

(62) Division of application No. 14/524,603, filed on Oct. 27, 2014, now Pat. No. 9,757,000.

(30) Foreign Application Priority Data

Dec. 24, 2013 (KR) ..... 10-2013-0162088
Apr. 15, 2014 (KR) ..... 10-2014-0045033

(51) Int. Cl.
*A47L 9/22* (2006.01)
*A47L 9/00* (2006.01)
(Continued)

(52) U.S. Cl.
CPC ..... *A47L 9/22* (2013.01); *A47L 9/0081* (2013.01); *F04D 29/4206* (2013.01);
(Continued)

(58) Field of Classification Search
CPC ..... A47L 9/22; A47L 9/0081; A47L 2201/00; F04D 29/4206; F04D 29/626; F05D 2250/52
See application file for complete search history.

(56) References Cited

U.S. PATENT DOCUMENTS 5,720,074 A 2/1998 Lee
6,666,660 B2 * 12/2003 Kegg ..... F04D 29/281 15/326
(Continued)

FOREIGN PATENT DOCUMENTS

CN 2083907 9/1991
CN 1107620 8/1995
(Continued)

OTHER PUBLICATIONS

International Search Report for PCT/KR2014/012407 dated Mar. 27, 2015.
(Continued)

*Primary Examiner* — Dung Van Nguyen
(74) *Attorney, Agent, or Firm* — Staas & Halsey LLP

(57) ABSTRACT

A cleaning device includes an inhalation unit to generate inhalation force to inhale air into a main body, the inhalation unit comprising: an impeller that is rotatable; an impeller cover having an inlet damper formed therein; and a return channel that is coupled to the impeller cover so that the impeller is capable of being accommodated in the return channel and that is directly coupled to the impeller so that air passing through the impeller is capable of being introduced into the return channel, the return channel comprising: an
(Continued)

inner frame; and an outer frame at an outer side of the inner frame so as to be spaced apart from the inner frame.

11 Claims, 63 Drawing Sheets

(51) Int. Cl.
*F04D 29/62* (2006.01)
*F04D 29/44* (2006.01)
*F04D 29/42* (2006.01)

(52) U.S. Cl.
CPC ..... *F04D 29/444* (2013.01); *F04D 29/626* (2013.01); *A47L 2201/00* (2013.01); *F05D 2250/52* (2013.01)

(56) References Cited

U.S. PATENT DOCUMENTS

| | | | | |
|---|---|---|---|---|
| 9,757,000 | B2 * | 9/2017 | Kim | A47L 9/22 |
| 2006/0280596 | A1 * | 12/2006 | Kim | A47L 5/22 415/119 |
| 2011/0277267 | A1 | 11/2011 | Nakamura et al. | |
| 2015/0143657 | A1 * | 5/2015 | Gindele | A47L 5/14 15/330 |
| 2016/0113467 | A1 * | 4/2016 | Box | A47L 9/1616 15/347 |

FOREIGN PATENT DOCUMENTS

| | | |
|---|---|---|
| CN | 1154447 | 7/1997 |
| CN | 102308099 | 1/2012 |
| JP | 11-336700 | 12/1999 |
| JP | 2010-14002 | 1/2010 |
| JP | 2011-80427 | 4/2011 |
| KR | 10-2013-0162088 | 12/2013 |
| KR | 10-2014-0045033 | 4/2014 |
| WO | 2012/103053 A2 | 8/2012 |
| WO | 2013/053920 | 4/2013 |

OTHER PUBLICATIONS

Australian Office Action for corresponding AU Application No. 20144370740 dated Mar. 23, 2017.

Australian Office Action for corresponding AU Application No. 20144370740 dated Jun. 29, 2017.

Office Action in co-pending U.S. Application No. 14/524,603 dated Feb. 17, 2017.

Notice of Allowance in co-pending U.S. Appl. No. 14/524,603 dated Apr. 18, 2017.

U.S. Appl. No. 14/524,603, filed Oct. 27, 2014, Hyun Joo Kim et al., Samsung Electronics Co., Ltd.

Extended European Search Report dated Jul. 26, 2017 in European Patent Application No. 14873210.0.

Chinese Office Action dated Dec. 18, 2018 in Chinese Patent Application No. 201480070651.6.

Chinese Office Action dated Apr. 26, 2018 in Chinese Patent Application No. 201480070651.6.

Chinese Office Action dated May 27, 2019 in corresponding Chinese Patent Application No. 201480070651.6.

European Office Action dated Apr. 16, 2019 in corresponding European Patent Application No. 14873210.0.

* cited by examiner

CLEANING DEVICE

CROSS-REFERENCE TO RELATED APPLICATIONS

This is a divisional application of U.S. application Ser. No. 14/524,603 filed on Oct. 27, 2014 which claims the benefit of Korean Patent Application No. 10-2013-0162088, filed on Dec. 24, 2013, and Korean Patent Application No. 10-2014-0045033, filed on Apr. 15, 2014, in the Korean Intellectual Property Office, the disclosures of which are incorporated herein by reference.

BACKGROUND

1. Field

Embodiments of the present invention relate to a cleaning device, and more particularly, to a cleaning device having an improved structure in which cleaning performance can be improved.

2. Description of the Related Art

In general, cleaning devices are devices that inhale air, including filth, on a surface to be cleaned, separate the filth from the air, collect the filth, and discharge purified air to outside of a main body.

Such cleaning devices are classified into a canister-type cleaning device in which a main body and an inhalation nozzle are separate from each other and are connected using a predetermined pipe, and an up-right type cleaning device in which an inhalation nozzle and a main body are provided as a single body, according to a shape of the cleaning device.

A robotic cleaning device that automatically cleans an area to be cleaned, while traveling the area to be cleaned by itself to perform a cleaning task, by inhaling foreign substances such as dust from a floor without user manipulation, has been recently spotlighted.

The cleaning device may include an impeller, a diffuser, and a deswirler that are elements for determining inhalation force.

Air inhaled into the main body sequentially passes through the impeller, the diffuser, and the deswirler along a flow path that is bent several times. In this procedure, a pressure loss of air increases, and a distance between the impeller and the diffuser is designed to be small so as to supplement a reduction in inhalation force caused by the pressure loss. However, the smaller the distance between the impeller and the diffuser, the higher a possibility that noise occurs due to pressure fluctuation. In order to prevent the occurrence of noise, the size of the impeller and the size of a motor to be coupled to the impeller may be increased. In this case, the size of the cleaning device is also increased, which does not correspond to a recent market trend for a compact product.

SUMMARY

Therefore, it is an aspect of the present invention to provide a cleaning device having an improved structure in which inhalation force can be improved.

It is another aspect of the present invention to provide a cleaning device having an improved structure in which the cleaning device can be made small and compact.

It is still another aspect of the present invention to provide a cleaning device having an improved structure in which the occurrence of noise can be prevented.

It is yet still another aspect of the present invention to provide a cleaning device having an improved structure in which the cleaning device can be easily manufactured.

Additional aspects of the invention will be set forth in part in the description which follows and, in part, will be obvious from the description, or may be learned by practice of the invention.

In accordance with one aspect of the present invention, there is provided a cleaning device including an inhalation unit to generate inhalation force to inhale air into a main body, wherein the inhalation unit may include: an impeller that is rotatable; an impeller cover having an inlet damper formed therein; and a return channel that is coupled to the impeller cover so that the impeller can be accommodated in the return channel, wherein the return channel may include: an inner frame; and an outer frame placed at an outer side of the inner frame so as to be spaced apart from the inner frame, and a plurality of wings are disposed between the inner frame and the outer frame.

The return channel may directly be coupled to the impeller so that air passing through the impeller can be introduced into the return channel.

The plurality of wings may form a slope with respect to an axial direction of the impeller.

The impeller may be rotated in a first direction, and the plurality of wings may form a slope with respect to the axial direction of the impeller in a second direction that is opposite to the first direction.

The plurality of wings may include curved surfaces.

The plurality of wings may be spaced apart from each other by a predetermined gap and may form a discharge flow path through which air passing through the impeller moves, and wherein the discharge flow path may include: an inlet formed on one end of the discharge flow path that faces the impeller; and an outlet formed on the other end of the discharge flow path so as to be spaced apart from the inlet, and air introduced into the discharge flow path via the inlet may be ejected to an outer side of the inhalation unit via the outlet.

The impeller cover may include a guide portion coupled to the outer frame so as to guide air passing through the impeller to the inlet, and the guide portion may have a curved surface.

The guide portion may have a curved surface that is convex toward an outer side of the impeller cover and has a radius of curvature of approximately 1 mm or more.

The plurality of wings may include: a first surface that faces an outer surface of the inner fame and includes a starting point; and a second surface that faces an inner surface of the outer frame and includes a starting point that forms the inlet together with the starting point.

A straight line that connects the starting point of the first surface and the starting point of the second side may form a slope at an angle between approximately 5° and 85° with respect to the axial direction of the impeller.

An angle θ between a straight line that connects one end of the first surface and one end of the second surface which face the impeller cover and a straight line that connects a center of the return channel and one end of the first surface that faces the impeller cover in a cross-section in which the return channel is cut in a horizontal direction perpendicular to the axial direction of the impeller, may be between approximately 0° and 80°.

The starting point of the second surface may further extend toward the impeller cover than the starting point of the first surface.

The plurality of wings may further include a connection portion that connects the starting point of the first surface and the starting point of the second surface, and the connection portion may include at least one of a curved surface and a flat surface.

The connection portion may include a summit that further extends toward the impeller cover than at least one of the starting point of the first surface and the starting point of the second surface.

The inhalation unit may further include a motor that is provided in the return channel and has a motor shaft coupled to the impeller so as to provide driving force for rotating the impeller.

In accordance with another aspect of the present invention, there is provided a cleaning device including an inhalation unit to generate inhalation force to inhale air into a main body, wherein the inhalation unit may include: an impeller that is rotatable; an impeller cover having an inlet damper formed therein; and a return channel that is coupled to the impeller cover so that the impeller can be accommodated in the return channel and that is directly coupled to the impeller so that air passing through the impeller can be introduced into the return channel, and the return channel is formed when a plurality of units that can be separated from each other, are coupled to each other.

The plurality of units may be separated from each other so as to form a slope with respect to an axial direction of the impeller.

The plurality of units may be separated from each other in a horizontal direction perpendicular to the axial direction of the impeller.

The return channel may include: an inner frame; an outer frame placed at an outer side of the inner frame so as to be spaced apart from the inner frame; and a plurality of wings placed between the inner frame and the outer frame, and the plurality of units may be separated from each other in the horizontal direction perpendicular to the axial direction of the impeller.

The plurality of wings may form a slope with respect to the axial direction of the impeller and may include curved surfaces.

The return channel may further include at least one rotation prevention unit that causes the plurality of units to be coupled to each other.

The at least one rotation prevention unit may be formed at an inner side of the return channel so as to be spaced apart from each other.

The plurality of units may include: a first unit placed at an upstream side of a direction in which air passing through the impeller moves; and a second unit placed at a downstream side of the direction in which air passing through the impeller moves, and the at least one rotation prevention unit may include a protrusion provided at an inner side of one of the first unit and the second unit.

The at least one rotation prevention unit may further include a fastening portion that is provided at an inner side of the other of the first unit and the second unit and is separably coupled to the protrusion.

In accordance with still another aspect of the present invention, there is provided a cleaning device including an inhalation unit to generate inhalation force to inhale air into a main body, wherein the inhalation unit may include: an impeller that is rotatable; an impeller cover having an inlet damper formed therein; and a return channel that is coupled to the impeller cover so that the impeller can be accommodated in the return channel and that is directly coupled to the impeller so that air passing through the impeller can be introduced into the return channel, and a plurality of wings may be disposed on the return channel so as to form a slope with respect to an axial direction of the impeller.

The plurality of wings may include curved surfaces.

The impeller may be rotated in a first direction, and the plurality of wings may form a slope with respect to the axial direction of the impeller in a second direction that is opposite to the first direction.

The return channel may include: an inner frame; and an outer frame placed at an outer side of the inner frame so as to be spaced apart from the inner frame, and the plurality of wings may be disposed between the inner frame and the outer frame.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
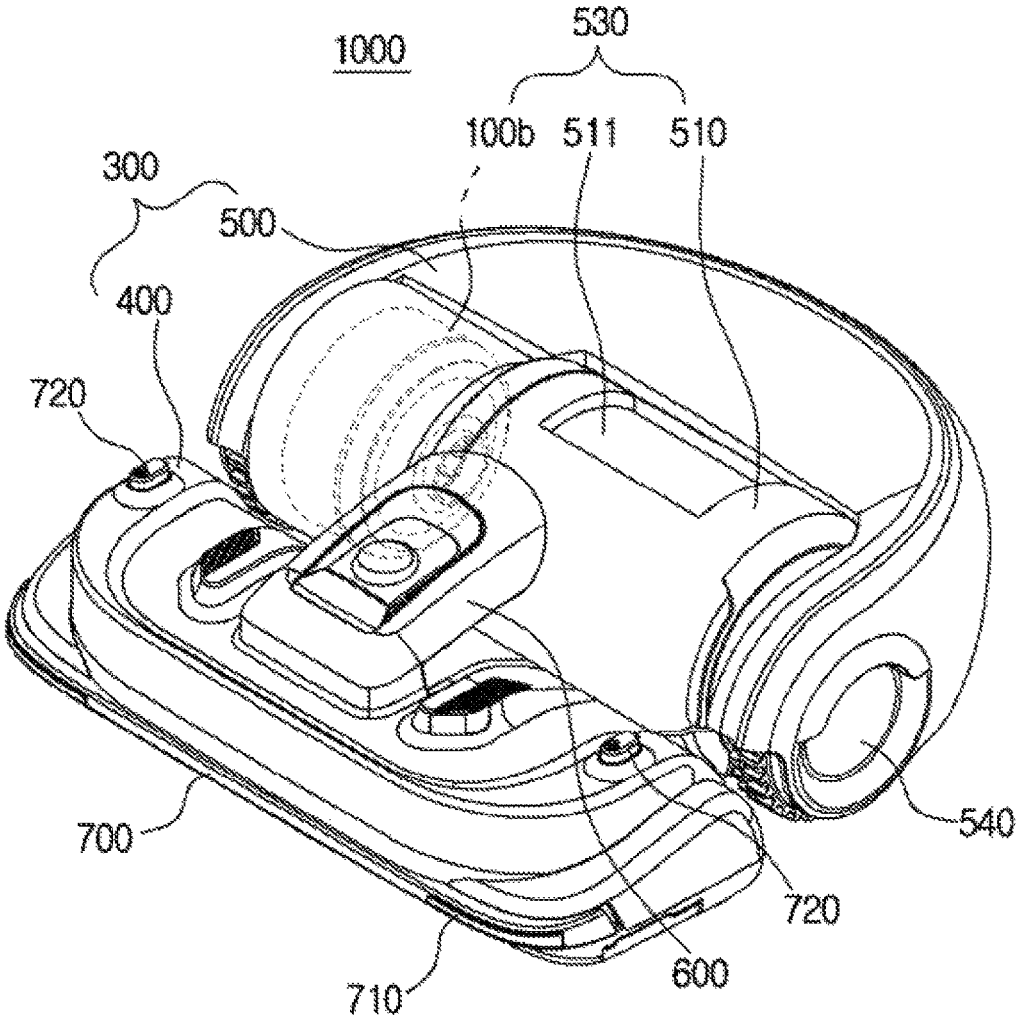
FIG. 1 illustrates an exterior of a cleaning device according to an embodiment of the present invention.

Reference will now be made in detail to the embodiments of the present invention, examples of which are illustrated in the accompanying drawings, wherein like reference numerals refer to like elements throughout.

The terms used herein, such as a "front end," a "rear end," an "upper portion,", a "lower portion," a "top end," and a "bottom end," are defined based on the drawings, and the shape and position of each element are not limited by the terms.

FIG. 1 illustrates an exterior of a cleaning device according to an embodiment of the present invention.

As illustrated in FIG. 1, the cleaning device may include a robotic cleaning device 1000. The robotic cleaning device 1000 may include a main body that constitutes an exterior, and a housing 300 that constitutes at least a portion of the exterior of the main body.

The housing 300 may include a first housing 400 formed in front of a second housing 500 and the second housing 500 formed behind the first housing 400. A connection member 600 may be placed between the first housing 400 and the second housing 500 so as to connect the first housing 400 and the second housing 500.

A dust collecting unit 530 configured to store dust may be coupled to the second housing 500. The dust collecting unit 530 may include an inhalation unit 100 (or intake unit) that provides driving force to inhale (or intake) dust and a dust collecting canister 510 in which inhaled dust is stored.

A grasping portion 511 that is concavely provided so that a user can grasp the dust collecting canister 510, may be provided in the dust collecting canister 510. The user can grasp the grasping portion 511, rotate the dust collecting canister 510 and separate the dust collecting canister 510 from the second housing 500. The user can remove accumulated dust in the dust collecting canister 510 by separating the dust collecting canister 510 from the second housing 500. A driving unit may be provided at a side of the second housing 500 so as to drive the main body. The driving unit may include driving wheels 540 on which the main body travels, and a roller (not shown) that is provided to be rotatable so as to minimize a load occurring when the main body travels. The driving wheels 540 may be coupled to both sides of the second housing 500.

A brush unit (not shown) configured to sweep dust on a floor may be provided at the first housing 400. A bumper 700 may be coupled to a front portion of the first housing 400 so as to alleviate noise and shock that occur due to collision between the robotic cleaning device 1000 and a wall surface when the robotic cleaning device 1000 travels. Also, a separate shock absorbing member 710 may be coupled to the bumper 700.

An entry blocking sensor 720 may be provided to protrude from a top surface of the first housing 400. The entry blocking sensor 720 may prevent the robotic cleaning device 1000 from entering a predetermined section by detecting infrared rays. The entry blocking sensor 720 may be provided at both sides of the first housing 400.

Figure 2:
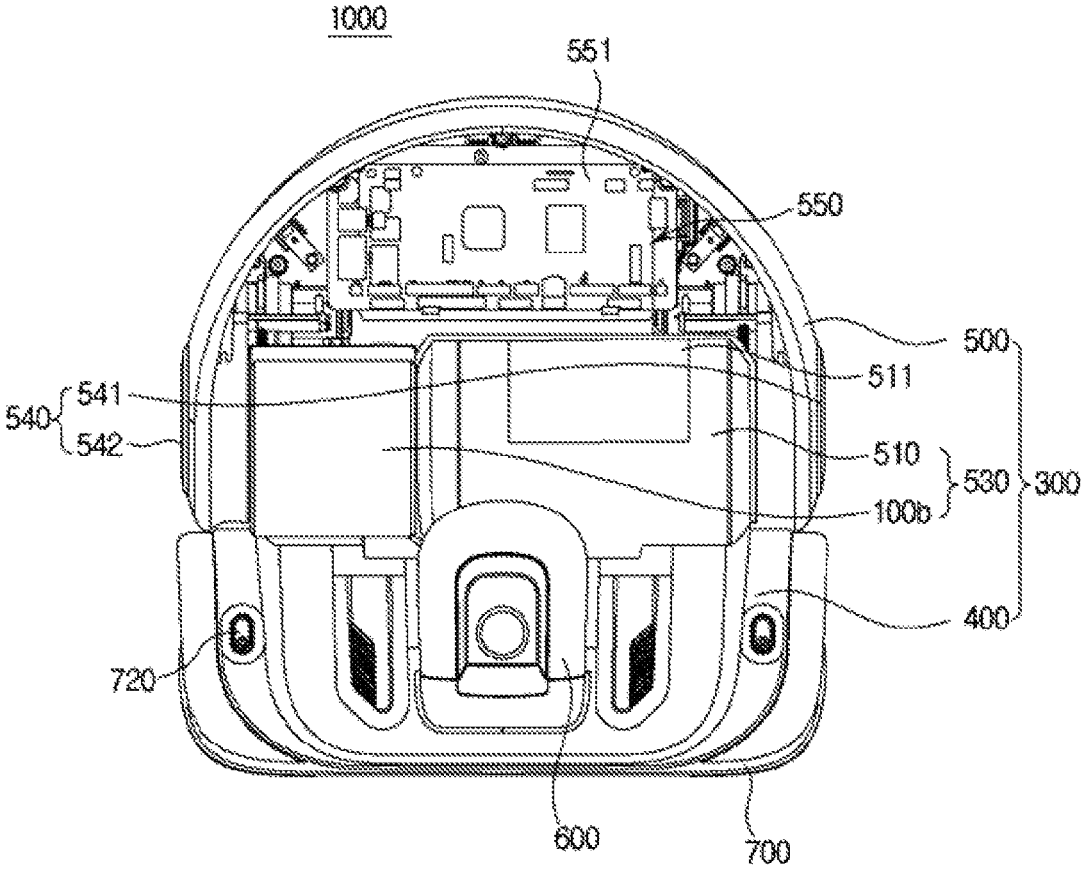
FIG. 2 is a plan view illustrating a state in which an outer housing of a second housing of the cleaning device illustrated in FIG. 1 is removed.
Figure 3:
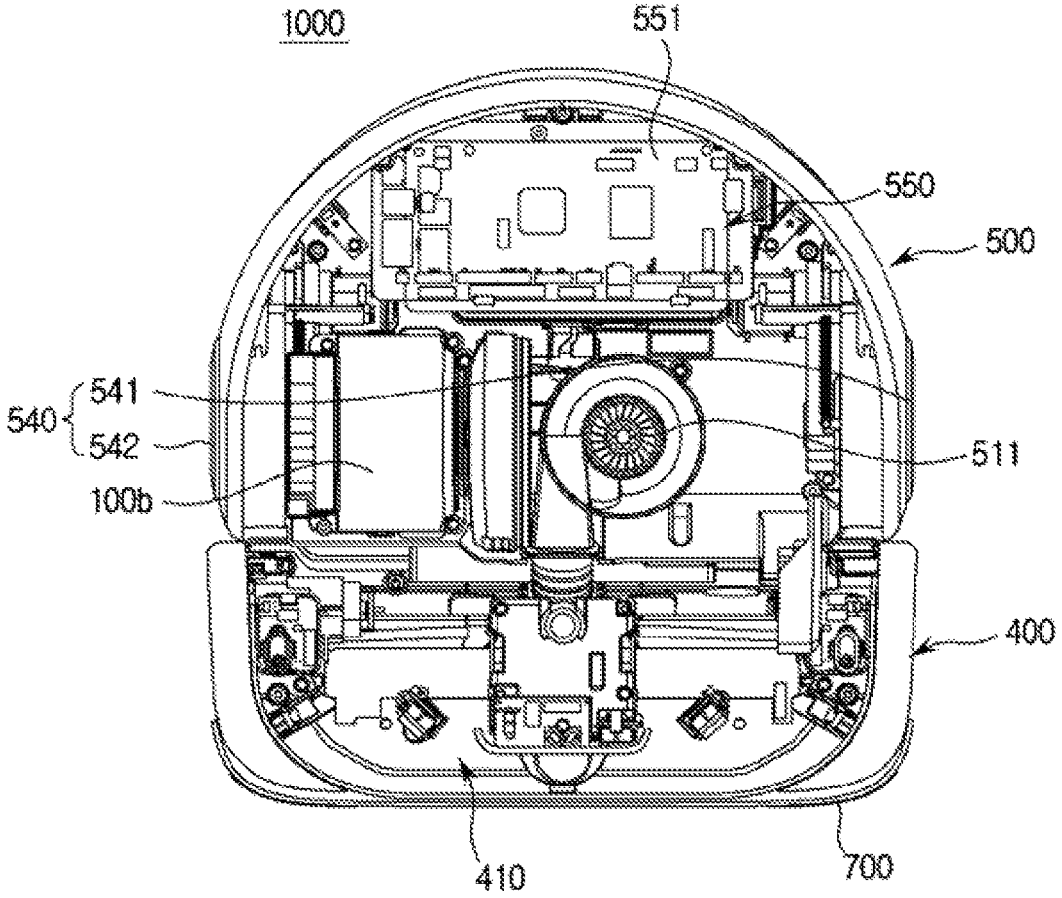
FIG. 3 is a plan view illustrating a state in which a first housing and an outer housing and a dust collecting canister of the second housing of the cleaning device of FIG. 1 are removed.

FIG. 2 is a plan view illustrating a state in which an outer housing of a second housing of the cleaning device illustrated in FIG. 1 is removed, and FIG. 3 is a plan view illustrating a state in which a first housing and an outer housing and a dust collecting canister of the second housing of the cleaning device of FIG. 1 are removed.

As illustrated in FIGS. 2 and 3, a power supply unit 550 for supplying power for driving the main body may be coupled to an inner side of the second housing 500. The power supply unit 550 may include a battery (not shown), a main board 551, and a display portion (not shown) that is placed at an upper side of the main board 551 and displays a state of the robotic cleaning device 1000. The power supply unit 550 may be disposed to be placed behind the dust collecting unit 530 in an embodiment.

The battery (not shown) may be provided as a secondary battery that is rechargeable, and when the main body is coupled to a docking station (not shown) after finishing a cleaning operation, the battery (not shown) is charged by power supplied from the docking station (not shown).

When the dust collecting canister 510 is removed from the second housing 500, a blower fan (not shown) that moves inhaled air into the dust collecting canister 510 may be provided. As the blower fan (not shown) operates, dust may be accumulated in the dust collecting canister 510, and the user may separate the dust collecting canister 510 from the second housing 500 and may discharge dust easily.

The inhalation unit 100*b* may be placed at an inner side of an inhalation unit housing (not shown). The inhalation unit 100*b* may be coupled to a side of the dust collecting canister 510. According to an embodiment of the present invention, the driving wheels 540 may be disposed at sides of the dust collecting canister 510 and the inhalation unit 100*b*. That is, the driving wheels 540 may include a first driving wheel 541 and a second driving wheel 542. The first driving wheel 541 may be disposed at the side of the inhalation unit 100*b*, and the second driving wheel 542 may be disposed at the side of the dust collecting canister 510.

Thus, the dust collecting canister 510, the inhalation unit 100*b*, and the driving wheels 540 may be arranged in a horizontal direction of the main body. That is, the dust collecting canister 510, the inhalation unit 100*b*, and the driving wheels 540 may be disposed in approximately a straight line in an embodiment A detailed description of the inhalation unit 100*b* will be provided below.

Figure 4:
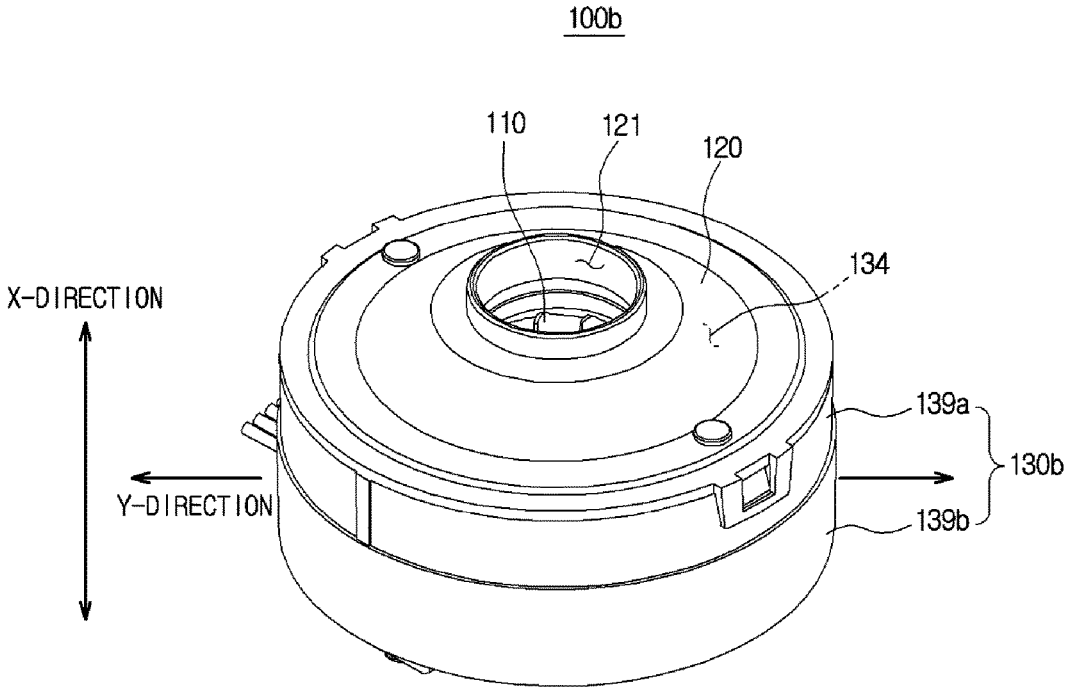
FIG. 4 is a perspective view illustrating an inhalation unit of the cleaning device of FIG. 1.
Figure 5:
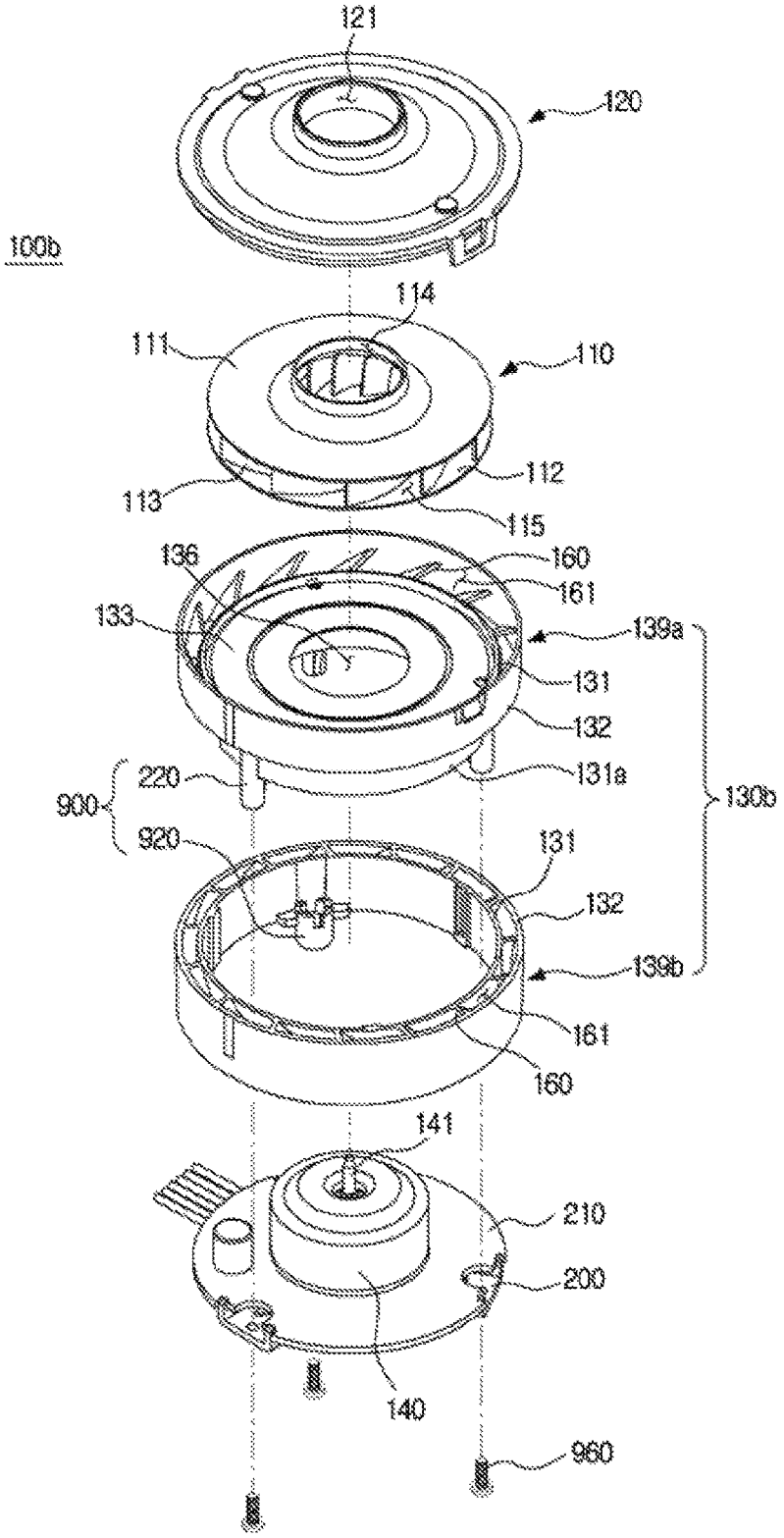
FIG. 5 is an exploded perspective view of the inhalation unit of the cleaning device of FIG. 1.
Figure 6:
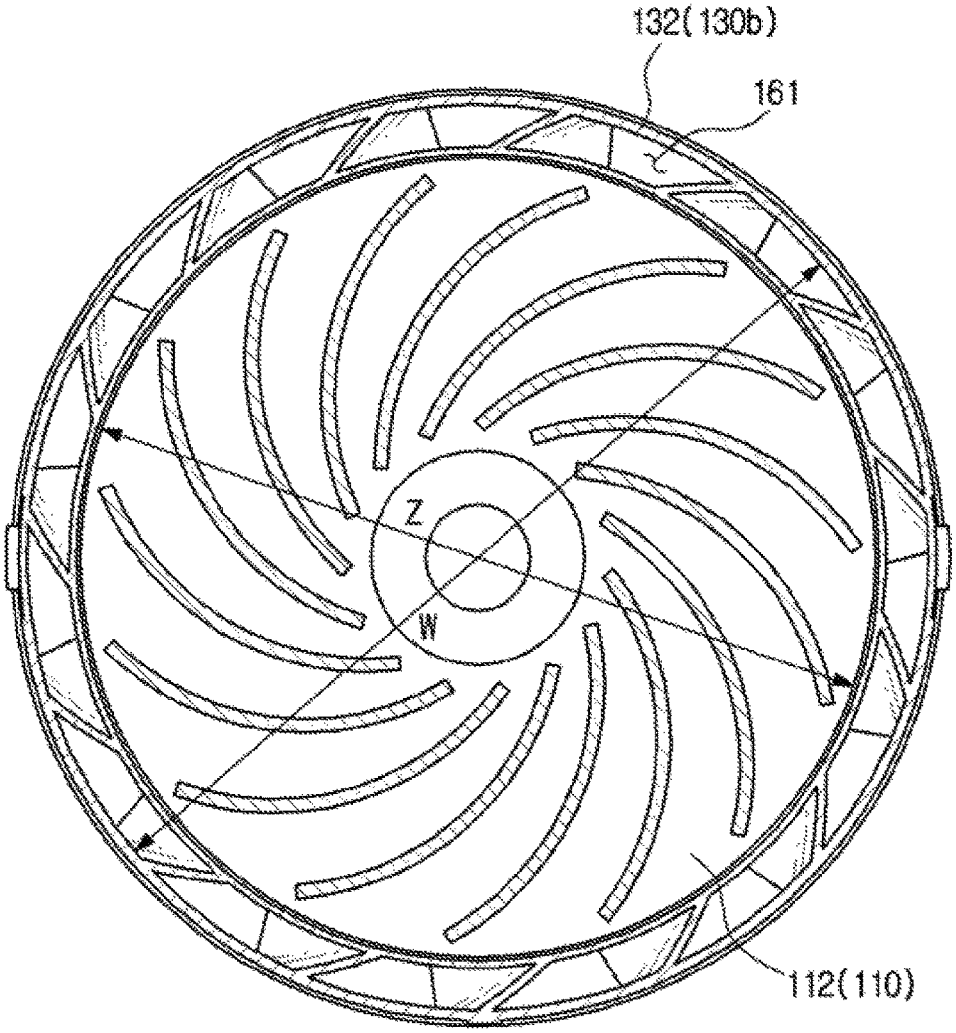
FIG. 6 is a top view illustrating part of the inhalation unit of the cleaning device of FIG. 1.

FIG. 4 is a perspective view illustrating an inhalation unit of the cleaning device of FIG. 1, and FIG. 5 is an exploded perspective view of the inhalation unit of the cleaning device of FIG. 1. FIG. 6 is a top view illustrating part of the inhalation unit of the cleaning device of FIG. 1.

As illustrated in FIGS. 4 through 6, the robotic cleaning device 1000 may include the inhalation unit 100*b* to generate inhalation force to inhale external air into the main body.

The inhalation unit 100*b* may include an impeller 110, an impeller cover 120, and a return channel 130*b*.

An inlet damper 121 may be formed at the impeller cover 120.

The rotatable impeller 110 may be provided at an inner side of the impeller cover 120.

The impeller 110 is connected to a motor 140 and is rotated so as to inhale air into the inhalation unit 100*b*. That is, in an embodiment, the impeller 110 is a rotatable impeller.

The impeller 110 may be configured as a centrifugal fan that inhales air in an axial direction X of the impeller 110 and ejects inhaled air in a radial direction.

The impeller 110 may include a first plate 111, a second plate 112, and a plurality of rotation wings 113.

The first plate 111 and the second plate 112 may be disposed in a vertical direction so as to face each other, and the plurality of rotation wings 113 may be placed between the first plate 111 and the second plate 112.

A top surface of each of the plurality of rotation wings 113 may be coupled to the first plate 111 placed at upper portions of the plurality of rotation wings 113, and a bottom surface of each of the plurality of rotation wings 113 may be coupled to the second plate 112 placed at lower portions of the plurality of rotation wings 113. Thus, the first plate 111, the second plate 112, and the plurality of rotation wings 113 may be rotated as an integral part.

An opening hole 114 that corresponds to the inlet damper 121 of the impeller cover 120 may be formed in the first plate 111. Air that passes through the inlet damper 121 may be introduced into the impeller 110 via the opening hole 114.

One end of a motor shaft 141 may be fixed onto the second plate 112. Thus, the first plate 111, the second plate 112, and the plurality of rotation wings 113 may be integrally rotated around the motor shaft 141.

The plurality of rotation wings 113 placed between the first plate 111 and the second plate 112 so as to be spaced apart from each other may define a flow path 115. Air that passes through the opening hole 114 and is introduced into the impeller 110 may move along the flow path 115 and may be transferred to a discharge flow path 161 formed on the return channel 130*b*.

For example, the impeller 110 may include a three-dimensional (3D) impeller including a body having a shape that is lowered as it goes to the radial direction, and a blade.

The impeller 110 may be modified in various shapes, and the shape of the impeller 110 is not limited to the above example.

The return channel 130*b* converts kinetic energy of air inhaled by the impeller 110 into the inhalation unit 100*b* into pressure energy. In detail, air introduced into the impeller 110 via the opening hole 114 is transferred to the return channel 130*b* after being rotated. The return channel 130*b* collects air that passes through the impeller 110 and converts dynamic pressure of air into static pressure of air. Also, the return channel 130*b* may prevent noise from occurring when air passes through the inhalation unit 100*b*. That is, the return channel 130*b* may serve as a diffuser and a deswirler simultaneously.

The return channel 130*b* may be coupled to the impeller cover 120 and may form an impeller accommodation space 134 in which the impeller 110 may be accommodated therein.

The return channel 130*b* may be disposed at a lower side of the impeller 110.

The return channel 130*b* may directly be coupled to the impeller 110 so that air passing through the impeller 110 may directly be introduced into the return channel 130*b*.

The return channel 130*b* may be separable. That is, the return channel 130*b* may be formed when a plurality of units 139*a* and 139*b* that may be separated from each other, are coupled to each other.

The plurality of units 139*a* and 139*b* may be separated from each other so as to form a slope with respect to the axial direction X of the impeller 110. The plurality of units 139*a* and 139*b* may be separated from each other in a horizontal direction Y perpendicular to the axial direction X of the impeller 110.

The plurality of units 139*a* and 139*b* may include a first unit 139*a* and a second unit 139*b*.

The first unit 139*a* may be placed at an upstream side of a direction G in which air passing through the impeller 110 moves, and the second unit 139*b* may be placed at a downstream side of the direction G in which air passing through the impeller 110 moves.

The first unit 139*a* may be coupled to the impeller cover 120. The second unit 139*b* may be coupled to a lower portion of the first unit 139*a* so as to be separated from the first unit 139*a*.

The first unit 139*a* and the second unit 139*b* may be coupled to each other so as to form a step therebetween.

The second unit 139*b* may have a larger width than that of the first unit 139*a*. That is, the second unit 139*b* may further protrude outward in the horizontal direction Y perpendicular to the axial direction X of the impeller 110 than the first unit 139*a*.

The plurality of units 139*a* and 139*b* are not limited to the first unit 139*a* and the second unit 139*b*.

The return channel 130*b* may include an inner frame 131, an outer frame 132, and a plurality of wings 160.

The outer frame 132 may be placed at an outer side of the inner frame 131 along an outer circumferential surface of the inner frame 131, may be coupled to the impeller cover 120 and may constitute the impeller accommodation space 134 in which the impeller 110 is accommodated.

The return channel 130*b* may be placed at the lower portion of the impeller 110, and a mounting portion 133 on which the impeller 110 is mounted, may be formed on a top surface of the inner frame 131. That is, the mounting portion 133 on which the impeller 110 is mounted, may be formed on the top surface of the inner frame 131 of the first unit 139*a*.

The inner frame 131 and the outer frame 132 may be formed as an integral part.

The plurality of wings 160 may be disposed lengthwise between the inner frame 131 and the outer frame 132. In detail, the plurality of wings 160 may be formed lengthwise between the inner frame 131 and the outer frame 132 in the axial direction X of the impeller 110. Thus, the plurality of wings 160 may constitute the discharge flow path 161 that is long in the axial direction X of the impeller 110 and may increase additional static pressure so that inhalation performance of the inhalation unit 100*b* can be improved.

A detailed description of the plurality of wings 160 will be provided below.

The inhalation unit 100*b* may further include a printed circuit board (PCB) 210 and a support unit 200.

The PCB 210 may be placed at a lower portion of the return channel 130*b* in the axial direction X of the impeller 110. That is, the PCB 210 may be placed at the lower portion of the return channel 130*b* so as to be adjacent to an outlet 135 of the discharge flow path 161. The PCB 210 may be placed at a lower portion of an inner side of the return channel 130*b* not to block the discharge flow path 161.

The support unit 200 may be placed at a lower portion of the PCB 210 in the axial direction X of the impeller 110. The support unit 200 may support the motor 140 provided in the return channel 130*b* and the PCB 210 at the lower portion of the return channel 130*b*.

The support unit 200 may be coupled, by a fixing member 960, to at least one protrusion 220 formed in the return channel 130*b*.

A width of the return channel 130*b* may be larger than a width of the impeller 110.

The width of the return channel 130*b* that crosses the outer frame 132 in the horizontal direction Y perpendicular to the axial direction X of the impeller 110 (hereinafter referred to as a "width W of a return channel") may be larger than the width of the impeller 110 that crosses the impeller 110 in the horizontal direction Y perpendicular to the axial direction X of the impeller 110 (hereinafter referred to as a "width Z of an impeller").

The width Z of the impeller 110 may correspond to be equal to or greater than approximately 70% and less than approximately 100% of the width W of the return channel 130*b*. In detail, a diameter of the second plate 112 of the impeller 110 may correspond to be equal to or greater than approximately 70% and less than approximately 100% of a diameter of the outer frame 132 of the return channel 130*b*.

When the width Z of the impeller 110 and the width W of the return channel 130*b* are equal to each other, i.e., when the width Z of the impeller 110 is 100% of the width W of the return channel 130*b*, air that passes through the impeller 110 is not easily transferred to the discharge flow path 161 formed on the return channel 130*b*.

A degree of separation between the second plate 112 of the impeller 110 and the outer frame 132 of the return channel 130*b* may be between approximately 4 mm and 8 mm. This may be modified in various ways according to the shape and size of the inhalation unit 100*b*.

The inhalation unit 100*b* may further include the motor 140 that provides driving force for rotating the impeller 110.

The motor 140 may include a brushless direct current (BLDC) motor, a direct current (DC) motor, and an alternating current (AC) motor.

The motor 140 may be provided in the return channel 130*b*. In detail, the motor 140 may be provided in the inner frame 131.

The motor 140 may include the motor shaft 141. One end of the motor shaft 141 is connected to the second plate 112 of the impeller 110, and the other end of the motor shaft 141 is connected to the motor 140.

A motor shaft penetration hole 136 may be formed in the mounting portion 133 of the inner frame 131 so that one end of the motor shaft 141 may be connected to the second plate 112 of the impeller 110 placed at the upper portion of the inner frame 131.

Figure 7:
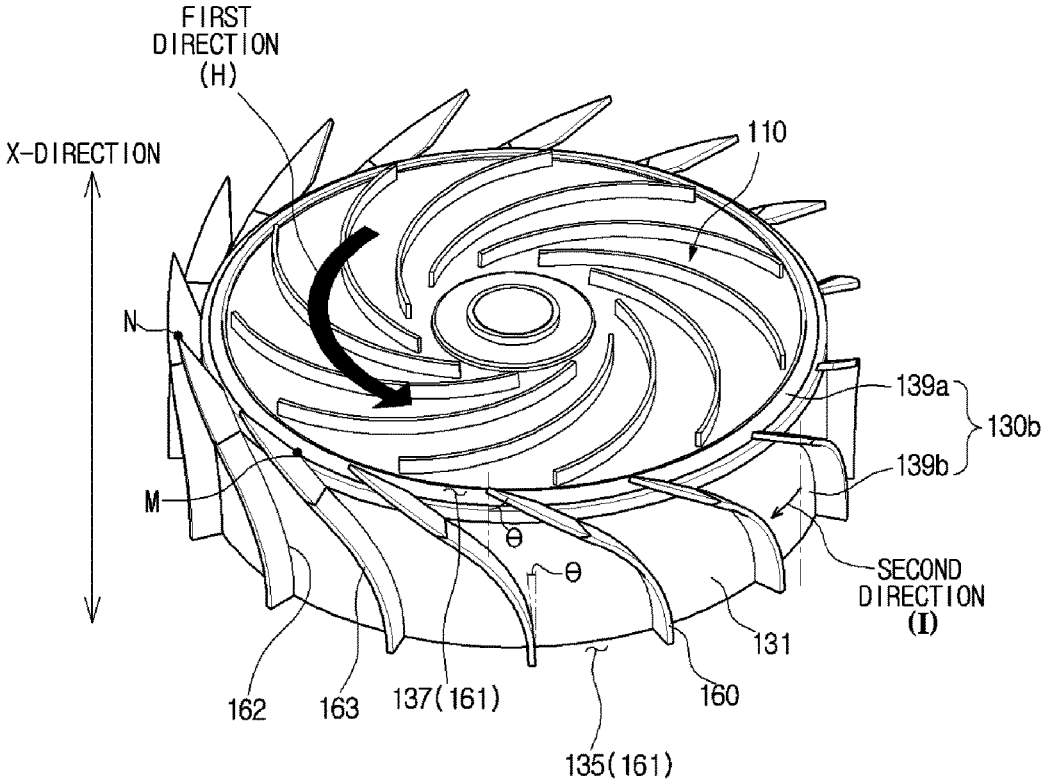
FIG. 7 illustrates a plurality of wings provided at a return channel in the inhalation unit of the cleaning device of FIG. 1.
Figure 8:
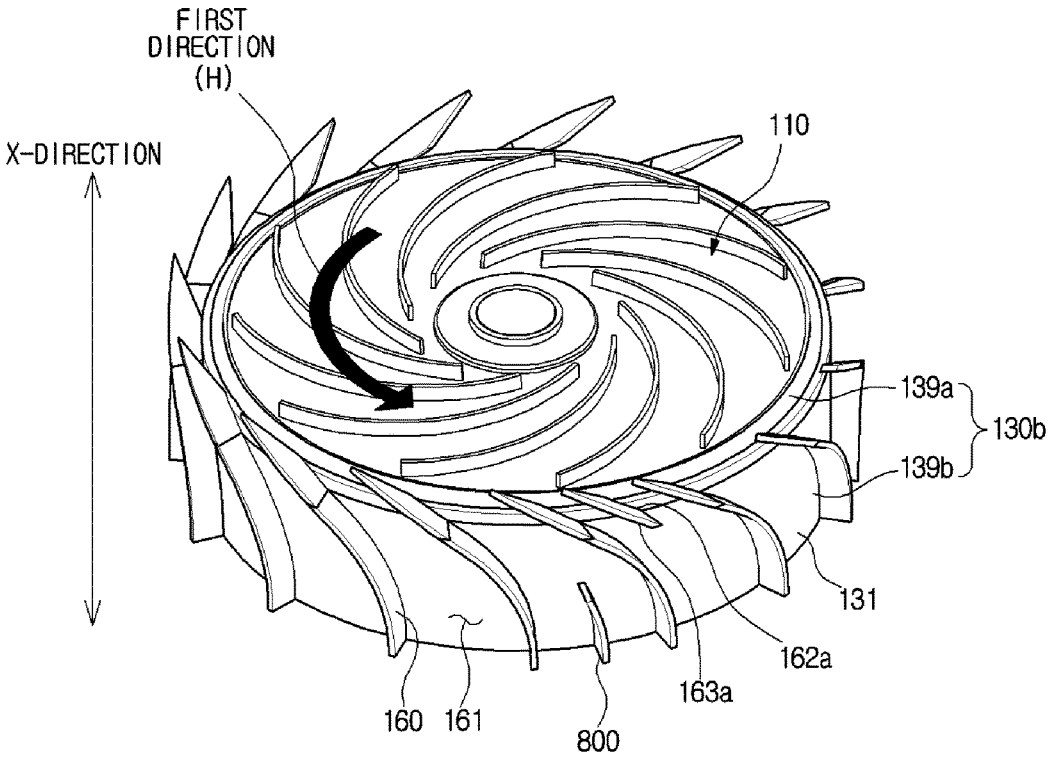
FIG. 8 illustrates a plurality of wings and at least one subwing provided at the return channel in the inhalation unit of the cleaning device of FIG. 1.

FIG. 7 illustrates a plurality of wings provided at a return channel in the inhalation unit of the cleaning device of FIG. 1, and FIG. 8 illustrates a plurality of wings and at least one subwing provided at the return channel in the inhalation unit of the cleaning device of FIG. 1. In FIGS. 7 and 8, the outer frame 132 of the return channel 130*b* is omitted for convenience of explanation. Unillustrated reference numerals refer to FIGS. 1 through 6.

As illustrated in FIGS. 7 and 8, the plurality of wings 160 may be disposed on the return channel 130*b*.

As described previously, the plurality of wings 160 may be formed lengthwise between the inner frame 131 and the outer frame 132 in the axial direction X of the impeller 110.

The plurality of wings 160 may be disposed on the return channel 130*b* so as to form a slope with respect to the axial direction X of the impeller 110. In detail, the plurality of wings 160 may be disposed between the inner frame 131 and the outer frame 132 so as to form a slope.

The plurality of wings 160 may be spaced apart from each other and may be disposed between the inner frame 131 and the outer frame 132. The plurality of wings 160 that are spaced apart from each other may define the discharge flow path 161 through which air passing through the impeller 110 moves.

The discharge flow path 161 may include an inlet 137 and an outlet 135. The inlet 137 of the discharge flow path 161 may be formed on a top end of the discharge flow path 161 that faces the impeller 110 so that air passing through the impeller 110 may be introduced into the discharge flow path 161 via the inlet 137. The outlet 135 of the discharge flow path 161 may be formed on a bottom end of the discharge flow path 161 so that air moving along the discharge flow path 161 may be ejected to an outer side of the inhalation unit 100*b* via the outlet 135.

A degree of separation between the plurality of wings 160 may be increased as they further face the outlet 135 of the discharge flow path 161. That is, as they go to the outlet 135 of the discharge flow path 161, the width of the discharge flow path 161 may be increased.

The plurality of wings 160 may include a first surface 162 and a second surface 163.

The first surface 162 may face an outer surface of the inner frame 131, and the second surface 163 may face an inner surface of the outer frame 132. The first surface 162 may include a starting point M placed on a top end of the first surface 162. The second surface 163 may include a starting point N placed on a top end of the second surface 163. The starting point N of the second surface 163 may constitute the inlet 137 of the discharge flow path 161 together with the starting point M of the first surface 162.

The plurality of wings 160 that constitute the inlet 137 of the discharge flow path 161 may be inclined at an angle between approximately 0° and 90° with respect to the axial direction X of the impeller 110. In detail, an angle θ of the second surface 163 of the plurality of wings 160 that constitute the inlet 137 of the discharge flow path 161 with respect to the axial direction X of the impeller 110 may be between approximately 0° and 90°.

Alternatively, the angle θ of a tangent of the plurality of wings 160 that constitute the inlet 137 of the discharge flow path 161 with respect to the axial direction X of the impeller 110 may be between approximately 0° and 90°.

The plurality of wings 160 that constitute the outlet 135 of the discharge flow path 161 may be inclined at an angle between approximately 0° and 90° with respect to the axial direction X of the impeller 110. In detail, the angle θ of the second surface 163 of the plurality of wings 160 that constitute the outlet 135 of the discharge flow path 161 with respect to the axial direction X of the impeller 110 may be between approximately 0° and 90° °.

Alternatively, the angle θ of the tangent of the plurality of wings 160 that constitute the outlet 135 of the discharge flow path 161 with respect to the axial direction X of the impeller 110 may be between approximately 0° and 90°.

The first surface 162 of the plurality of wings 160 may be coupled to the outer surface of the inner frame 131, and the second surface 163 of the plurality of wings 160 may be coupled to the inner surface of the outer frame 132.

The plurality of wings 160 may include curved surfaces.

A direction in which the plurality of wings 160 are inclined, has some connection with the rotation direction of the impeller 110. In detail, when the impeller 110 is rotated in a first direction H, the plurality of wings 160 may be inclined in a second direction I that is opposite to the first direction H with respect to the axial direction X of the impeller 110.

The number of the plurality of wings 160 of the return channel 130*b* may have some connection with the number of the plurality of rotation wings 113 of the impeller 110. In detail, when one of the number of the plurality of wings 160 and the number of the plurality of rotation wings 113 is divided by the other, a value obtained by this division may be an infinite decimal.

The number of at least one of the plurality of wings 160 and the plurality of rotation wings 113 may be an odd number. For example, the number of the plurality of wings 160 of the return channel 130*b* may be an odd number that is equal to or greater than 13 and is equal to or less than 23. However, the number of the plurality of wings 160 is not limited to the above example.

The return channel 130*b* may further include at least one subwing 800.

At least one subwing 800 may serve to reduce noise that may occur when air passes through the inhalation unit 100*b*.

The at least one subwing 800 may be formed on the discharge flow path 161.

The at least one subwing 800 may be provided between the plurality of wings 160 so as to have the same inclination as that of the plurality of wings 160 that constitute the discharge flow path 161.

The at least one subwing 800 may be formed at at least one of the inlet 137 and the outlet 135 of the discharge flow path 161.

The at least one subwing 800 may have a lower height than that of the plurality of wings 160 in the axial direction X of the impeller 110. The at least one subwing 800 may have a height that is equal to or less than approximately 50% of the plurality of wings 160 in the axial direction X of the impeller 110.

The at least one subwing 800 may have different heights in the axial direction X of the impeller 110. Alternatively, the at least one subwing 800 may have the same heights in the axial direction X of the impeller 110.

The at least one subwing 800 may include a first surface 162*a* and a second surface 163*a*.

The first surface 162*a* may face the outer surface of the inner frame 131, and the second surface 163*a* may face the inner surface of the outer frame 132.

The first surface 162*a* of the at least one subwing 800 may be coupled to the outer surface of the inner frame 131, and the second surface 163*a* of the at least one subwing 800 may be coupled to the inner surface of the outer frame 132.

Alternatively, the first surface 162*a* of the at least one subwing 800 may be coupled to the outer surface of the inner frame 131, and the second surface 163*a* of the at least one subwing 800 may be spaced apart from the inner surface of the outer frame 132.

Alternatively, the first surface 162*a* of the at least one subwing 800 may be spaced apart from the outer surface of the inner frame 131, and the second surface 163*a* of the at least one subwing 800 may be coupled to the inner surface of the outer frame 132.

Figure 9:
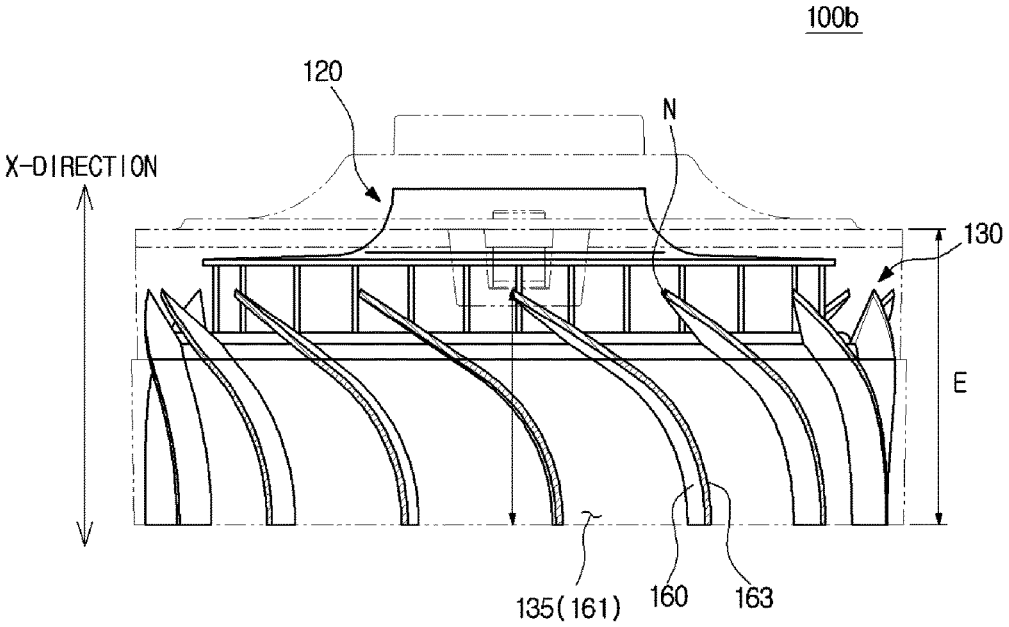
FIG. 9 is a front view illustrating the inhalation unit of the cleaning device of FIG. 1.

FIG. 9 is a front view illustrating the inhalation unit of the cleaning device of FIG. 1.

As illustrated in FIG. 9, the plurality of wings 160 may have a height that is equal to or greater than approximately 80% of the inhalation unit 100*b* in the axial direction X of the impeller 110. In detail, the second surface 163 of the plurality of wings 160 may have a height that is equal to or greater than approximately 80% of the inhalation unit 100*b* in the axial direction X of the impeller 110. A height E of the inhalation unit 100*b* refers to a distance from a top end of the impeller cover 120 to a bottom end of the return channel 130*b* in a state in which the impeller cover 120 and the return channel 130*b* are coupled to each other.

The plurality of wings 160 that correspond to the inlet 137 of the discharge flow path 161 may be spaced apart from each other by a predetermined gap downward from a top end of the height E of the inhalation unit 100*b* in the axial direction X of the impeller 110. In detail, the starting point N of the second surface 163 that constitutes the inlet 137 of the discharge flow path 161 may be spaced apart from the top end of the height E of the inhalation unit 100*b* downward in the axial direction X of the impeller 110 by a predetermined gap.

The plurality of wings 160 that correspond to the outlet 135 of the discharge flow path 161 may be placed at the same position as the bottom end of the height E of the inhalation unit 100*b* in the axial direction X of the impeller 110. In detail, the second surface 163 that constitutes the outlet 135 of the discharge flow path 161 may be placed at the same position as the bottom end of the height E of the inhalation unit 100*b* in the axial direction X of the impeller 110.

Figure 10:
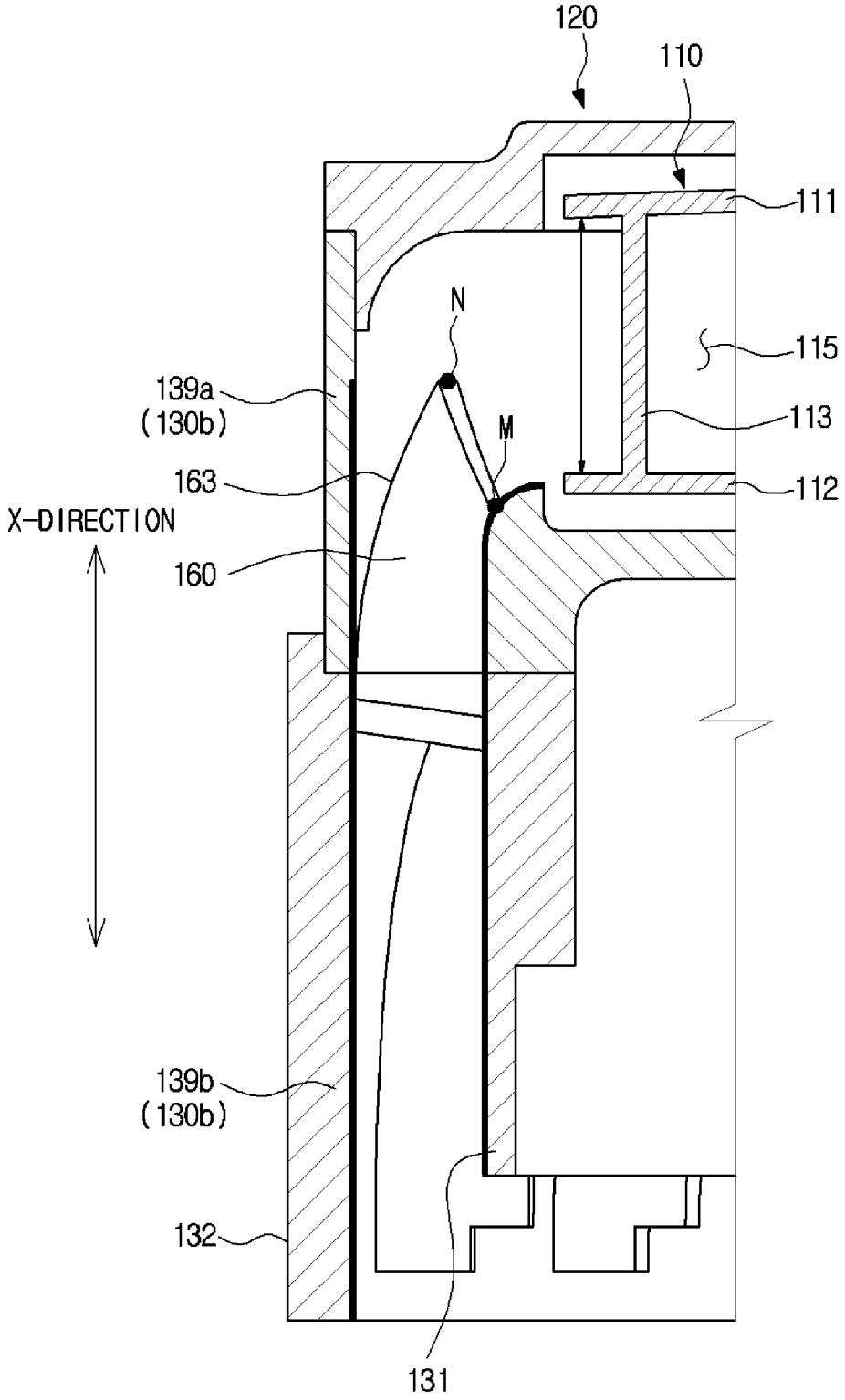
FIG. 10 is an enlarged cross-sectional view of part of the inhalation unit of the cleaning device of FIG. 1.

FIG. 10 is an enlarged cross-sectional view of part of the inhalation unit of the cleaning device according to the embodiment of the present invention. Unillustrated reference numerals refer to FIGS. 1 through 9.

As illustrated in FIG. 10, the starting point N of the second side 163 of the plurality of wings 160 may further extend upward toward the impeller cover 120 than the starting point M of the first surface 162 of the plurality of wings 160. That is, the starting point N of the second surface 163 may be formed at a higher position than the starting point M of the first side 162 in the axial direction X of the impeller 110.

The starting points N of the second surface 163 may be placed at a position that corresponds to be equal to or greater than 10% or to be equal to or less than 70% of a height of a flow path 115 formed at the impeller 110. The height of the flow path 115 formed at the impeller 110 refers to a distance between the first plate 111 and the second plate 112.

Figure 11:
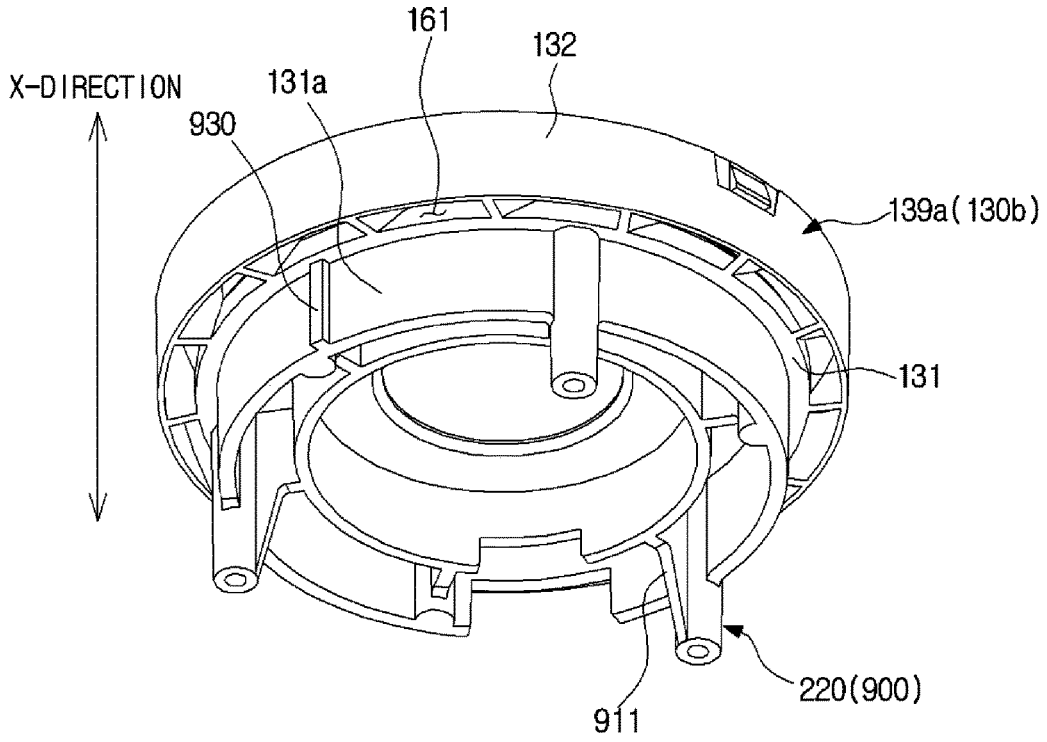
FIG. 11 is a bottom view of a first unit of the return channel in the inhalation unit of the cleaning device of FIG. 1.
Figure 12:
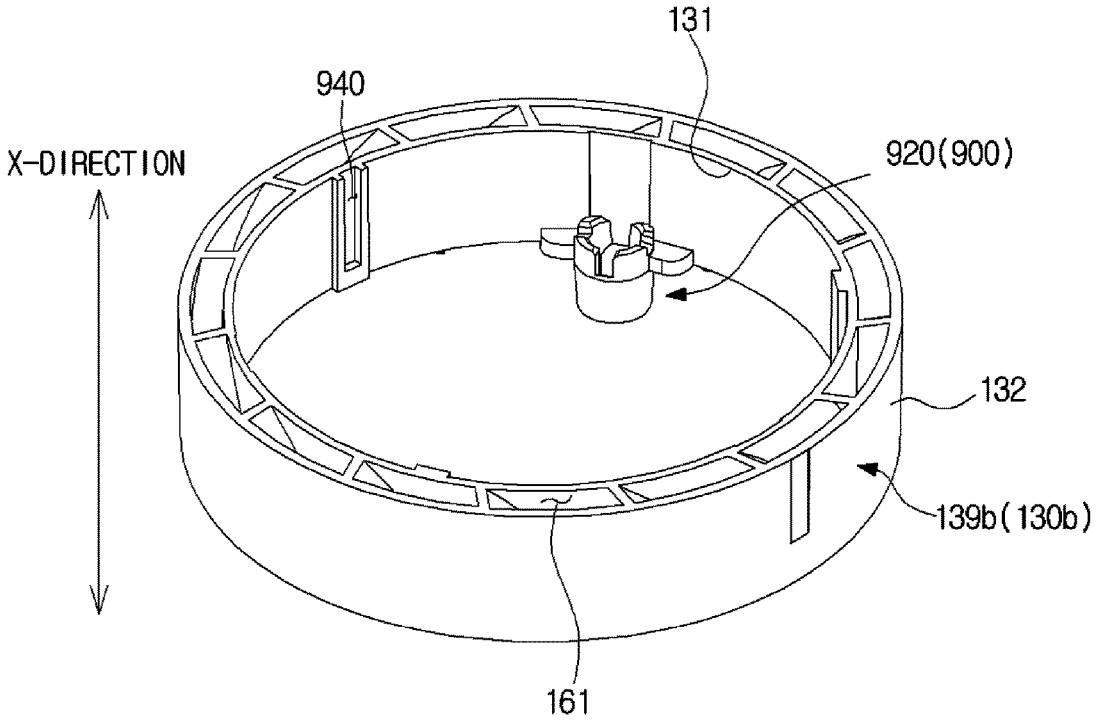
FIG. 12 is a top view of a second unit of the return channel in the inhalation unit of the cleaning device of FIG. 1.
Figure 13A:
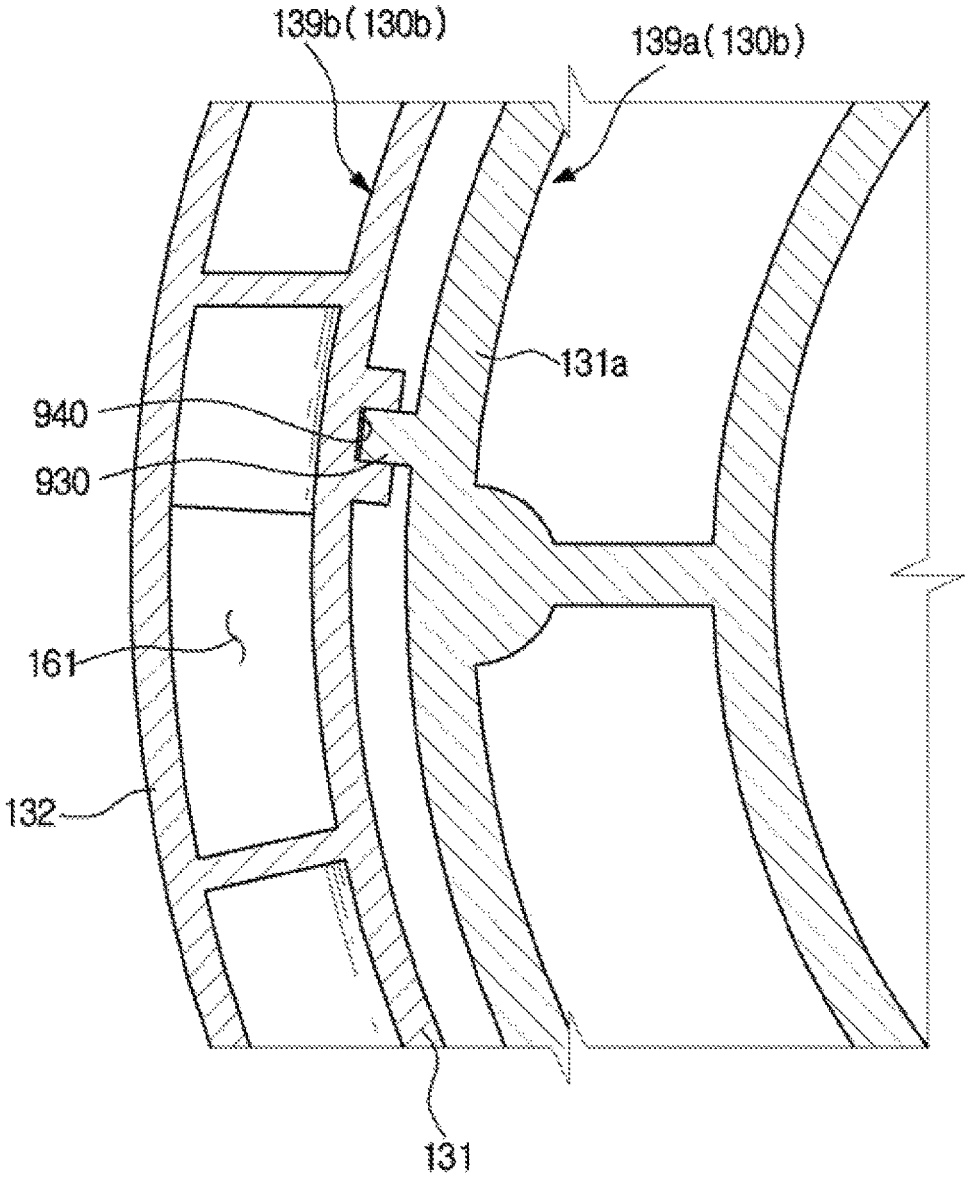
FIGS. 13A and 13B are cross-sectional views illustrating a coupling structure of first and second units of the return channel in the inhalation unit of the cleaning device of FIG. 1.
Figure 13B:
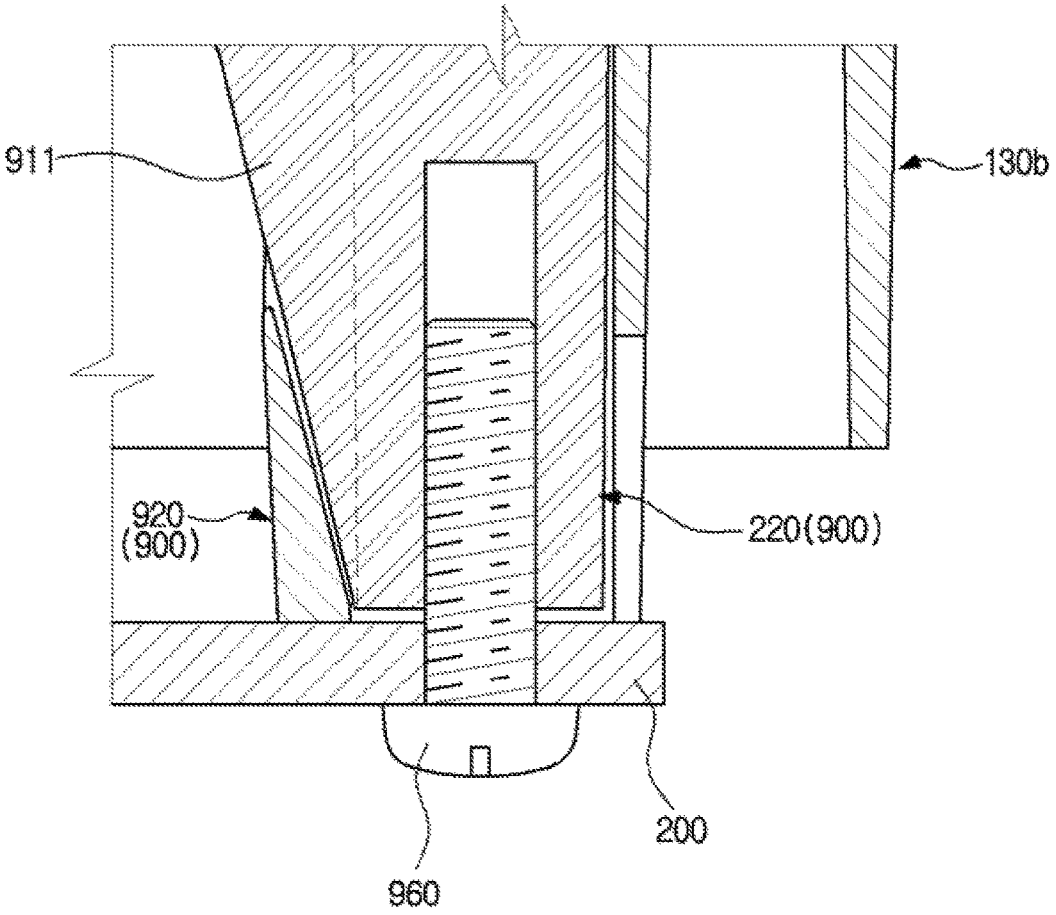

FIG. 11 is a bottom view of a first unit of the return channel in the inhalation unit of the cleaning device of FIG. 1, and FIG. 12 is a top view of a second unit of the return channel in the inhalation unit of the cleaning device of FIG. 1. FIGS. 13A and 13B are cross-sectional views illustrating a coupling structure of first and second units of the return channel in the inhalation unit of the cleaning device of FIG. 1. Unillustrated reference numerals refer to FIGS. 1 through 10.

As illustrated in FIGS. 11 through 13B, the return channel 130*b* may further include at least one rotation prevention unit 900 that causes the plurality of units 139*a* and 139*b* to be coupled to each other.

The at least one rotation prevention unit 900 may be formed at an inner side of the return channel 130*b* so as to be spaced apart from each other. The at least one rotation prevention unit 900 may be spaced apart from each other by a predetermined gap.

The at least one rotation prevention unit 900 may include a protrusion 220 and a fastening portion 920.

The protrusion 220 may be provided at an inner side of at least one of the first unit 139*a* and the second unit 139*b*. In detail, the protrusion 220 may be provided at the inner frame 131 of at least one of the first unit 139*a* and the second unit 139*b*.

The fastening portion 920 may be provided at an inner side of the other of the first unit 139*a* and the second unit 139*b*. In detail, the fastening portion 920 may be provided at the inner frame 131 of the other of the first unit 139*a* and the second unit 139*b*. The protrusion 220 may be separably coupled to the fastening portion 920.

The protrusion 220 may be provided at an inner side of the first unit 139*a*. The protrusion 220 may be provided at the inner frame 131 of the first unit 139*a* so as to protrude downward in the axial direction X of the impeller 110. The protrusion 220 may be formed integrally with the inner frame 131 of the first unit 139*a*.

The protrusion 220 may have a shape of a circular protrusion; however, embodiments of the present invention are not limited thereto.

A rib 911 that protrudes toward the inner side of the inner frame 131 may be formed at the protrusion 220. The rib 911 may be connected to the protrusion 220 so that a degree of protrusion toward the inner side of the inner frame 131 may be reduced as it goes to a downward direction in the axial direction X of the impeller 110. The rib 911 may be formed integrally with the protrusion 220.

The fastening portion 920 may be provided at an inner side of the second unit 139*b*. The fastening portion 920 may be provided at the inner surface of the inner frame 131 of the second unit 139*b*.

The protrusion 220 formed at the first unit 139*a* may be coupled to the fastening portion 920 provided at the second unit 139*b*. In this case, one end of the rib 911 that faces a downward direction in the axial direction X of the impeller 110 may be coupled and fixed to a fastening groove (not shown) provided in an inner surface of the fastening portion 920.

The inner frame 131 of the first unit 139*a* may include an extension portion 131*a* that protrudes downward in the axial direction X of the impeller 110. The extension portion 131*a* may have a shape of a circular protrusion with a smaller diameter than that of the inner frame 131. However, the shape of the extension portion 131*a* is not limited to the circular protrusion. The extension portion 131*a* may be coupled to an inner side of the second unit 139*b*. The extension portion 131*a* may be coupled to an inner side of the inner frame 131 of the second unit 139*b*.

The protrusion 220 of the first unit 139*a* may be provided at the extension portion 131*a*.

The protrusion 220 of the first unit 139*a* may constitute part of the extension portion 131*a*.

At least one fixing portion 930 that protrudes toward the outer side of the first unit 139*a* may be provided on an outer surface of the extension portion 131*a*. That is, the at least one fixing portion 930 may protrude outward in a radial direction of the first unit 139*a*. In this case, the at least one fixing portion 930 does not block the discharge flow path 161.

The at least one fixing portion 930 may be coupled to fixing grooves 940 provided at the inner frame 131 of the second unit 139*b*. The fixing grooves 940 may be provided on the inner surface of the inner frame 131 of the second unit 139*b*. The at least one fixing portion 930 may be separably coupled to the fixing grooves 940. The number of fixing grooves 940 and the number of the at least one fixing portion 930 may be the same.

Thus, the first unit 139*a* and the second unit 139*b* of the return channel 130*b* may be separably coupled to each other by the at least one rotation prevention unit 900. Also, by coupling the at least one fixing portion 930 and the fixing grooves 940, coupling of the first unit 139*a* and the second unit 139*b* can be more firmly performed.

Figure 14:
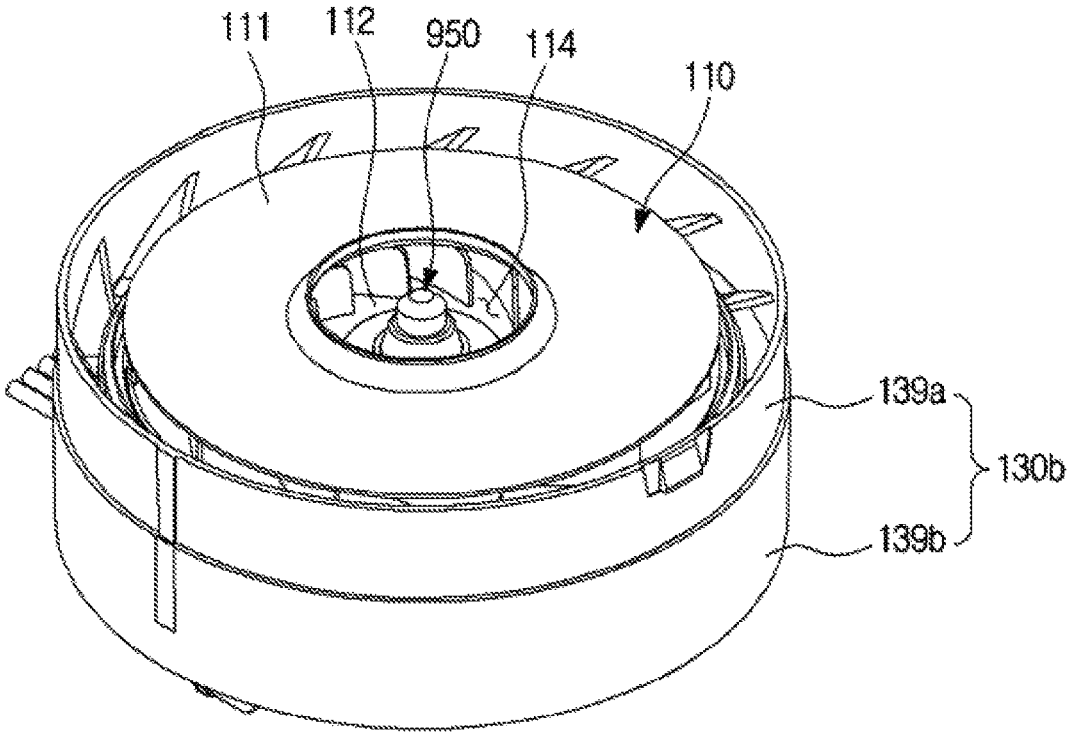
FIG. 14 illustrates a structure including a nose cone in the inhalation unit of the cleaning device of FIG. 1.

FIG. 14 illustrates a structure including a nose cone in the inhalation unit of the cleaning device of FIG. 1. Unillustrated reference numerals refer to FIGS. 1 through 13B.

As illustrated in FIG. 14, the inhalation unit 100*b* may further include a nose cone 950. The nose cone 950 may be designed in a steamlined shape so as to have less aerodynamic resistance. The nose cone 950 may be provided on the second plate 112 of the impeller 110 so as to correspond to the position of the opening hole 114 formed in the first plate 111 of the impeller 110. The nose cone 950 may be coupled to one end of the motor shaft 141 fixed onto the second plate 112. The nose cone 950 is installed at the second plate 112 of the impeller 110 so that resistance of air introduced into the impeller 110 via the opening hole 114 can be reduced and inhalation efficiency of the inhalation unit 100*b* can be improved.

Figure 15:
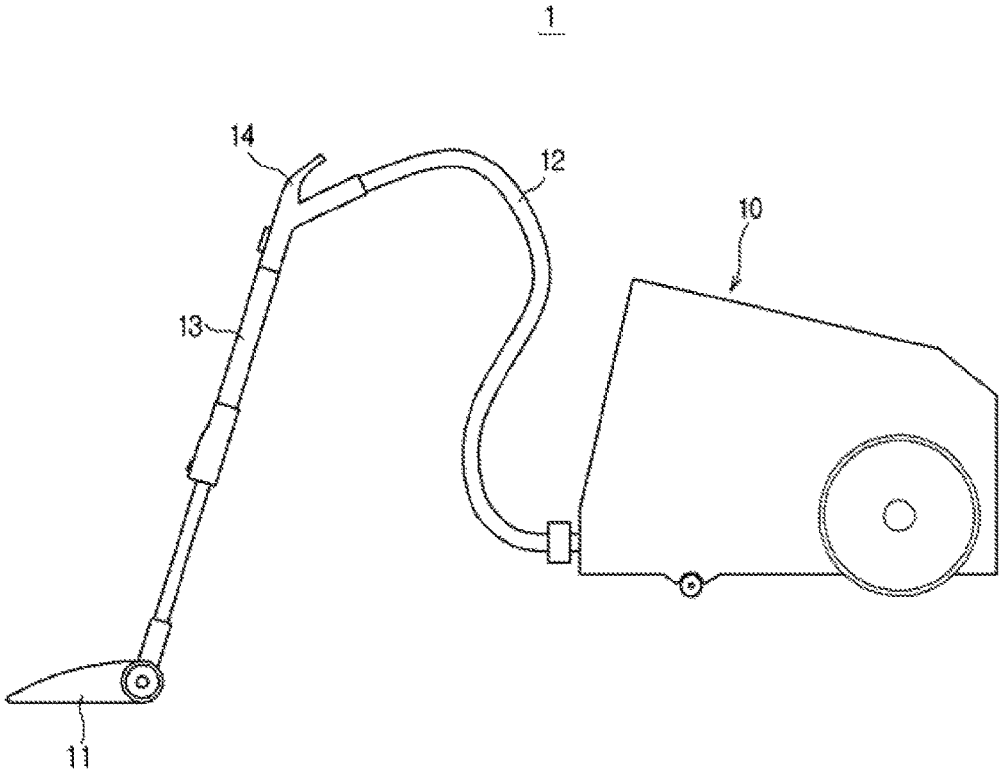
FIG. 15 illustrates an exterior of a cleaning device according to another embodiment of the present invention.

FIG. 15 illustrates an exterior of a cleaning device according to another embodiment of the present invention.

As illustrated in FIG. 15, a cleaning device 1 may include an inhalation portion 11 that inhales foreign substances by inhalation force of air, and a main body 10 onto which the foreign substances inhaled by the inhalation portion 11 are collected.

A space between the main body 10 and the inhalation portion 11 may be connected by a connection hose 12 and a connection pipe 13 so that inhalation force generated in the main body 10 may be transferred to the inhalation portion 11, and a handle 14 may be provided between the connection hose 12 and the connection pipe 13 so that the user may grasp the handle 14 with his/her hand.

The connection hose 12 may be formed as an extendable bellows pipe, and one end of the connection hose 12 may be connected to the main body 10, and the other end of the connection hose 12 may be connected to the handle 14 so that the inhalation portion 11 may be freely moved within a constant radius centering on the main body 10. The connection pipe 13 may be formed to have a predetermined length. One end of the connection pipe 13 may be connected to the inhalation portion 11, and the other end of the connection pipe 13 may be connected to the handle 14 so that the user at a standing position can clean foreign substances on the floor.

Figure 16:
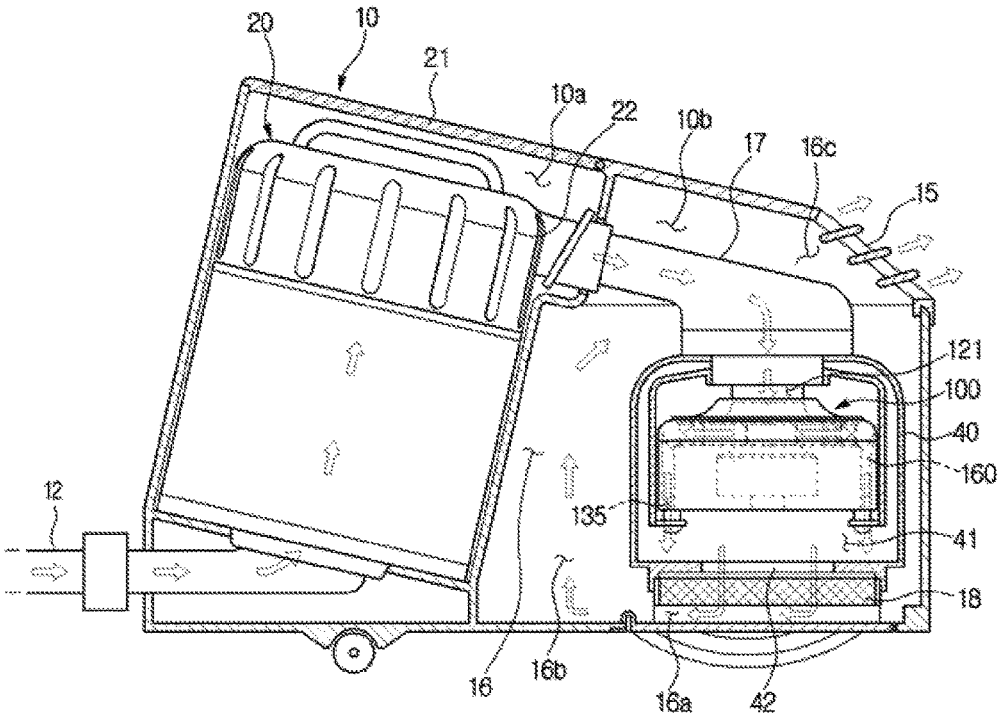
FIG. 16 is a cross-sectional view of a main body of the cleaning device illustrated in FIG. 15.
Figure 17:
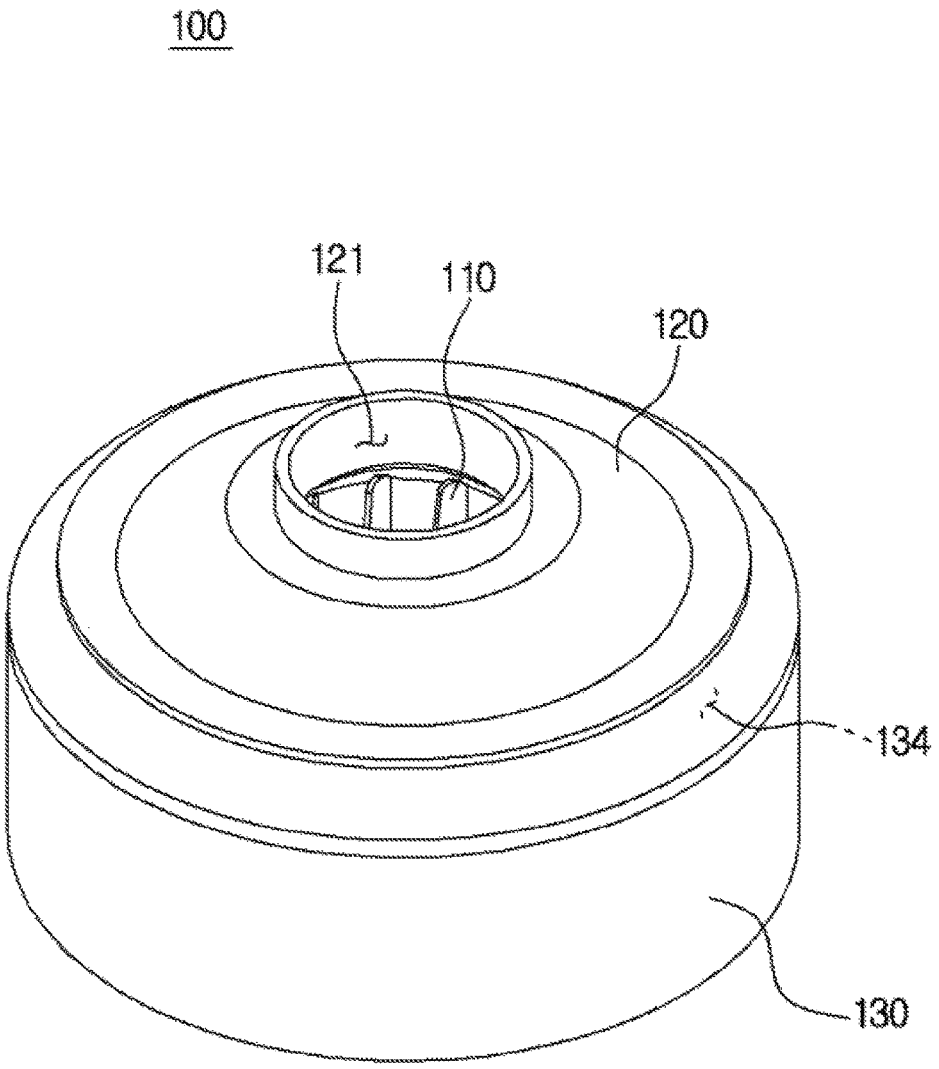
FIG. 17 is a perspective view illustrating an inhalation unit of the cleaning device of FIG. 15.
Figure 18:
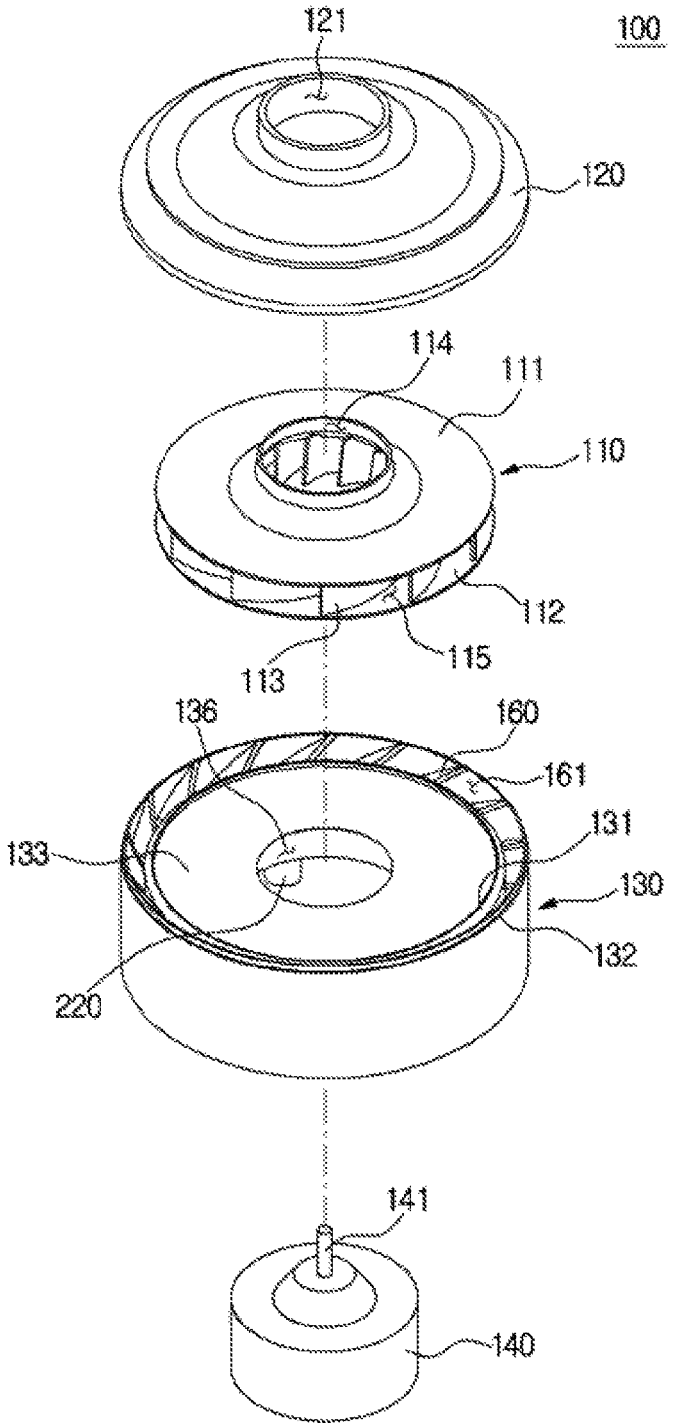
FIG. 18 is an exploded perspective view of the inhalation unit of the cleaning device of FIG. 15.
Figure 19:
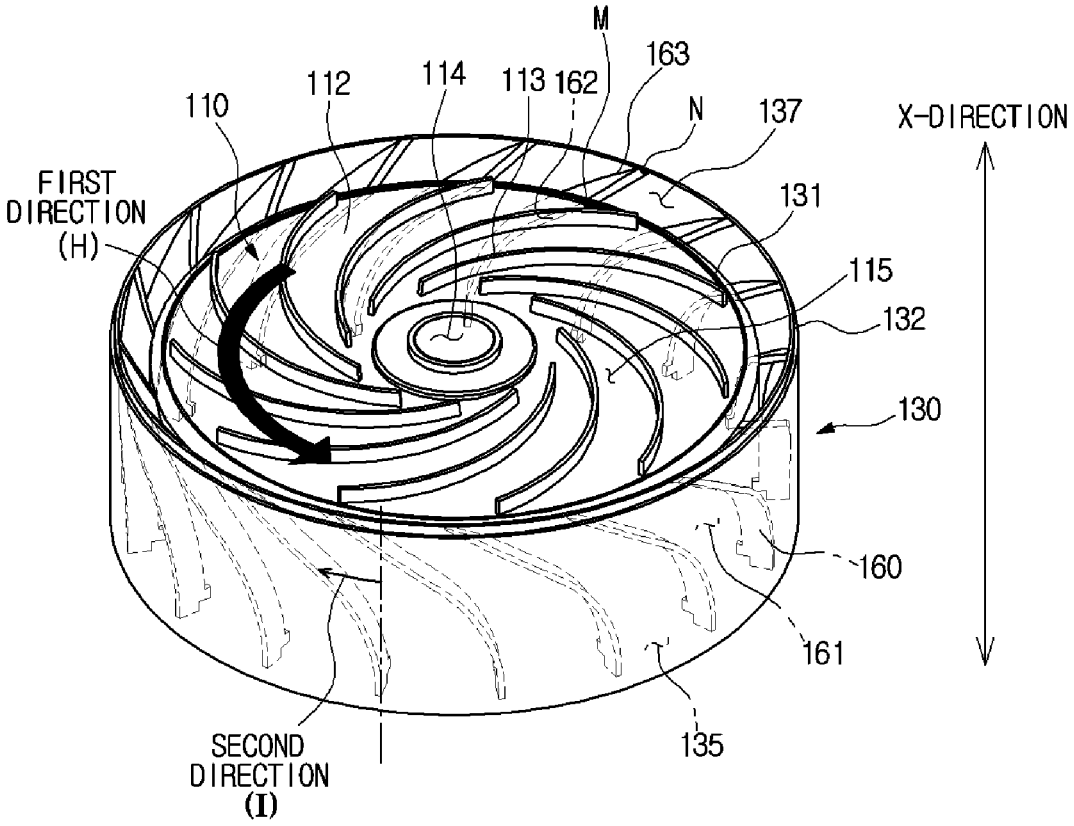
FIG. 19 is an enlarged perspective view of part of the inhalation unit of the cleaning device of FIG. 15.
Figure 20:
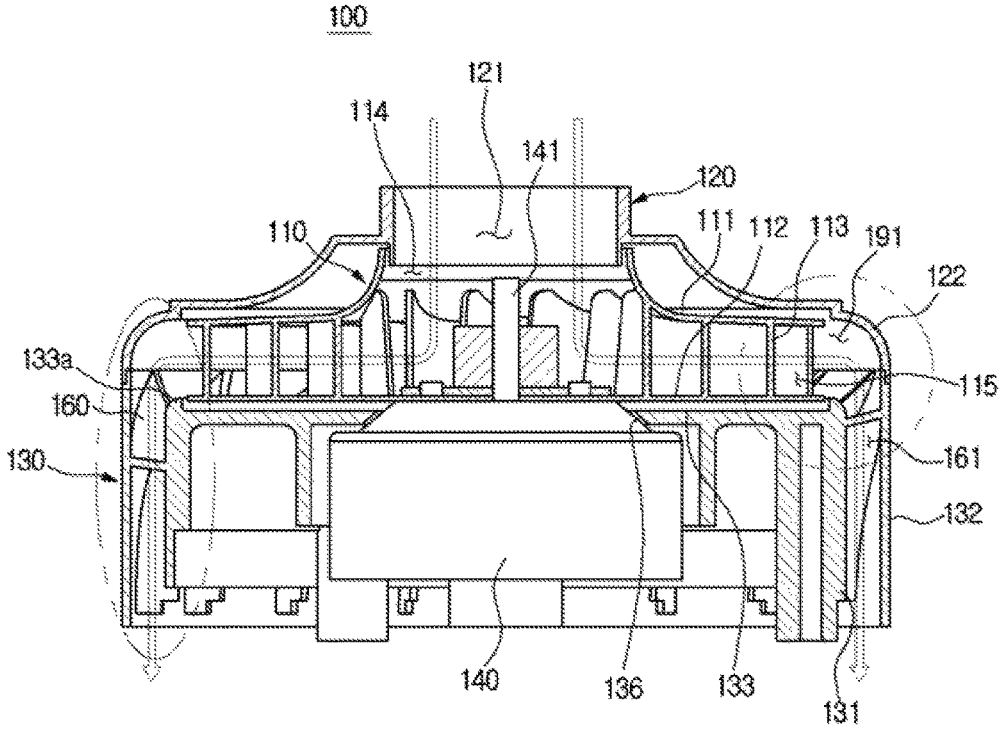
FIG. 20 is a cross-sectional view of the inhalation unit of the cleaning device of FIG. 15.
Figure 21:
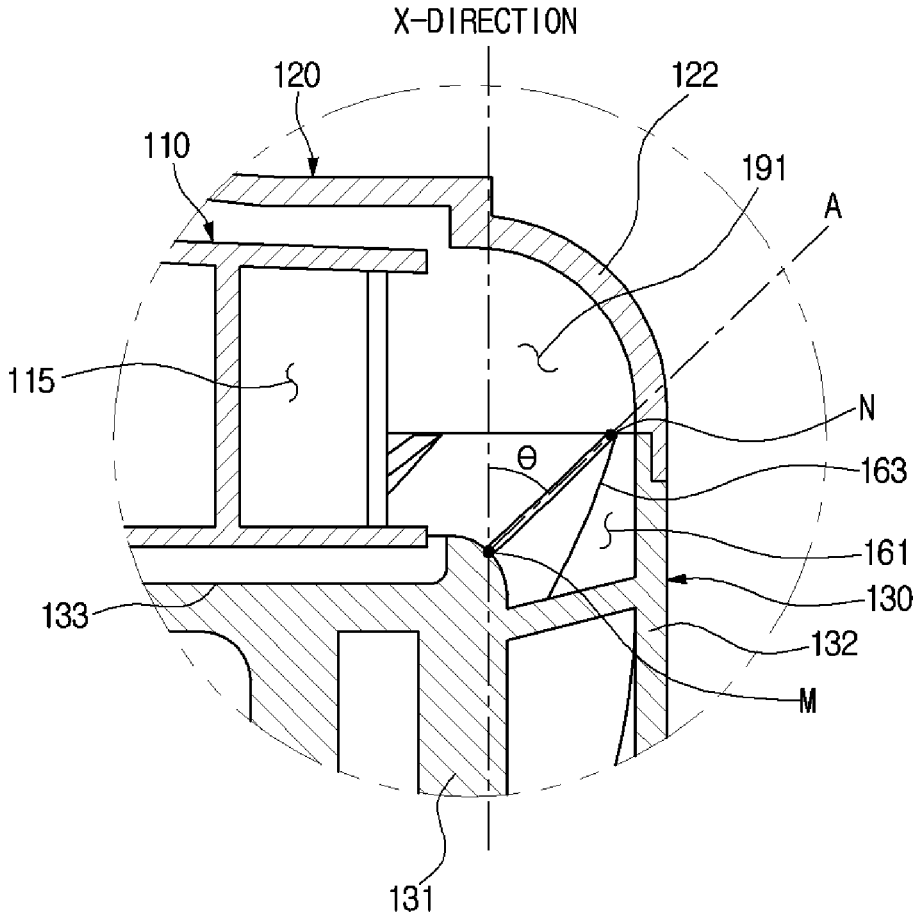
FIG. 21 is an enlarged cross-sectional view of part of the inhalation unit of the cleaning device of FIG. 15.

FIG. 16 is a cross-sectional view of a main body of the cleaning device illustrated in FIG. 15, and FIG. 17 is a perspective view illustrating an inhalation unit of the cleaning device of FIG. 15. FIG. 18 is an exploded perspective view of the inhalation unit of the cleaning device of FIG. 15, and FIG. 19 is an enlarged perspective view of part of the inhalation unit of the cleaning device of FIG. 15. FIG. 20 is a cross-sectional view of the inhalation unit of the cleaning device of FIG. 15, and FIG. 21 is an enlarged cross-sectional view of part of the inhalation unit of the cleaning device of FIG. 15.

As illustrated in FIGS. 16 through 21, the connection hose 12 may be connected to a front portion of the main body 10, and air inhaled by the inhalation portion 11 may be transferred to an inside of the main body 10 along the connection hose 12. An exhaust portion 15 may be formed at an upper portion of a rear portion of the main body 10 so that air, of which foreign substances are filtered by a dust collecting unit 20 provided in the main body 10 may be discharged to an outside of the main body 10. Also, the inside of the main body 10 may be partitioned into a dust collecting chamber 10*a* in which the dust collecting unit 20 is installed, an inhalation chamber 10*b* in which an inhalation unit 100 and a discharge flow path 161 are provided, and a code chamber (not shown) in which a power supply code (not shown) is provided.

The dust collecting unit 20 may be installed in the dust collecting chamber 10*a* so as to collect dust inhaled into the dust collecting chamber 10*a* via the connection hose 12. In the present embodiment, a cyclone unit is used as a unit that separates foreign substances in air inhaled into the dust collecting unit 20 using centrifugal force. However, a dust box that collects dust may also be used. Also, a cover 21 may be hinge-coupled to an upper portion of the dust collecting chamber 10*a* so that the dust collecting unit 20 may be detached from the dust collecting chamber 10*a*.

The cleaning device 1 may include an inhalation unit 100 to generate inhalation force to inhale external air into the main body 10. The inhalation unit 100 may be installed in the inhalation chamber 10*b*.

The inhalation unit 100 may include an impeller 110, an impeller cover 120, and a return channel 130.

An inlet damper 121 may be formed at the impeller cover 120. The inlet damper 121 may be connected to an ejection hole 22 of the dust collecting unit 20 via a connection pipe 17 and may generate inhalation force in the dust collecting unit 20.

The rotatable impeller 110 may be provided at an inner side of the impeller cover 120.

The impeller 110 may be configured as a centrifugal fan that inhales air in an axial direction of the impeller 110 and ejects inhaled air in a radial direction.

The impeller 110 may include a first plate 111, a second plate 112, and a plurality of rotation wings 113.

The first plate 111 and the second plate 112 may be disposed in a vertical direction so as to face each other, and the plurality of rotation wings 113 may be placed between the first plate 111 and the second plate 112.

A top surface of each of the plurality of rotation wings 113 may be coupled to the first plate 111 placed at upper portions of the plurality of rotation wings 113, and a bottom surface of each of the plurality of rotation wings 113 may be coupled to the second plate 112 placed at lower portions of the plurality of rotation wings 113. Thus, the first plate 111, the second plate 112, and the plurality of rotation wings 113 may be rotated as an integral part.

An opening hole 114 that corresponds to the inlet damper 121 of the impeller cover 120 may be formed in the first plate 111. Air that passes through the inlet damper 121 may be introduced into the impeller 110 via the opening hole 114.

One end of a motor shaft 141 may be fixed onto the second plate 112. Thus, the first plate 111, the second plate 112, and the plurality of rotation wings 113 may be integrally rotated around the motor shaft 141.

The plurality of rotation wings 113 placed between the first plate 111 and the second plate 112 so as to be spaced apart from each other may define a flow path 115. Air that passes through the opening hole 114 and is introduced into the impeller 110 may move along the flow path 115 and may be transferred to a discharge flow path 161 formed on the return channel 130.

The impeller 110 may include a 3D impeller including a body that is lowered as it goes to the radial direction, and a blade.

The impeller 110 may be modified in various shapes, and the shape of the impeller 110 is not limited to the above example.

The return channel 130 may convert kinetic energy of air introduced by the impeller 110 into pressure energy, may be coupled to the impeller cover 120 and may constitute an impeller accommodation space 134 in which the impeller 110 may be accommodated.

The return channel 130 may be disposed at a lower side of the impeller 110.

The return channel 130 may directly be coupled to the impeller 110 so that air passing through the impeller 110 may directly be introduced into the return channel 130.

The return channel 130 may include an inner frame 131 and an outer frame 132.

The return channel 130 may be placed at the lower portion of the impeller 110, and a mounting portion 133 on which the impeller 110 is mounted, may be formed on a top surface of the inner frame 131.

The mounting portion 133 may include a protrusion portion 133*a* that protrudes upward toward the impeller cover 120. The protrusion portion 133*a* may be formed along edges of the mounting portion 133. The impeller 110 may be mounted on the mounting portion 133 so as to be placed at an inner side of the protrusion portion 133*a*.

The protrusion portion 133*a* may have a curved surface.

The protrusion portion 133*a* may have a curved surface that is convex toward an outer side of the inner frame 131.

The outer fame 132 may be placed at the outer side of the inner frame 131 along an outer circumferential surface of the inner frame 131, may be coupled to the impeller cover 120, and may define the impeller accommodation space 134 in which the impeller 110 is accommodated.

The inner frame 131 and the outer frame 132 may be formed as an integral part.

The plurality of wings 160 may be disposed on the return channel 130.

The plurality of wings 160 may be disposed lengthwise between the inner frame 131 and the outer frame 132 in an axial direction X of the impeller 110. Thus, the plurality of wings 160 may constitute the discharge flow path 161 that is long in the axial direction X of the impeller 110 so that inhalation performance of the inhalation unit 100 can be improved.

The plurality of wings 160 may be disposed on the return channel 130 so as to form a slope with respect to the axial direction X of the impeller 110. In detail, the plurality of wings 160 may be disposed between the inner frame 131 and the outer frame 132.

The plurality of wings 160 may be spaced apart from each other and may be disposed between the inner frame 131 and the outer frame 132. The plurality of wings 160 that are spaced apart from each other may define the discharge flow path 161 on which air passing through the impeller 110 moves.

The discharge flow path 161 may include an inlet 137 and an outlet 135. The inlet 137 of the discharge flow path 161 may be formed on a top end of the discharge flow path 161 that faces the impeller 110, so that air passing through the impeller 110 may be introduced into the discharge flow path 161 via the inlet 137. The outlet 135 of the discharge flow path 161 may be formed on a bottom end of the discharge flow path 161 so that air that moves along the discharge flow path 161 may be ejected toward an outer side of the inhalation unit 100 via the outlet 135.

A degree of separation between the plurality of wings 160 may be increased as it goes to the outlet 135 of the discharge flow path 161. That is, as they get closer to the outlet 135 of the discharge flow path 161, the width of the discharge flow path 161 may be increased.

The plurality of wings 160 may include a first surface 162 and a second surface 163.

The first surface 162 may face an outer surface of the inner frame 131, and the second surface 163 may face an inner surface of the outer frame 132. The first surface 162 may include a starting point M placed on a top end of the first surface 162. The second surface 163 may include a starting point N placed on a top end of the second surface 163. The starting point N of the second surface 163 may constitute the inlet 137 of the discharge flow path 161 together with the starting point M of the first surface 162.

The first surface 162 of the plurality of wings 160 may be coupled to the outer surface of the inner frame 131, and the second surface 163 of the plurality of wings 160 may be coupled to the inner surface of the outer frame 132.

The first surface 162 of the plurality of wings 160 may also be coupled to an outer surface of the protrusion portion 133*a*. That is, the starting point M of the first surface 162 may be coupled to the outer surface of the protrusion portion 133*a* that is convex toward the outer side of the inner frame 131.

The plurality of wings 160 may further include a connection portion 164 that connects the starting point M of the first surface 162 and the starting point N of the second surface 163. A description of various shapes of the connection portion 164 will be provided later.

The plurality of wings 160 may have curved surfaces.

A direction in which the plurality of wings 160 are inclined, has some connection with the rotation direction of the impeller 110. In detail, when the impeller 110 is rotated in a first direction H, the plurality of wings 160 may be inclined in a second direction I that is opposite to the first direction H with respect to the axial direction X of the impeller 110.

The impeller cover 120 may include a guide portion 122. In detail, the guide portion 122 guides air that passes through the flow path 115 of the impeller 110 to the inlet 137 of the discharge flow path 161.

The guide portion 122 may have a curved surface in such a way that air passing through the flow path 115 may be prevented from remaining in a space 191 formed between the impeller 110 and the return channel 130 before air passing through the flow path 115 is introduced into the inlet 137 of the discharge flow path 161. The guide portion 122 may have a curved surface that is convex toward the outer side of the impeller cover 120.

The guide portion 122 may have a curved surface with a radius of curvature of 1 mm or more.

Air that passes through the flow path 115 provided at the impeller 110 is introduced into the discharge flow path 161 provided on the return channel 130 along the guide portion 122.

A movement direction of air may vary according to the guide portion 122. In detail, air that passes through the opening hole 114 and is introduced into the impeller 110 moves in a horizontal direction along the flow path 115, and air that passes through the flow path 115 collides with the guide portion 122 and moves in a vertical direction toward the discharge flow path 161.

One end of the guide portion 122 that faces a downward direction may be coupled to the outer frame 132.

The inhalation unit 100 may further include a motor 140 that provides driving force for rotating the impeller 110.

The motor 140 may include a BLDC motor, a DC motor, and an AC motor.

The motor 140 may be provided in the return channel 130. In detail, the motor 140 may be provided in the inner frame 131.

The motor 140 may include the motor shaft 141. One end of the motor shaft 141 is connected to the second plate 112 of the impeller 110, and the other end of the motor shaft 141 is connected to the motor 140.

A motor shaft penetration hole 136 may be formed in the mounting portion 133 of the inner frame 131 so that one end of the motor shaft 141 may be connected to the second plate 112 of the impeller 110 placed at an upper portion of the inner frame 131.

Air that is ejected to the outlet 135 formed at one end of the discharge flow path 161 is discharged through a discharge port 42 formed at a lower portion of the inhalation unit 100 via an internal flow path 41 formed in a case 40 that surrounds the inhalation unit 100. Air discharged through the discharge port 42 is exhausted by the exhaust portion 15 via an exhaust flow path 16. Here, the exhaust flow path 16 refers to a flow path on which air discharged from the discharge port 42 of the inhalation unit 100 reaches the exhaust portion 15.

A space formed between the dust collecting unit 20 and the inhalation unit 100 may constitute part of the exhaust flow path 16.

The exhaust flow path 16 may be bent at least once. The exhaust flow path 16 may include a first flow path 16*a* from the discharge port 42 of the inhalation unit 100 to a space between the dust collecting unit 20 and the inhalation unit 100, a second flow path 16*b* that extends from the first flow path 16*a* and is formed between the dust collecting unit 20 and the inhalation unit 100, and a third flow path 16*c* that connects the second flow path 16*b* and the exhaust portion 15.

An exhaust filter 18 may be installed on the exhaust flow path 16 so as to separate unremoved foreign substances from the dust collecting unit 20. The exhaust filter 18 may be installed on the first flow path 16*a* or the second flow path 16*b*. This is because, if the exhaust filter 18 is installed on the first flow path 16*a* or the second flow path 16*b*, a sufficient distance from the exhaust filter 18 to the exhaust portion 15 can be secured so that air can be exhausted through the exhaust portion 15 after noise occurring when air passes through the exhaust filter 18 is sufficiently reduced. Also, the exhaust filter 18 is installed on the first flow path 16*a* or the second flow path 16*b* having a relatively large cross-sectional area so that a sufficient area of the exhaust filter 18 can be secured and thus a pressure loss occurring when air passes through the exhaust filter 18 can be reduced.

An opening (not shown) that may be opened/closed by a door (not shown) may be formed in a bottom surface of the main body 10 so that replacement of the exhaust filter 18 can be easily performed.

Figure 22:
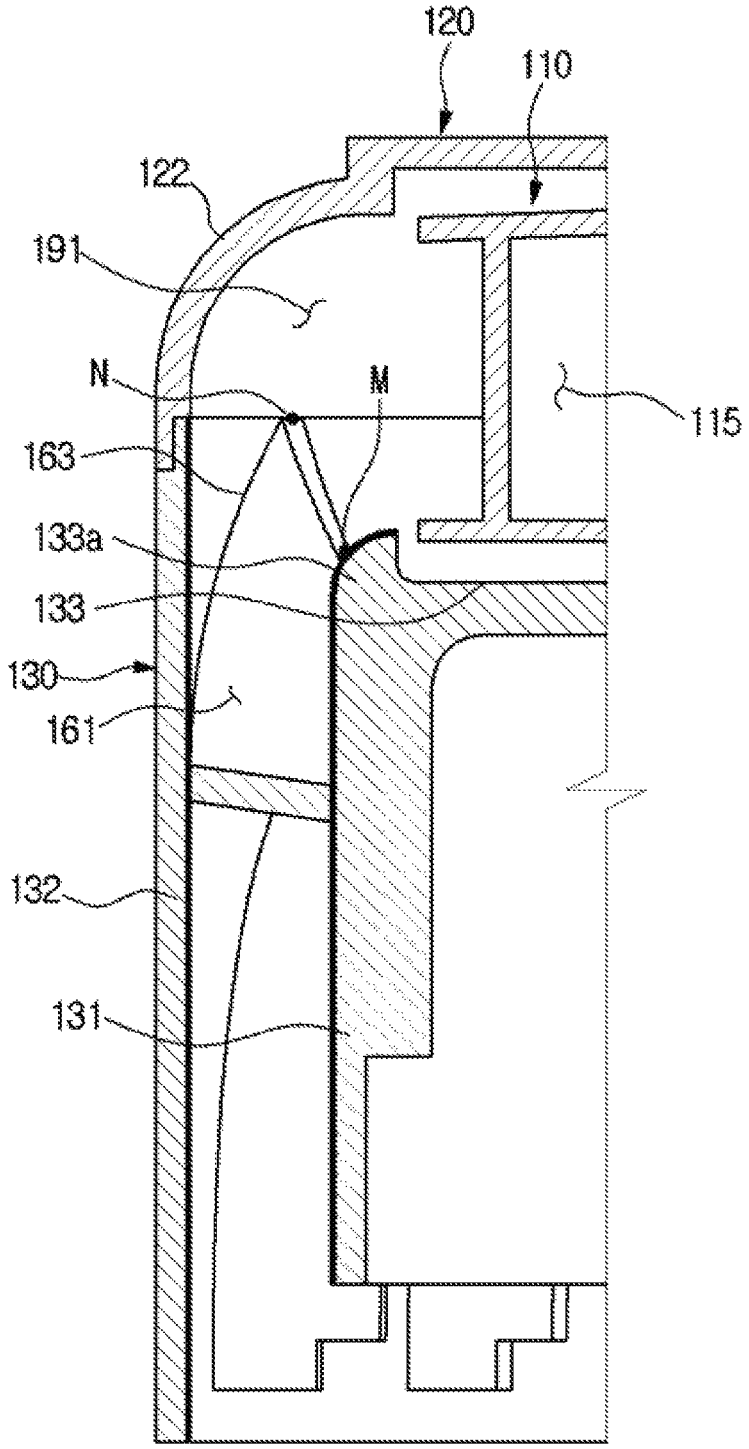
FIG. 22 is an enlarged cross-sectional view of another part of the inhalation unit of the cleaning device of FIG. 15.

FIG. 22 is an enlarged cross-sectional view of another part of the inhalation unit of the cleaning device of FIG. 15.

As illustrated in FIG. 22, a straight line A that connects the starting point M of the first surface 162 coupled to the inner frame 131 and the starting point N of the second surface 163 coupled to the outer frame 132 may form a slope between approximately 5° and 85° with respect to the axial direction X of the impeller 110.

Also, as described above, the guide portion 122 may have a curved surface that is convex toward the outer side of the impeller cover 120 and has a radius of curvature of 1 mm or more. The guide portion 122 may also have a quadratic curved surface.

Figure 23:
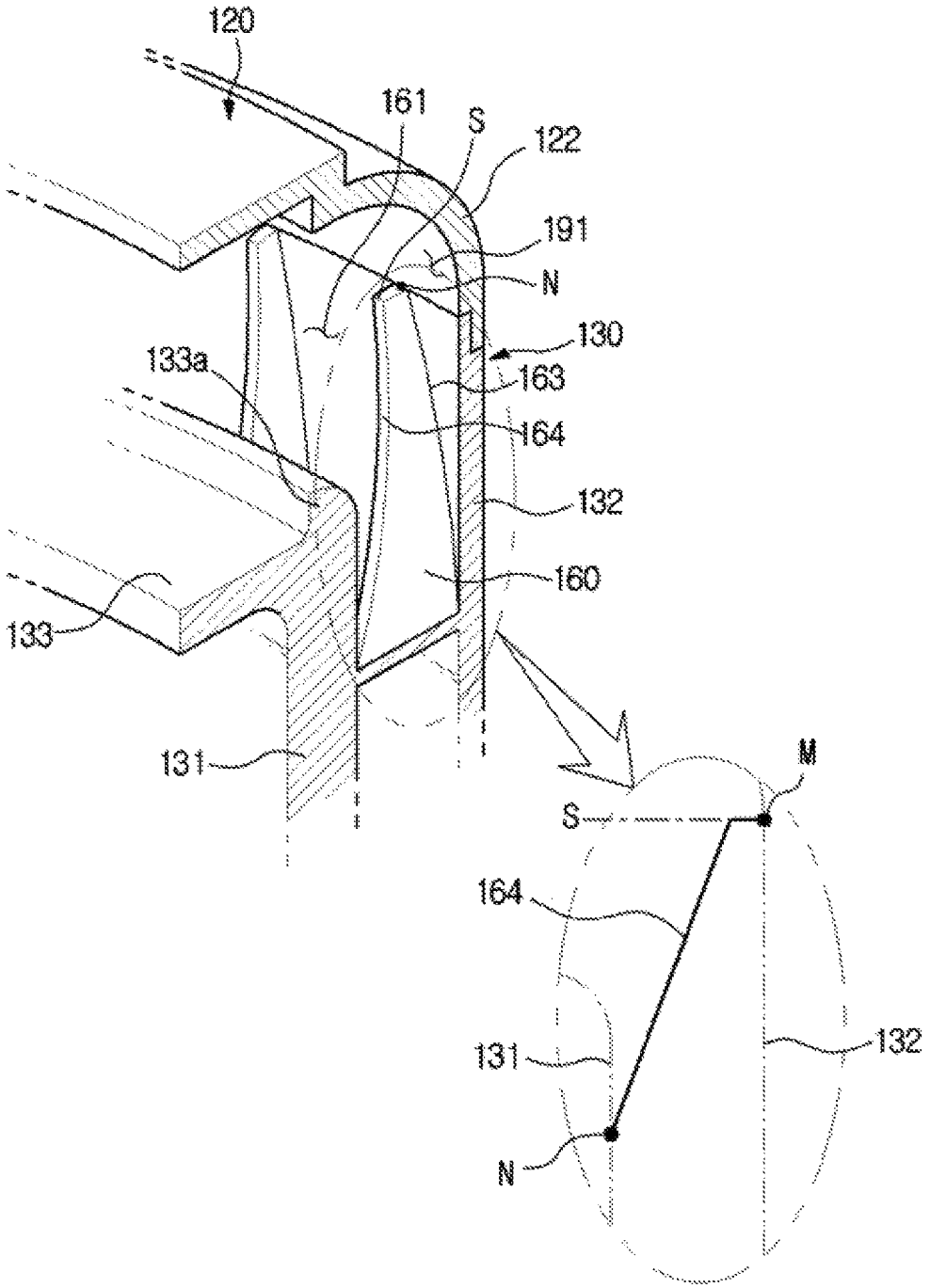
FIG. 23 illustrates part of a plurality of wings arranged between an inner frame and an outer frame of the cleaning device of FIG. 15.
Figure 24A:
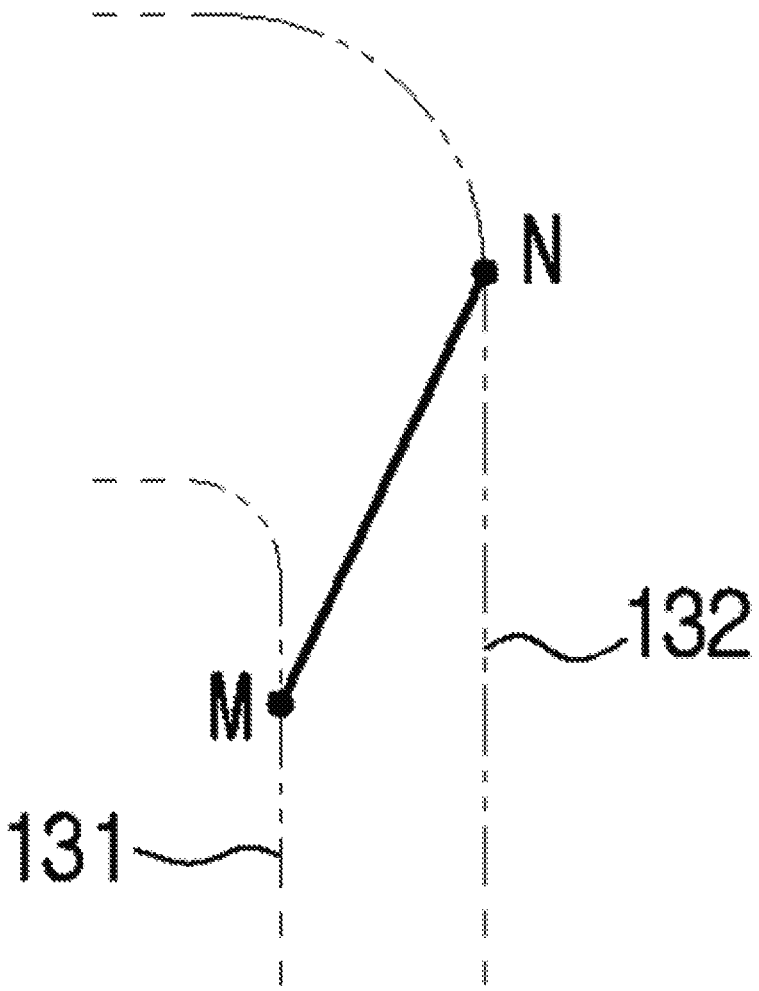
FIGS. 24A through 24P are side views schematically illustrating various shapes of a connection portion of the plurality of wings illustrated in FIG. 23.
Figure 24B:
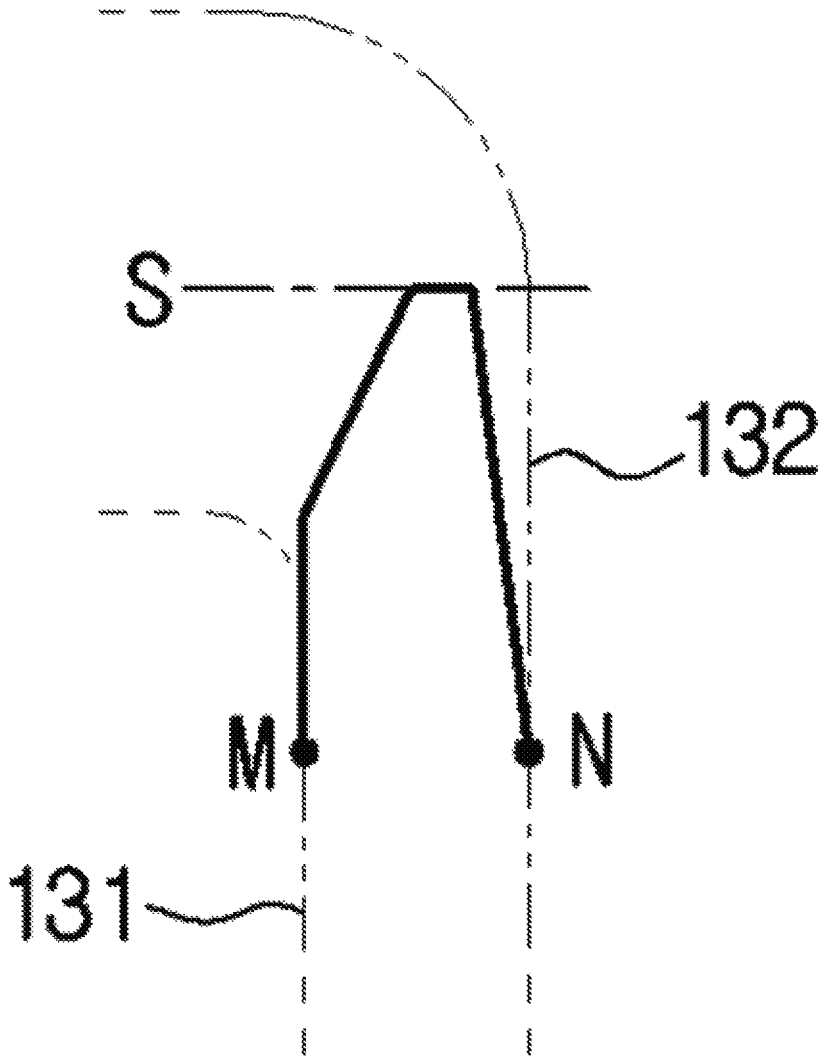
Figure 24C:
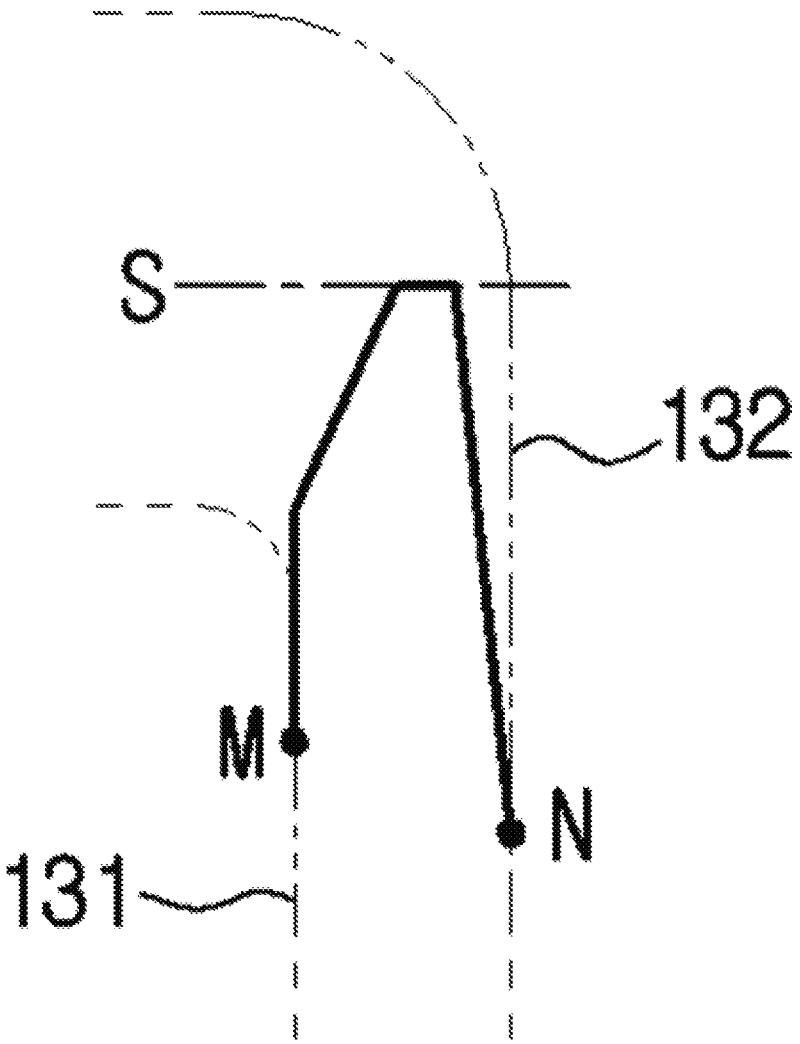
Figure 24D:
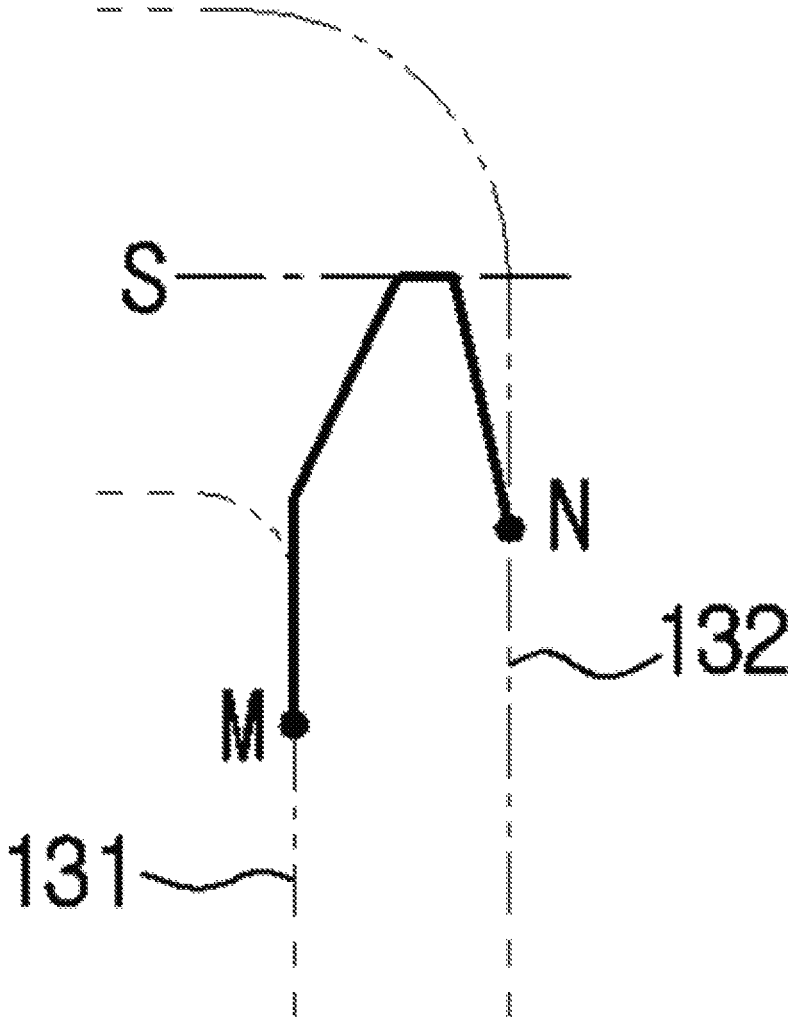
Figure 24E:
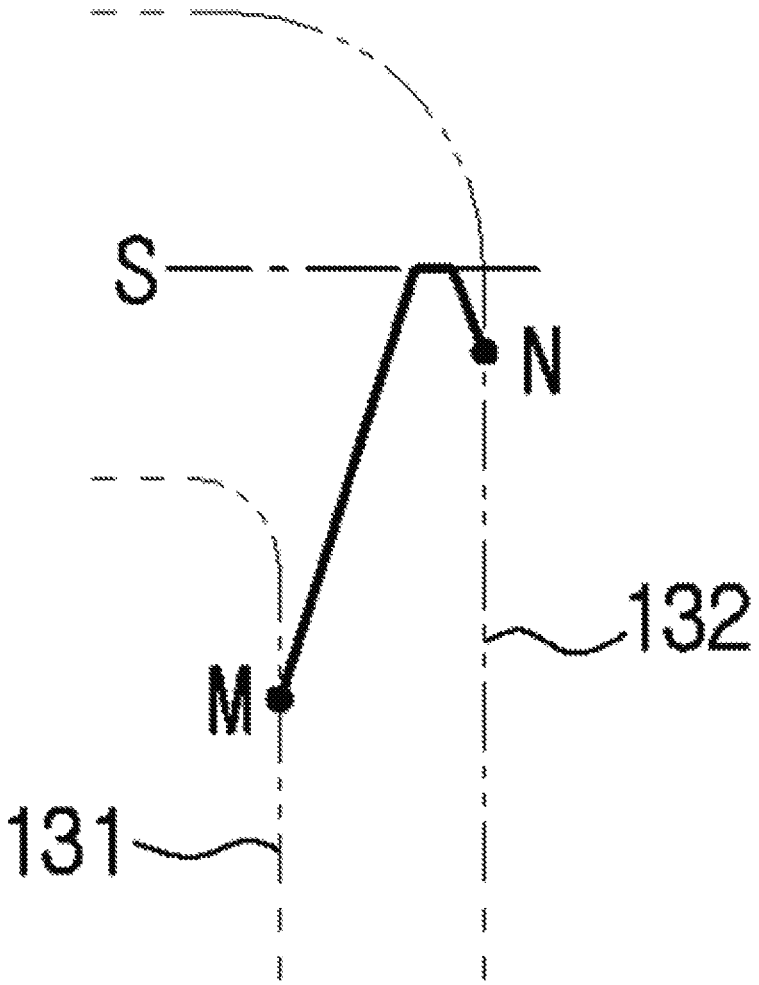
Figure 24F:
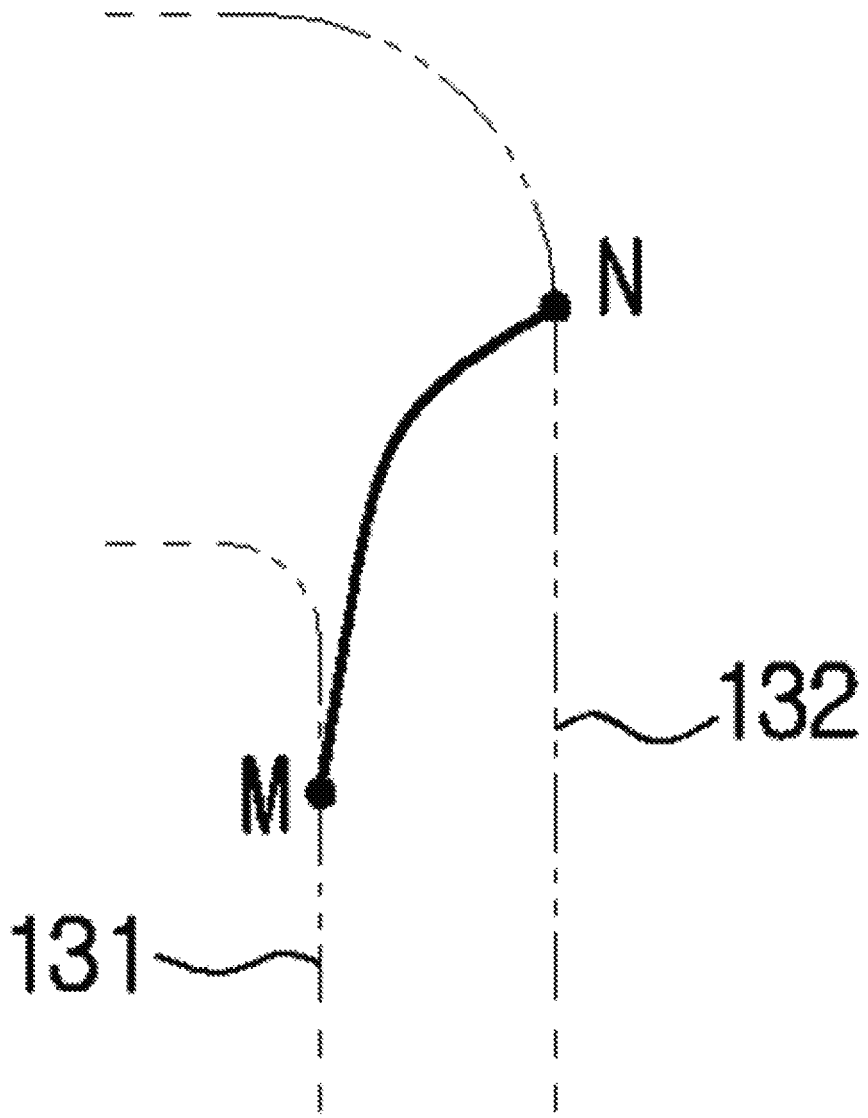
Figure 24G:
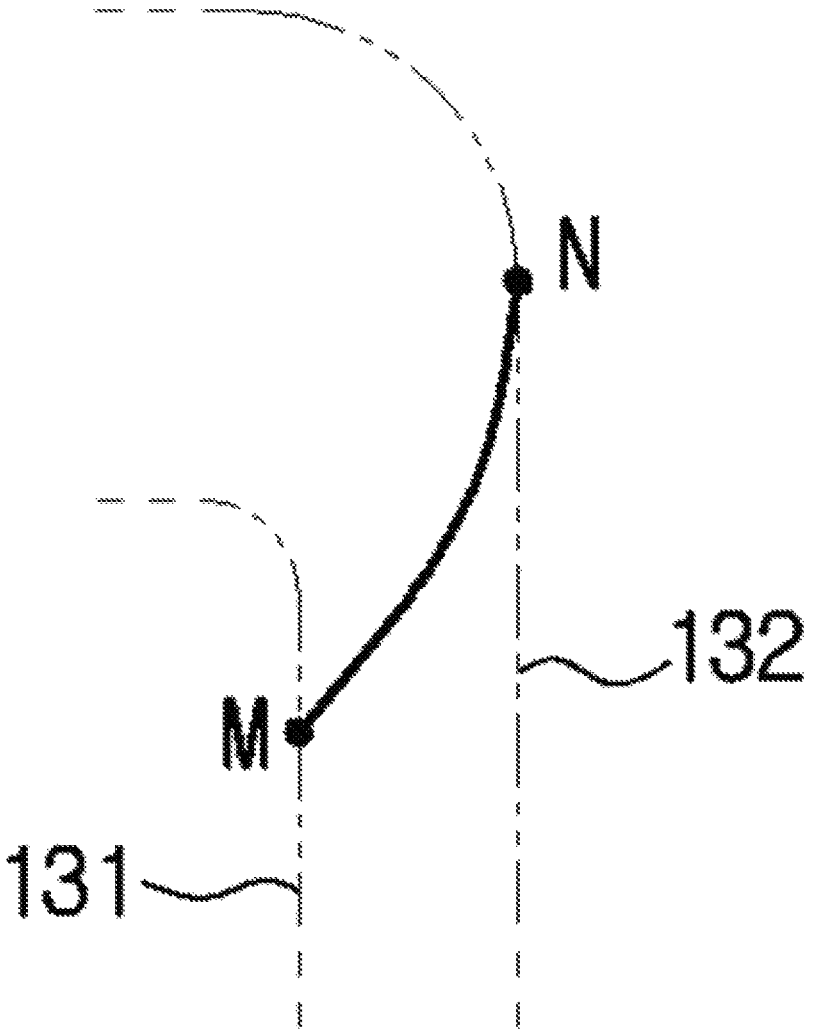
Figure 24H:
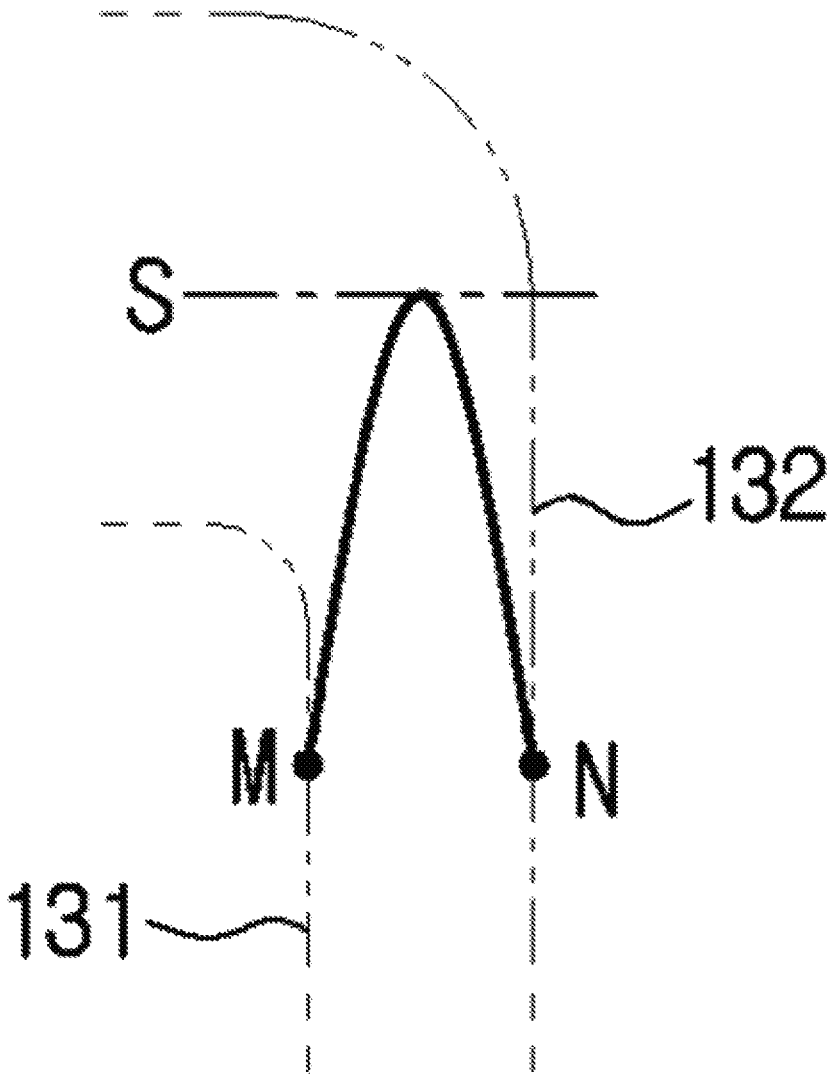
Figure 24I:
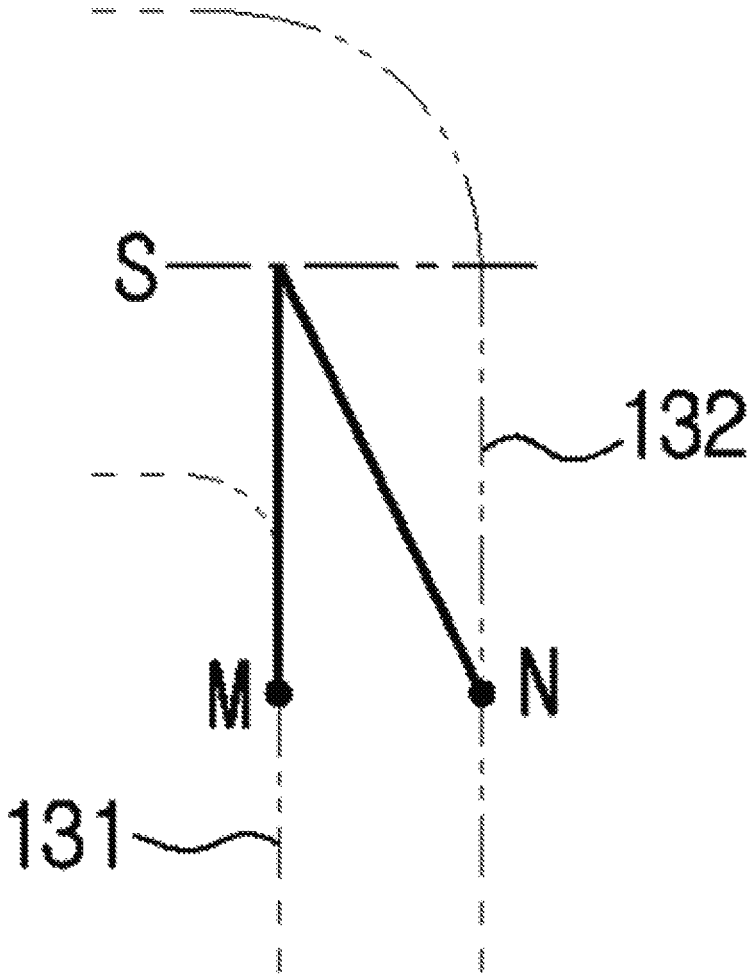
Figure 24J:
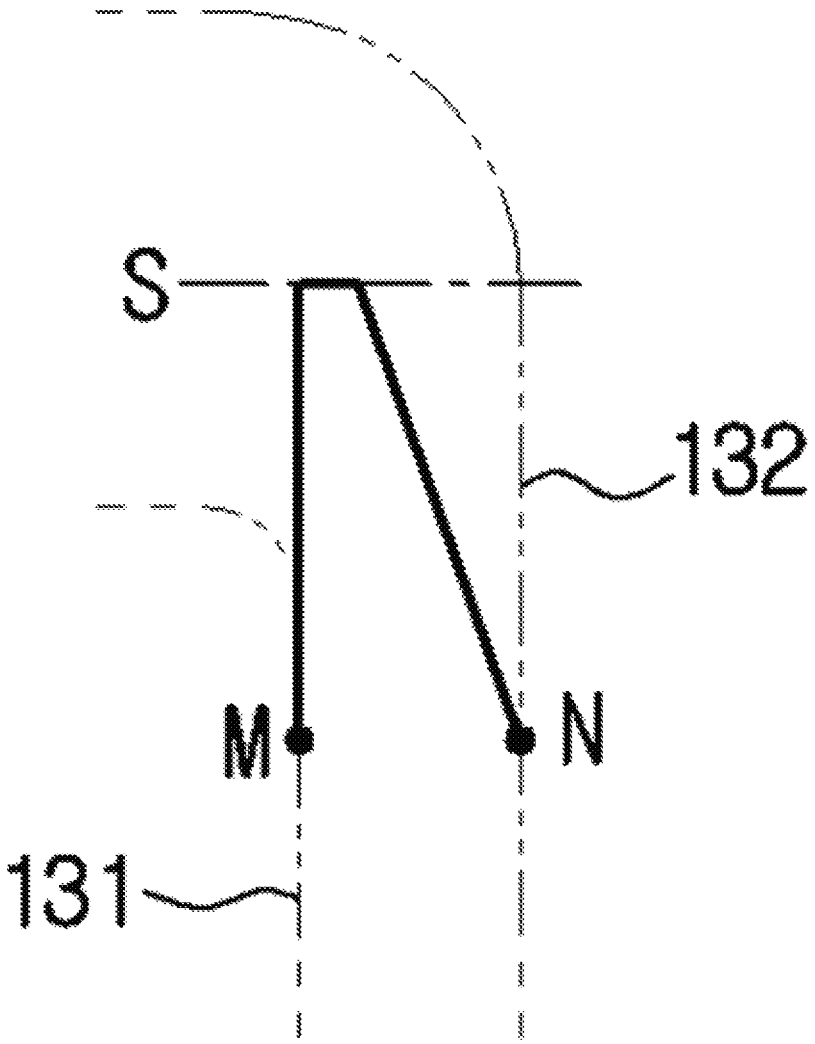
Figure 24K:
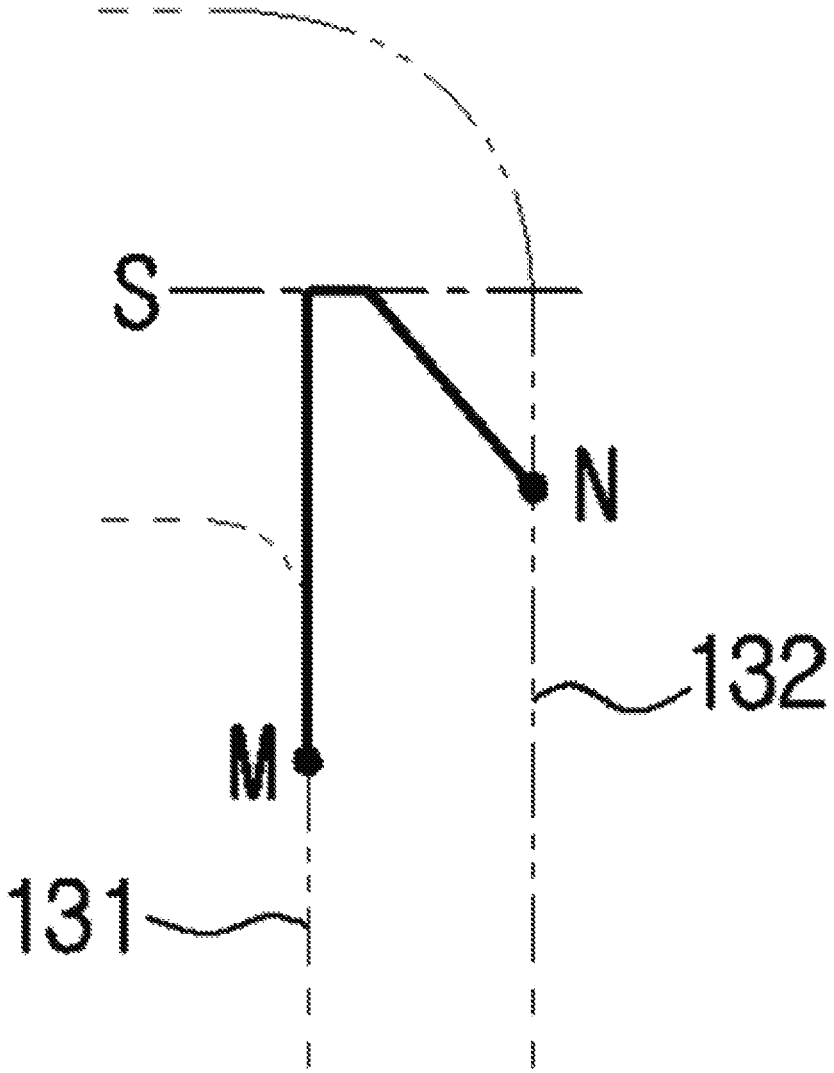
Figure 24L:
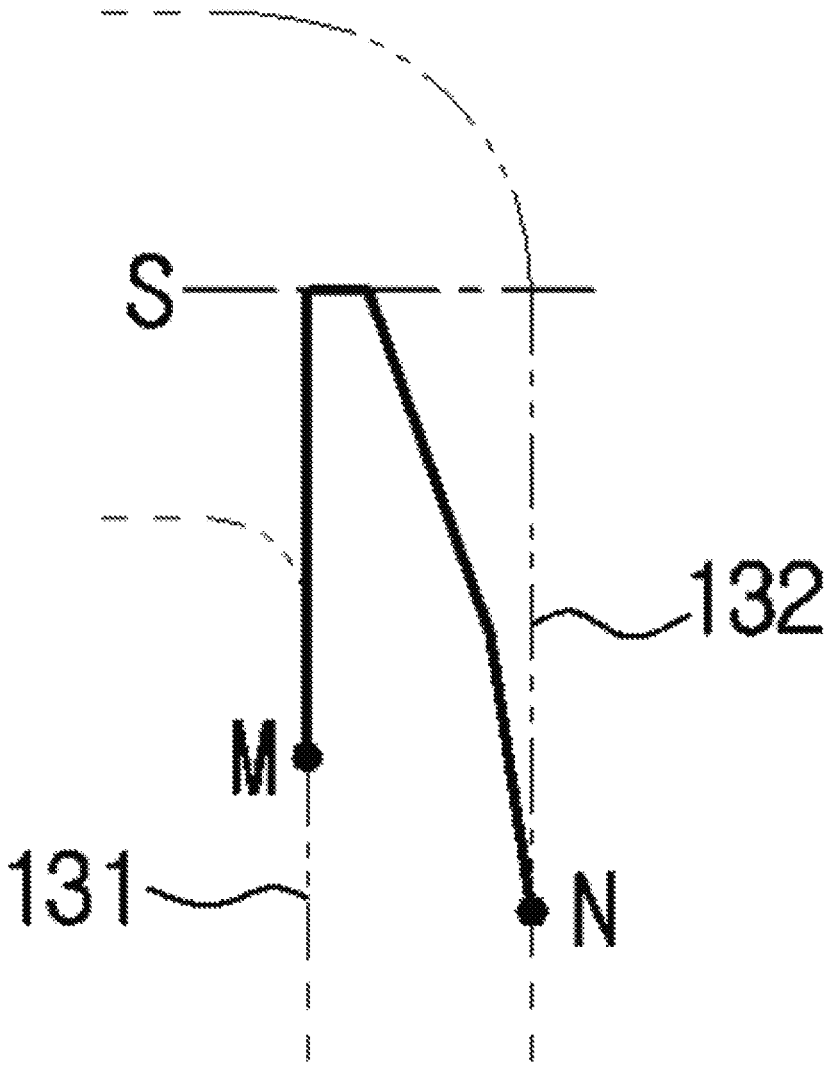
Figure 24M:
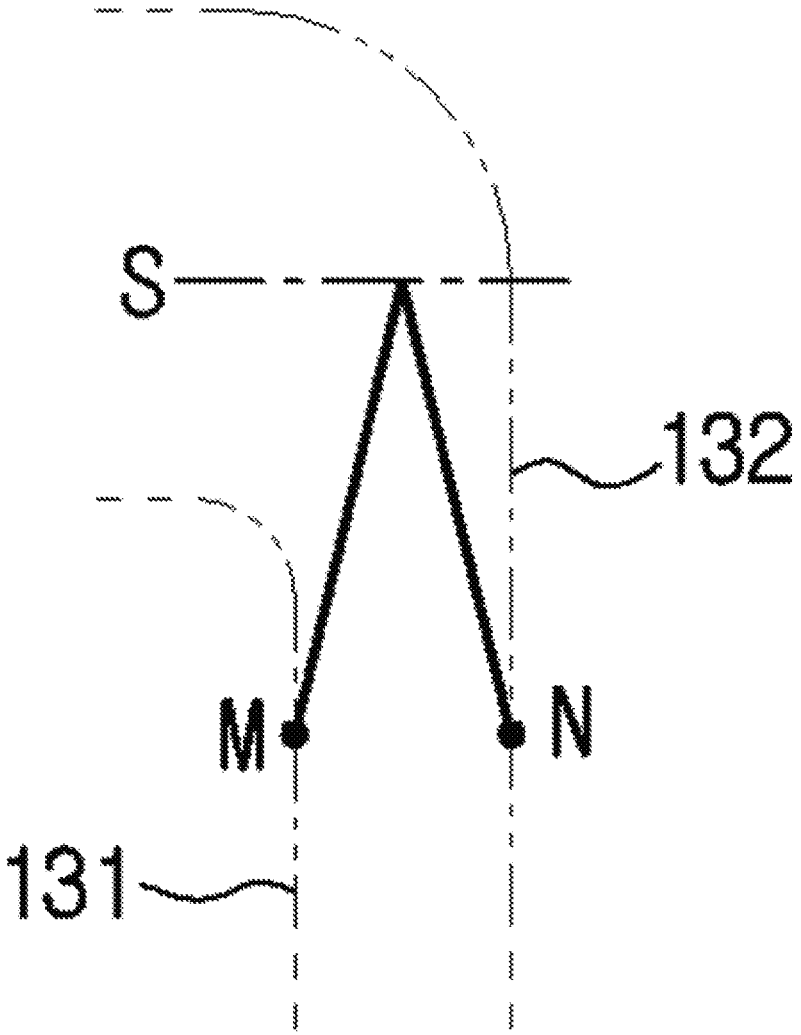
Figure 24N:
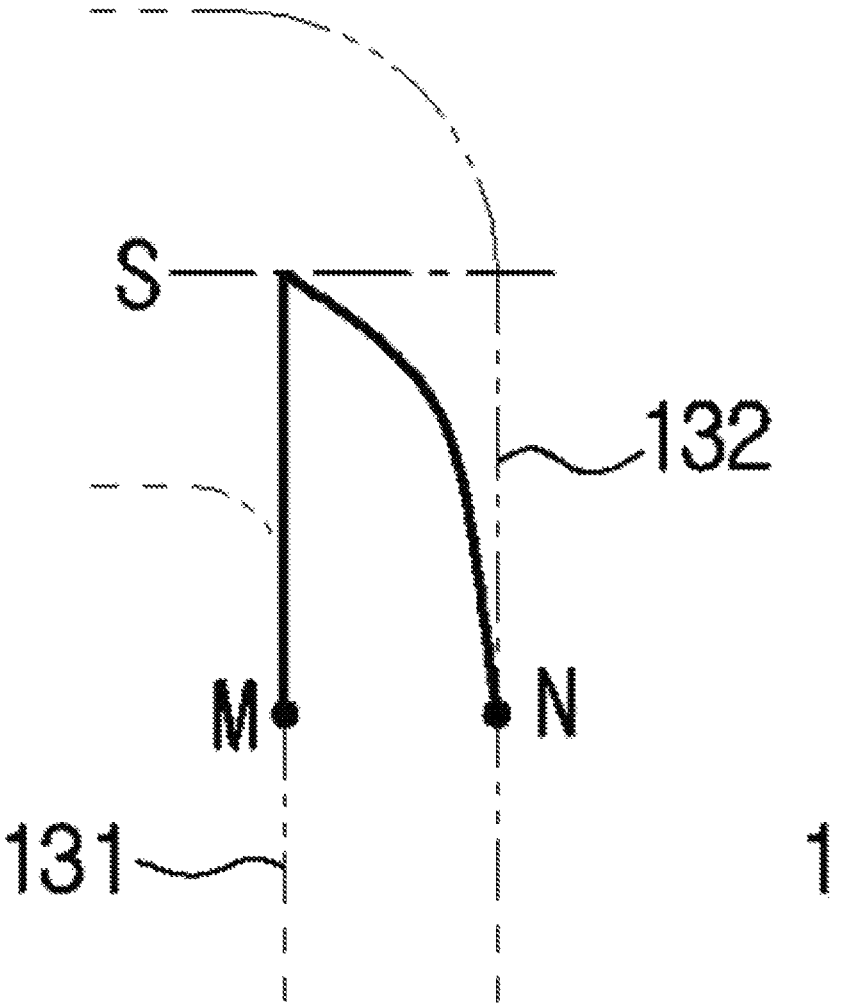
Figure 24O:
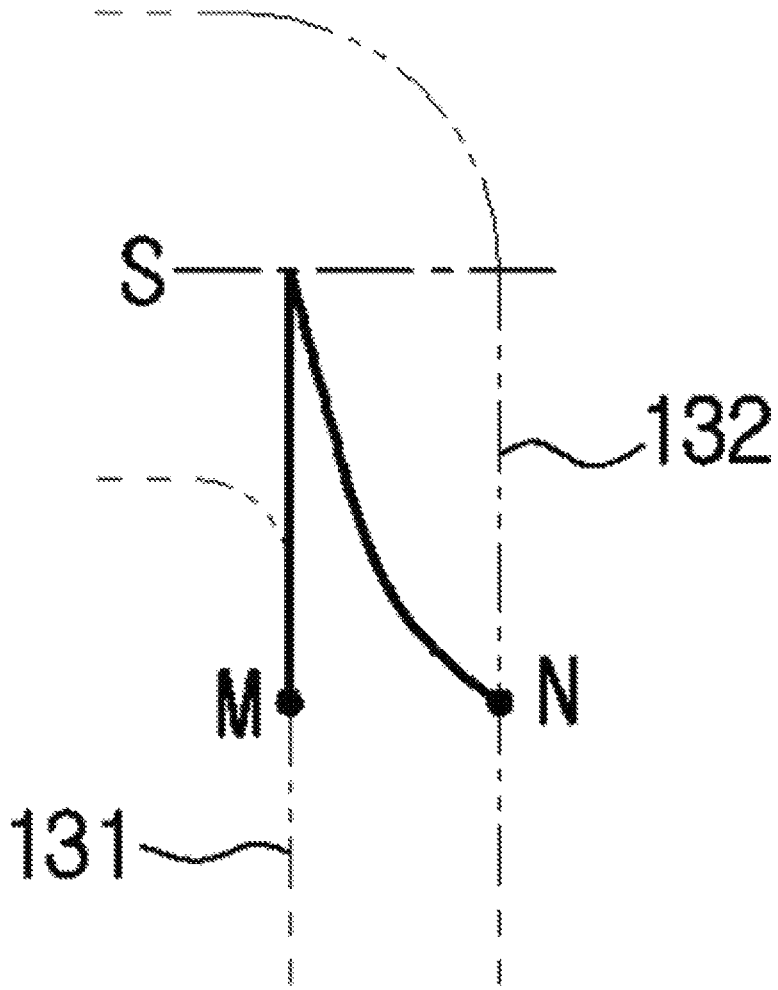
Figure 24P:
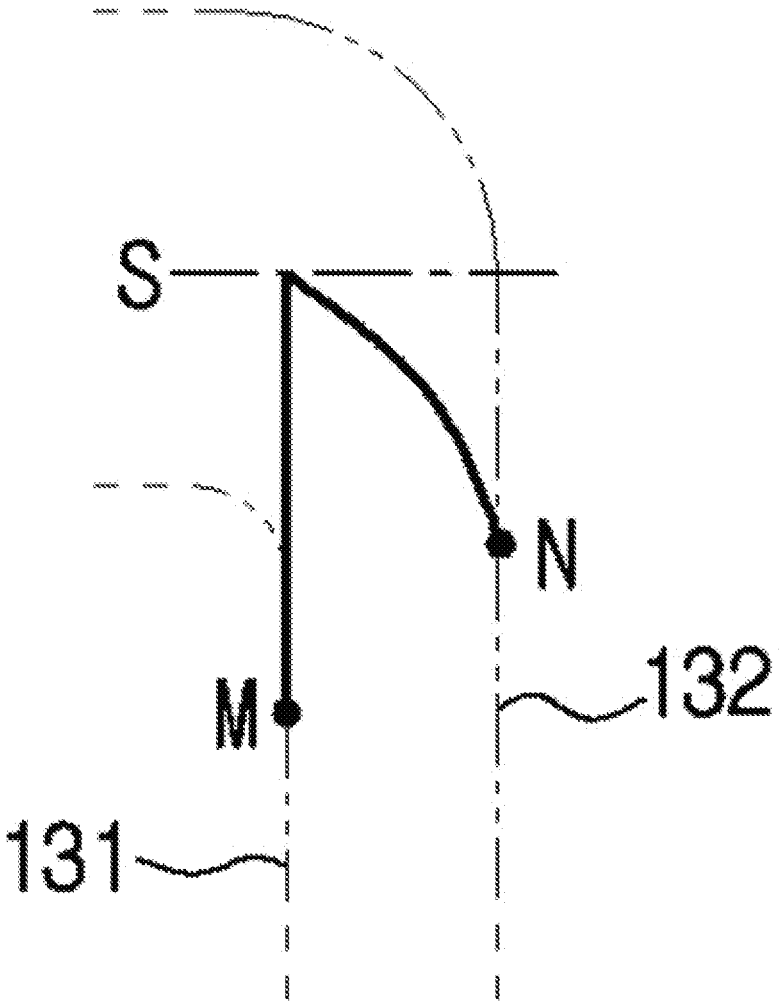

FIG. 23 illustrates part of a plurality of wings arranged between an inner frame and an outer frame of the cleaning device of FIG. 15, and FIGS. 24A through 24P are side views schematically illustrating various shapes of a connection portion of the plurality of wings illustrated in FIG. 23.

As illustrated in FIGS. 23 through 24P, the connection portion 164 of the plurality of wings 160 may have one of various shapes.

The connection portion 164 may include at least one of a curved surface and a flat surface.

The connection portion 164 may have curved surfaces with difference curvatures.

The connection portion 164 may have a curved surface with an inflexion point.

The connection portion 164 may include a flat surface with a constant gradient.

The connection portion 164 may include a plurality of flat surfaces with different gradients. That is, the plurality of flat surfaces that constitute the connection portion 164 may be bent.

The connection portion 164 may include a curved surface and a flat surface simultaneously.

The starting point N of the second surface 163 may further extend upward toward the impeller cover 120 than the starting point M of the first surface 162. That is, the starting point N of the second surface 163 may be formed at a higher position than the starting point M of the first surface 162 in the axial direction X of the impeller 110.

Alternatively, the starting point N of the second surface 163 may extend upward toward the impeller cover 120 at the same level as that of the starting point M of the first surface 162. That is, the starting point N of the second surface 163 and the starting point M of the first surface 162 may have the same heights in the axial direction X of the impeller 110.

The connection portion 164 may include a summit S that further extends upward toward the impeller cover 120 than at least one of the starting point M of the first surface 162 and the starting point N of the second surface 163. The summit S may further extend upward toward the impeller cover 120 than the starting point M of the first surface 162.

Figure 25:
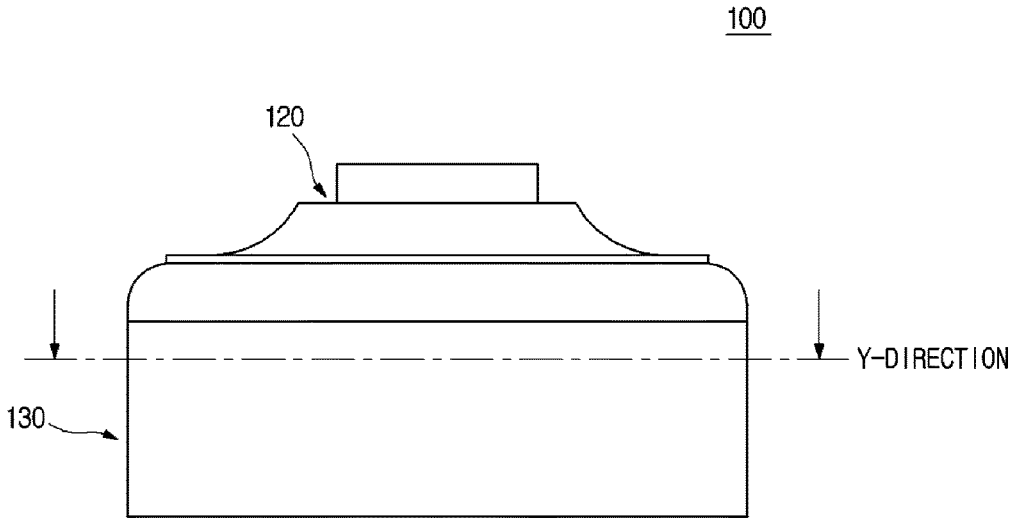
FIG. 25 is a side view of the inhalation unit of the cleaning device of FIG. 15.
Figure 26:
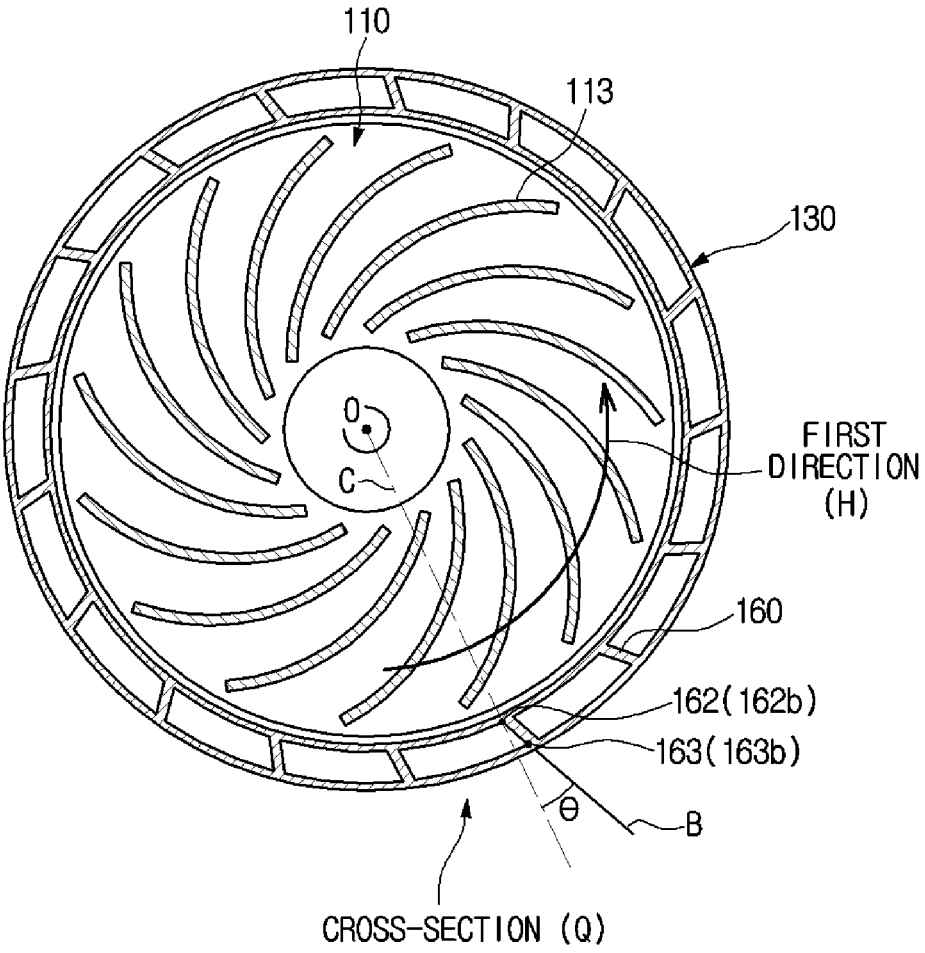
FIG. 26 is an enlarged cross-sectional view of a plurality of wings that are inclined in the same direction as a rotation direction of an impeller of the cleaning device of FIG. 15.
Figure 27:
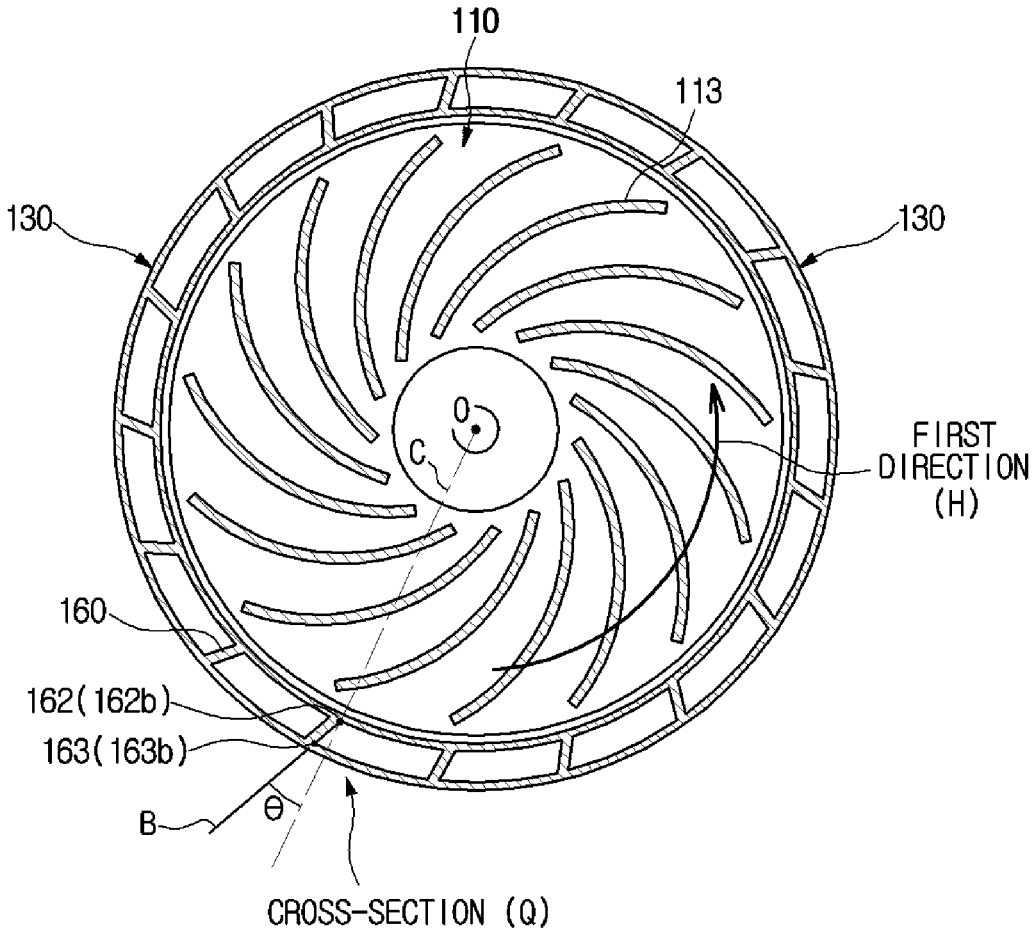
FIG. 27 is an enlarged cross-sectional view of a plurality of wings that are inclined in an opposite direction to the rotation direction of the impeller of the cleaning device of FIG. 15.

FIG. 25 is a side view of the inhalation unit of the cleaning device of FIG. 15, and FIG. 26 is an enlarged cross-sectional view of a plurality of wings that are inclined in the same direction as a rotation direction of an impeller of the cleaning device of FIG. 15. FIG. 27 is an enlarged cross-sectional view of a plurality of wings that are inclined in an opposite direction to the rotation direction of the impeller of the cleaning device of FIG. 15.

As illustrated in FIGS. 25 through 27, an angle θ between a straight line B that connects a top end 162*b* of the first surface 162 and a top end 163*b* of the second surface 163 which face an upward direction and a straight line C that connects a center O of the return channel 130 and the top end 162*b* of the first surface 162 in a cross-section Q in which the return channel 130 is cut in a horizontal direction Y perpendicular to the axial direction X of the impeller 110, may be between approximately 0° and 80°. In detail, when the impeller 110 is rotated in the first direction H, the straight line B that connects the top end 162*b* of the first surface 162 and the top end 163*b* of the second surface 163 may be inclined at an angle between approximately 0° and 80° with respect to the straight line C that connects the center O of the return channel 130 and the top end 162*b* of the first surface 162 in the first direction H. Also, when the impeller 110 is rotated in the first direction H, the straight line B that connects the top end 162*b* of the first surface 162 and the top end 163*b* of the second surface 163 may be inclined at an angle between approximately 0° and 80° with respect to the straight line C that connects the center C of the return channel 130 and the top end 162*b* of the first surface 162 in the second direction I.

In the cross-section Q in which the return channel 130 is cut in the horizontal direction Y perpendicular to the axial direction X of the impeller 110, the top end 162*b* of the first surface 162 and the top end 163*b* of the second surface 163 that face the upward direction may be connected to each other in a straight line or a curve.

Figure 28:
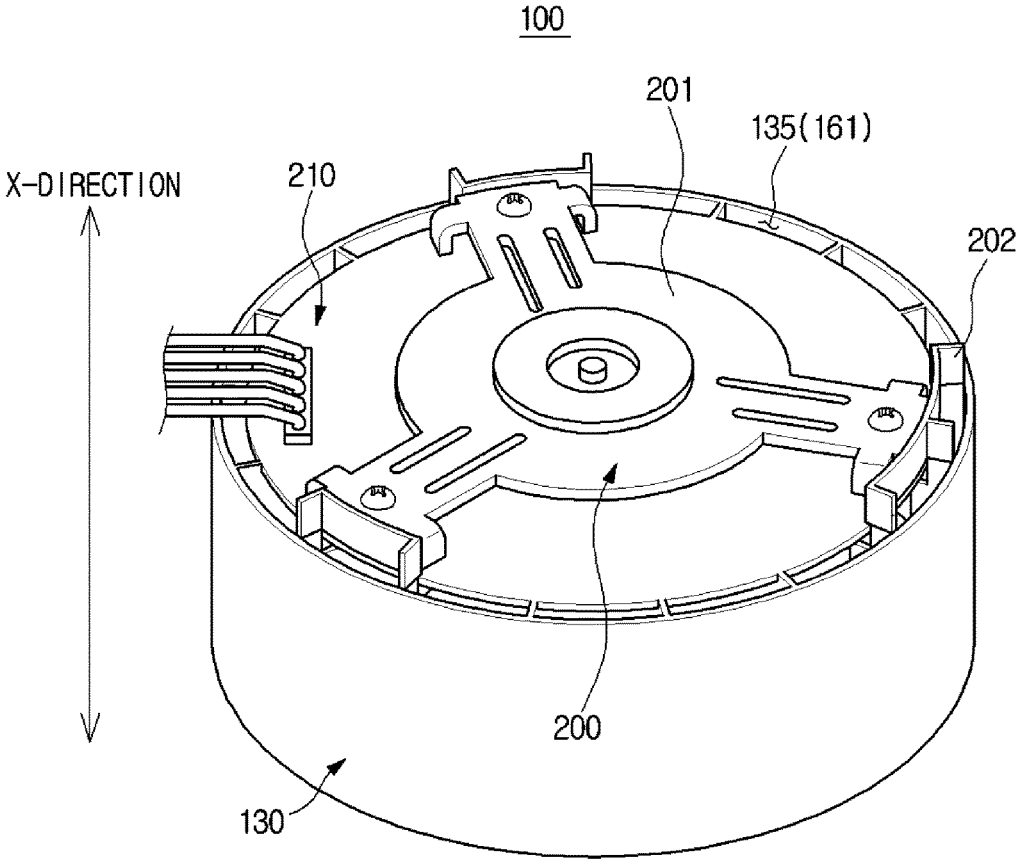
FIG. 28 is a perspective view of a cooling structure of the cleaning device of FIG. 15, according to a first embodiment of the present invention.

FIG. 28 is a perspective view of a cooling structure of the cleaning device of FIG. 15, according to a first embodiment of the present invention. Hereinafter, FIGS. 28 through 33 illustrate an inhalation unit 100 that is turned over. Thus, an upper part of a return channel 130 represents an inlet 137 of a discharge flow path 161, and a lower part of the return channel 130 represents an outlet 135 of the discharge flow path 161.

As illustrated in FIG. 28, the inhalation unit 100 may further include a PCB 210 and a support unit 200.

The PCB 210 may be placed at a lower portion of the return channel 130 in the axial direction X of the impeller 110. That is, the PCB 210 may be placed at the lower portion of the return channel 130 so as to be adjacent to the outlet 135 of the discharge flow path 161. The PCB 210 may be placed at a lower portion of an inner side of the return channel 130 not to block the discharge flow path 161.

The support unit 200 may be placed at a lower portion of the PCB 210 in the axial direction X of the impeller 110. The support unit 200 may support the motor 140 provided in the return channel 130 and the PCB 210 at the lower portion of the return channel 130.

The support unit 200 may be coupled to at least one protrusion (220, see FIG. 18) formed in the return channel 130.

The at least one protrusion 220 may be formed in the return channel 130 so as to be placed at an outer side of the motor 140. Also, the at least one protrusion 220 may be formed integrally with the return channel 130.

The support unit 200 may include a metal material.

The support unit 200 may include a body 201 and cooling fins 202.

The body 201 may be disposed at a lower part of an inner side of the return channel 130 so as to support the motor 140 provided in the return channel 130 and the PCB 210. The body 201 may be disposed at the lower part of the inner side of the return channel 130 not to block the discharge flow path 161.

The cooling fins 202 may be formed at an end of the support unit 200 so as to be adjacent to the outlet 135 of the discharge flow path 161. The cooling fins 202 may be formed at edges of the body 201. The cooling fins 202 may be formed to protrude in a radial direction toward an outer side of the body 201.

The cooling fins 202 may be disposed at a lower part of the outlet 135 of the discharge flow path 161 not to disturb a flow of air discharged to the outlet 135 of the discharge flow path 161.

Heat generated in the PCB 210 and the motor 140 may be transferred to the cooling fins 202 via the body 201. Air discharged to the outlet 135 of the discharge flow path 161 may cool heat transferred to the cooling fins 202 when air discharged to the outlet 135 of the discharge flow path 161 passes through the cooling fins 202.

Also, the cooling fins 202 may serve to extend the discharge flow path 161 in the axial direction X of the impeller 110 and thus may contribute to an increase in inhalation force of the inhalation unit 100.

The cooling fins 202 may be formed integrally with the body 201.

The cooling fins 202 may be disposed at all or part of the outlet 135 of the discharge flow path 161 according to a caloric value of the PCB 210 and the motor 140.

Figure 29:
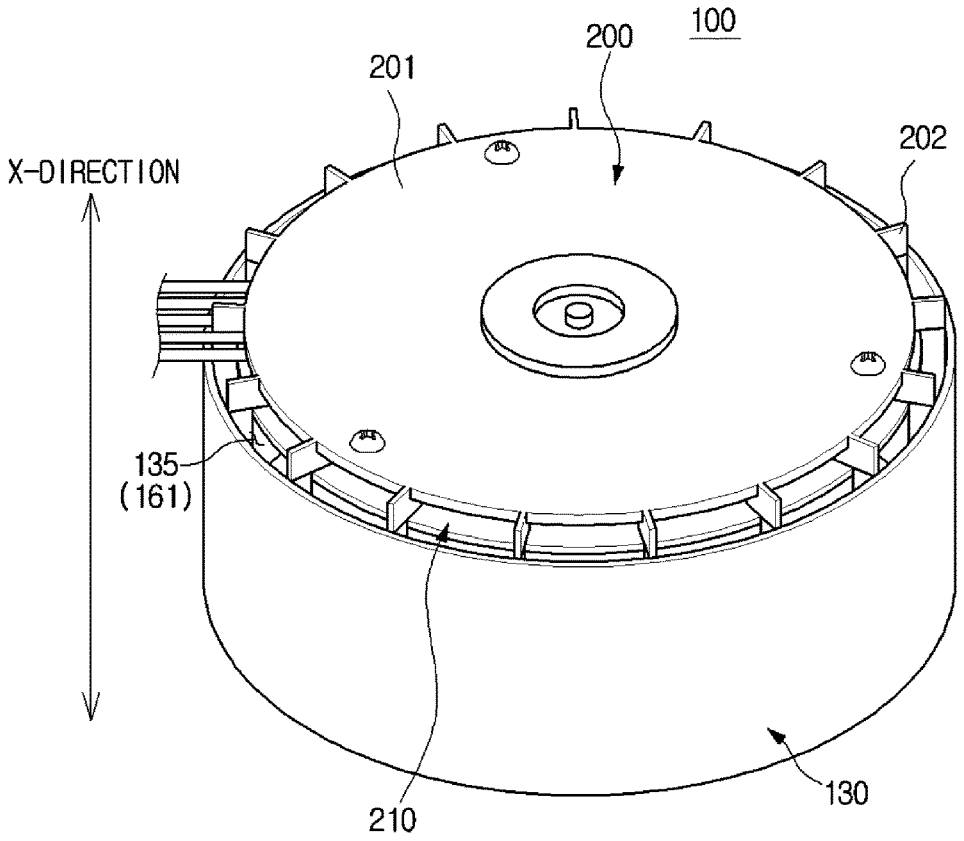
FIG. 29 is a perspective view of a cooling structure of the cleaning device of FIG. 15, according to a second embodiment of the present invention.
Figure 30:
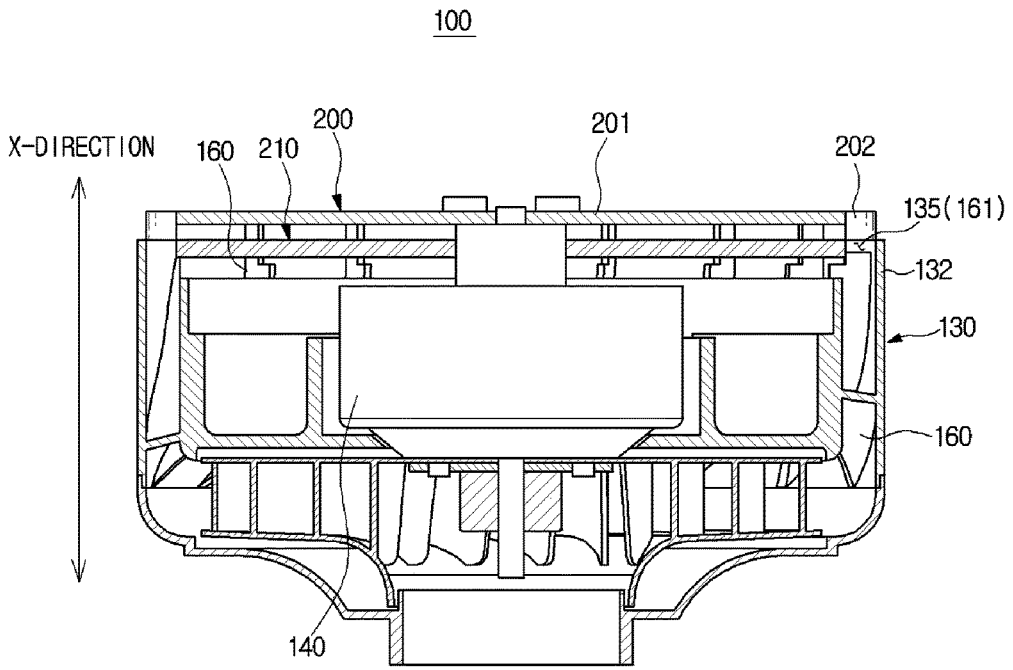
FIG. 30 is a cross-sectional view of the cooling structure illustrated in FIG. 29.

FIG. 29 is a perspective view of the cooling structure of the cleaning device of FIG. 15, according to a second embodiment of the present invention, and FIG. 30 is a cross-sectional view of the cooling structure illustrated in FIG. 29. Hereinafter, redundant descriptions with FIG. 28 will be omitted.

As illustrated in FIGS. 29 and 30, the support unit 200 may be disposed at a lower part of the PCB 210 not to close the outlet 135 of the discharge flow path 161.

The body 201 of the support unit 200 may have a circular shape, and the cooling fins 202 may be formed along a circumference of the body 201. The cooling fins 202 may be disposed at all of the outlet 135 of the discharge flow path 161. That is, the cooling fins 202 may be disposed at a lower part of the outlet 135 of the discharge flow path 161.

As the number of cooling fins 202 increases, cooling efficiency can be improved.

Figure 31:
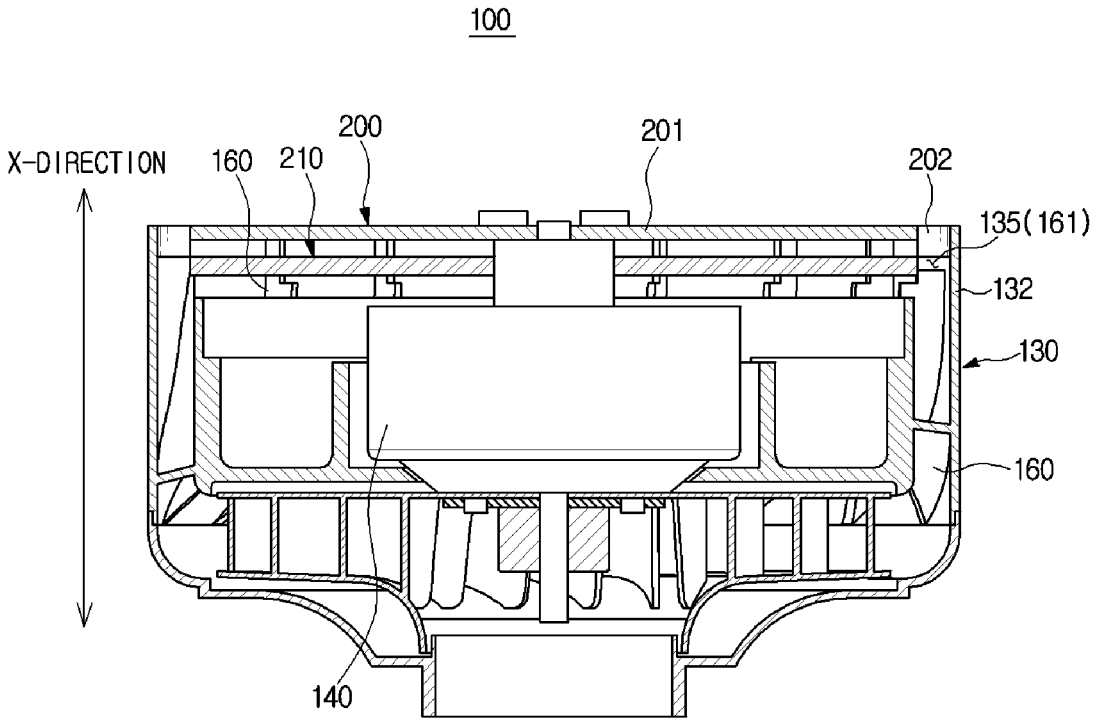
FIG. 31 is a cross-sectional view of a cooling structure of the cleaning device of FIG. 15, according to a third embodiment of the present invention.

FIG. 31 is a cross-sectional view of a cooling structure of the cleaning device of FIG. 15, according to a third embodiment of the present invention. Repeated descriptions with FIGS. 28 through 30 will be omitted.

As illustrated in FIG. 31, the support unit 200 may be formed in the return channel 130 so as to support the motor 140 and the PCB 210. That is, the cooling fins 202 that protrude from the body 201 of the support unit 200 toward the outer side of the body 201, may face an inner surface of the outer frame 132. The cooling fins 202 may be in contact with or be coupled to the inner surface of the outer frame 132.

The support unit 200 may be placed at the lower part of the PCB 210 so as to support the motor 140 and the PCB 210. In this case, the outer frame 132 of the return channel 130 may further extend toward the lower part of the return channel 130 so that the cooling fins 202 may be in contact with the inner surface of the outer fame 132. That is, one end of the outer frame 132 that faces the lower part of the return channel 130 may be disposed in the same line as that of the support unit 200.

Figure 32:
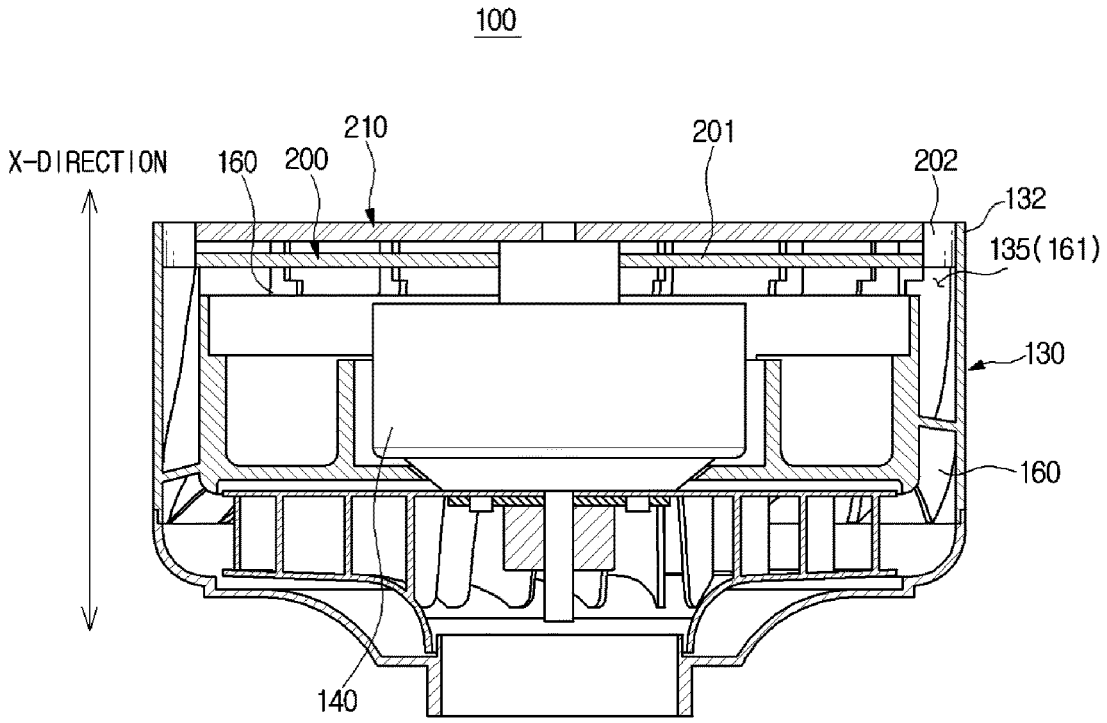
FIG. 32 is a cross-sectional view of a cooling structure of the cleaning device of FIG. 15, according to a fourth embodiment of the present invention.

FIG. 32 is a cross-sectional view of a cooling structure of the cleaning device of FIG. 15, according to a fourth embodiment of the present invention. Repeated descriptions with FIGS. 28 through 31 will be omitted.

As illustrated in FIG. 32, the support unit 200 may be accommodated in the return channel 130. The support unit 200 may be placed at the lower part of the inner side of the return channel 130 so as to support the motor 140. The PCB 210 may be provided at the lower part of the support unit 200.

The cooling fins 202 that protrude from the body 201 of the support unit 200 to the outer side of the body 201, may face the inner surface of the outer frame 132. The cooling fins 202 may be in contact with or be coupled to the inner surface of the outer frame 132.

The outer frame 132 of the return channel 130 may further extend toward the lower part of the return channel 130. In detail, one end of the outer frame 132 that faces the lower part of the return channel 130 may be disposed in the same line as that of the PCB 210.

Figure 33:
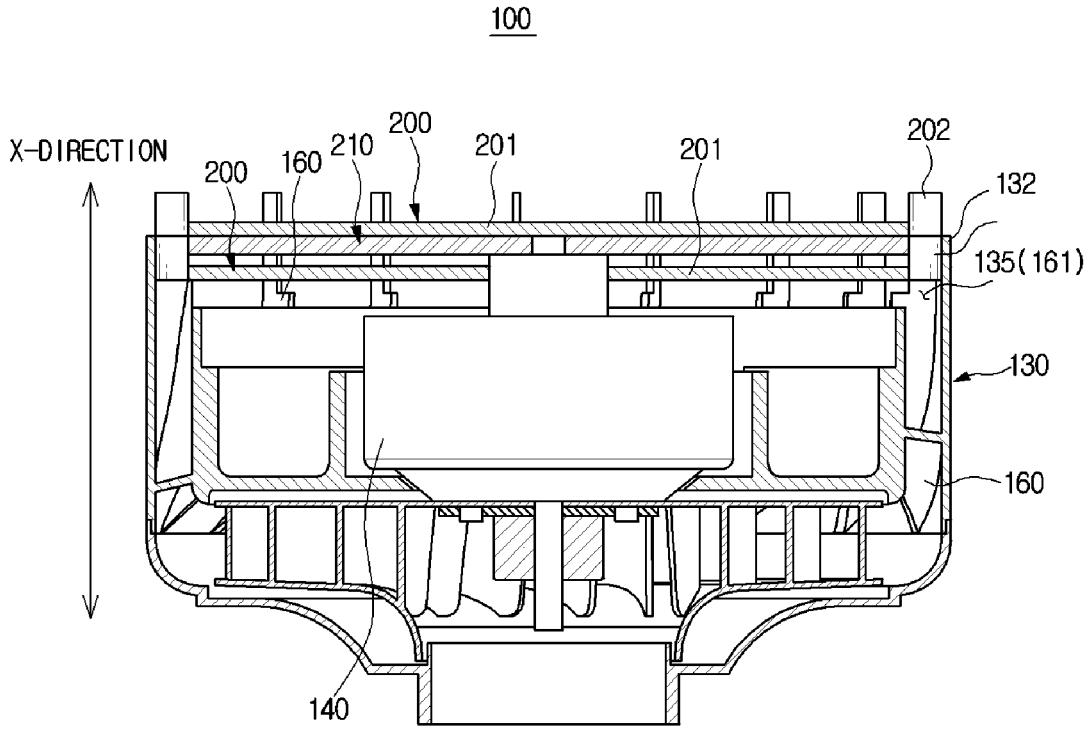
FIG. 33 is a cross-sectional view of a cooling structure of the cleaning device of FIG. 15, according to a fifth embodiment of the present invention.

FIG. 33 is a cross-sectional view of a cooling structure of the cleaning device of FIG. 15, according to a fifth embodiment of the present invention. Repeated descriptions of FIGS. 28 through 32 will be omitted.

As illustrated in FIG. 33, a plurality of support units 200 may be disposed at the lower part of the return channel 130. In detail, the plurality of support units 200 may be disposed at the upper and lower parts of the PCB 210 in the axial direction X of the impeller 110. The cooling fins 202 of the support units 200 that face the motor 140 may extend from the body 201 so as to face the inner surface of the outer frame 132. The cooling fins 202 of the support units 200 provided at the lower part of the PCB 210 may be formed to protrude toward the outer side of the body 201. The cooling fins 202 of the support units 200 provided at the lower part of the PCB 210 may be exposed to an outside of the return channel 130.

Figure 34:
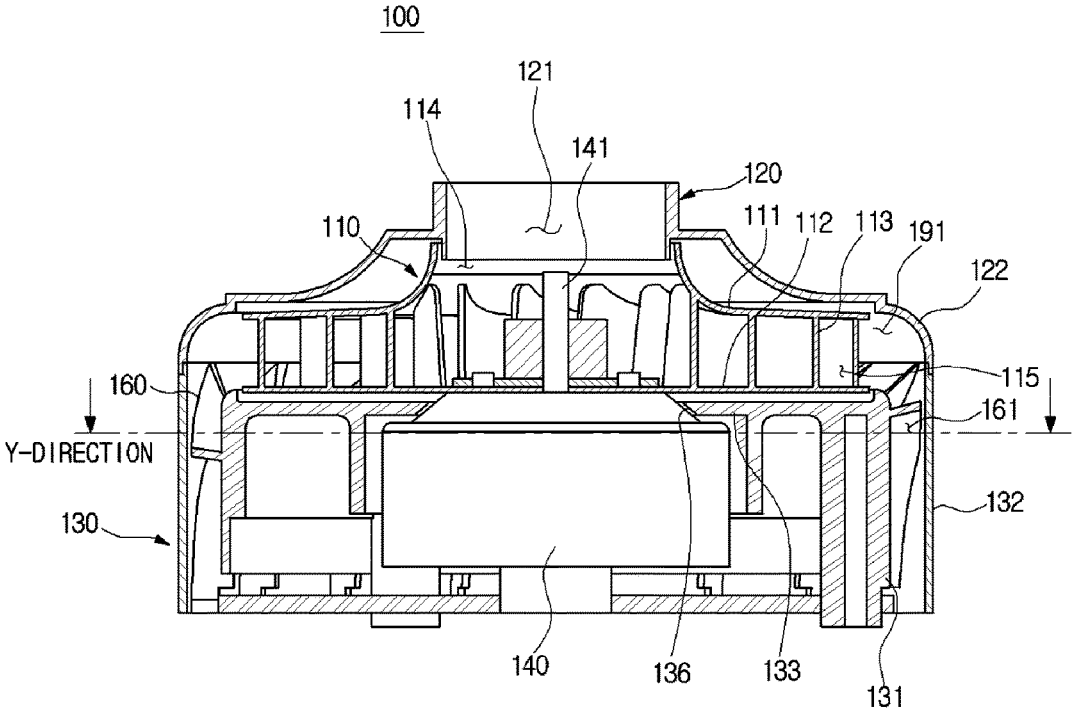
FIG. 34 is a cross-sectional view of an arrangement structure of a plurality of wings in the cleaning device of FIG. 15, according to a first embodiment of the present invention.
Figure 35:
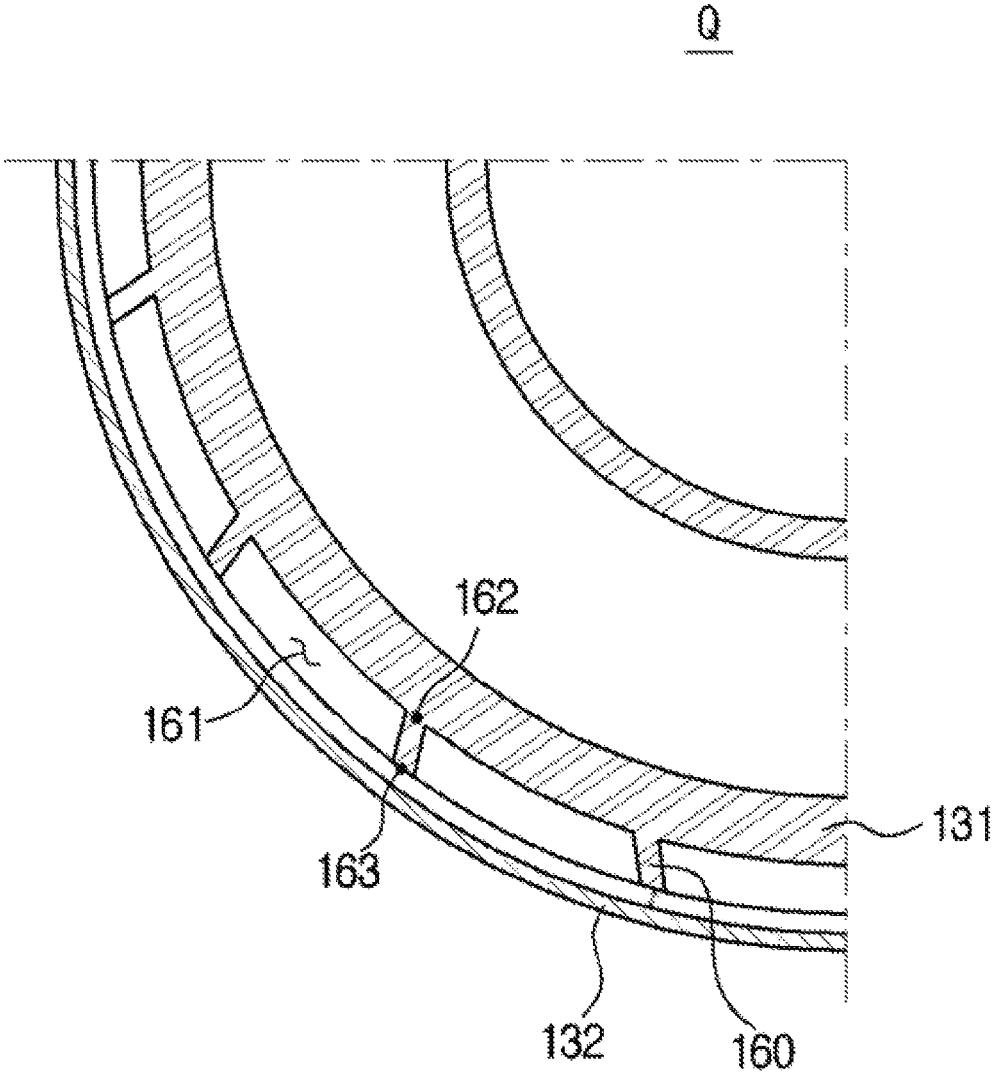
FIG. 35 is a partial cut view of FIG. 34 in a horizontal direction.
Figure 36:
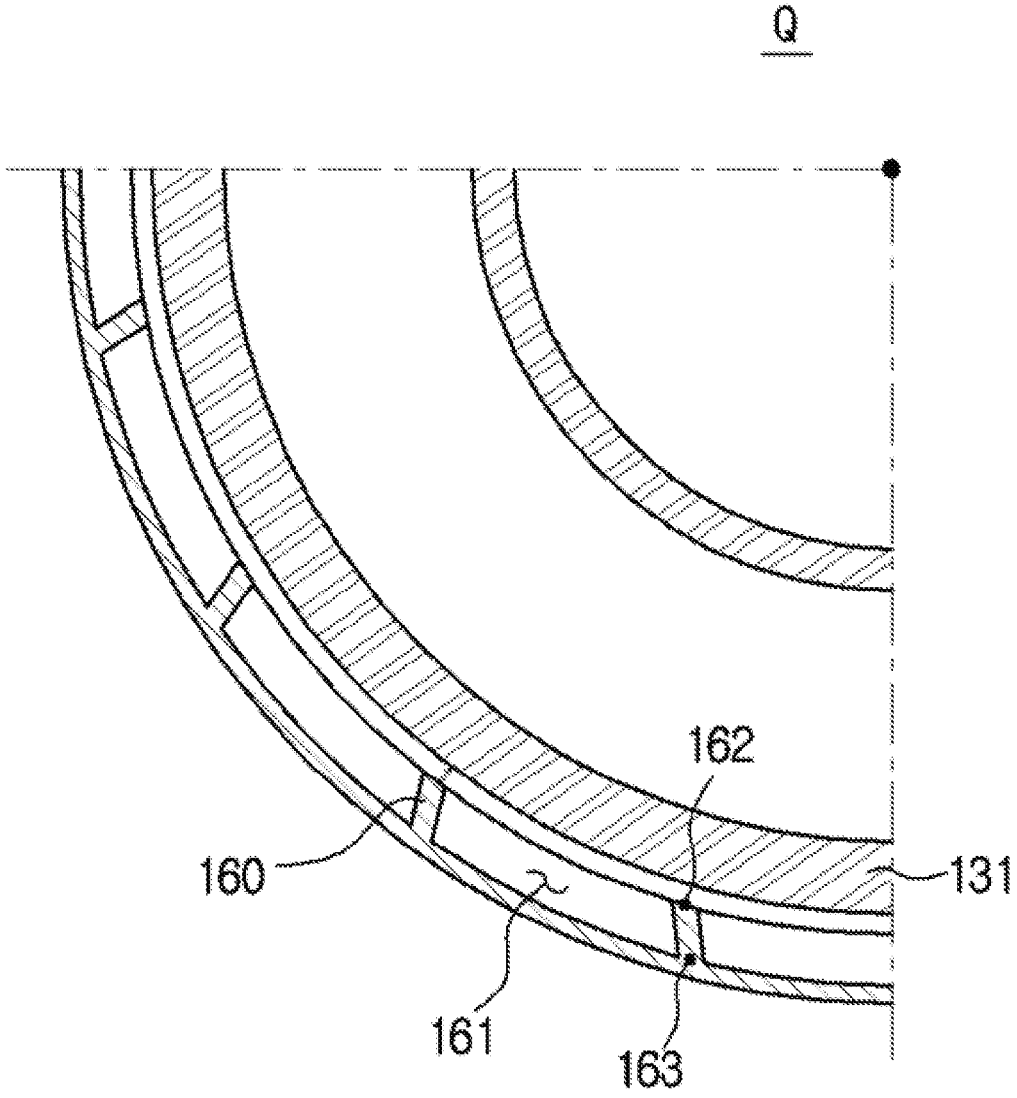
FIG. 36 is a cross-sectional view of an arrangement structure of plurality of wings in the cleaning device of FIG. 15, according to a second embodiment of the present invention.
Figure 37:
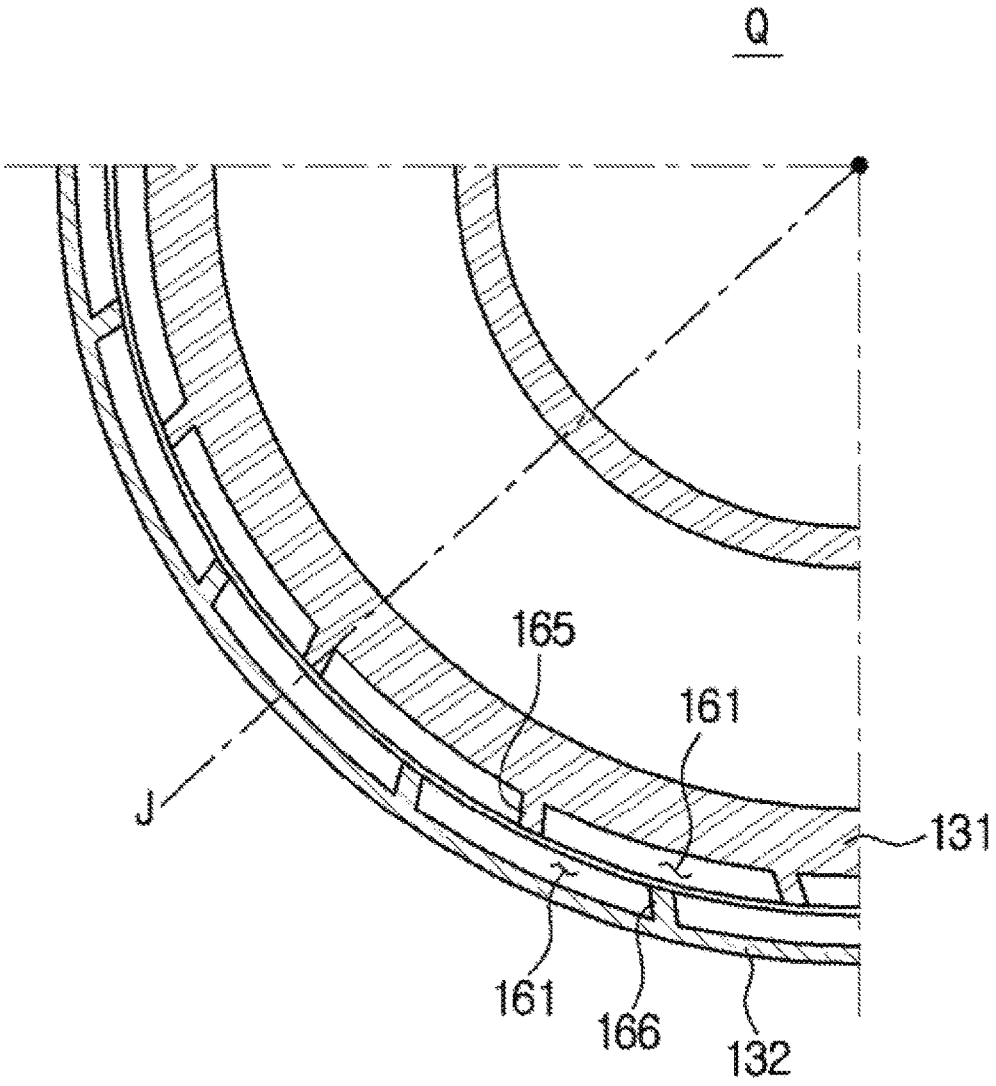
FIG. 37 is a cross-sectional view of an arrangement structure of plurality of wings in the cleaning device of FIG. 15, according to a third embodiment of the present invention.

FIG. 34 is a cross-sectional view of an arrangement structure of a plurality of wings in the cleaning device of FIG. 15, according to a first embodiment of the present invention, and FIG. 35 is a partial cut view of FIG. 34 in a horizontal direction. FIGS. 35 through 37 illustrate part of the cross-section Q in which the return channel 130 is cut in the horizontal direction Y perpendicular to the axial direction X of the impeller 110.

As illustrated in FIGS. 34 and 35, the plurality of wings 160 may be disposed between the inner frame 131 and the outer frame 132 of the return channel 130. The plurality of wings 160 may be disposed between the inner frame 131 and the outer frame 132 so as to form a slope with respect to the axial direction of the impeller 110.

The plurality of wings 160 may be disposed between the inner frame 131 and the outer frame 132 so as to be spaced apart from the outer frame 132 by a predetermined gap. In detail, the first side 162 of the plurality of wings 160 may be coupled to the outer surface of the inner frame 131, and the second side 163 of the plurality of wings 160 may be spaced apart from the inner surface of the outer frame 132 by a predetermined gap.

The second surface 163 of the plurality of wings 160 may be spaced apart from the inner surface of the outer frame 132 on all of the inlet 137 and the outlet 135 of the discharge flow path 161.

Alternatively, the second surface 163 of the plurality of wings 160 may be spaced apart from the inner surface of the outer fame 132 on part of the inlet 137 and the outlet 135 of the discharge flow path 161. The second surface 163 of the plurality of wings 160 may be spaced apart from the inner surface of the outer frame 132 as the plurality of wings 160 get closer to the outlet 135 of the discharge flow path 161. That is, the second surface 163 adjacent to the inlet 137 of the discharge flow path 161 may be coupled to the inner surface of the outer fame 132, and the second surface 163 adjacent to the outlet 135 of the discharge flow path 161 may be spaced apart from the inner surface of the outer frame 132 by a predetermined gap.

A degree of separation between the inner surface of the outer frame 132 and the second surface 163 may differ in the axial direction X of the impeller 110.

The plurality of wings 160 may be formed integrally with the inner frame 131.

As the second surface 163 is further spaced apart from the inner surface of the outer frame 132, an air exfoliation phenomenon that occurs in the discharge flow path 161 can be reduced and thus, inhalation force of the inhalation unit 100 can be improved.

FIG. 36 is a cross-sectional view of an arrangement structure of a plurality of wings in the cleaning device of FIG. 15, according to a second embodiment of the present invention.

As illustrated in FIG. 36, the plurality of wings 160 may be disposed between the inner frame 131 and the outer frame 132 so as to form a slope with respect to the axial direction X of the impeller 110.

The plurality of wings 160 may be disposed between the inner frame 131 and the outer frame 132 so as to be spaced apart from the inner frame 131. In detail, the second side 163 of the plurality of wings 160 may be coupled to the inner surface of the outer frame 132, and the first surface 162 of the plurality of wings 160 may be spaced apart from the outer surface of the outer frame 132.

The first surface 162 of the plurality of wings 160 may be spaced apart from the outer surface of the inner frame 31 on all of the inlet 137 and the outlet 135 of the discharge flow path 161.

Alternatively, the first surface 162 of the plurality of wings 160 may be spaced apart from the outer surface of the inner frame 31 on part of the inlet 137 and the outlet 135 of the discharge flow path 161.

A degree of separation between the outer surface of the inner frame 131 and the first surface 162 may differ in the axial direction X of the impeller 110.

The plurality of wings 160 may be formed integrally with the outer frame 132.

FIG. 37 is a cross-sectional view of an arrangement structure of a plurality of wings in the cleaning device of FIG. 15, according to a third embodiment of the present invention.

As illustrated in FIG. 37, the plurality of wings 160 may include first wings 165 and second wings 166 that are disposed between the inner frame 131 and the outer frame 132. The first wings 165 may be coupled to the outer surface of the inner frame 131, and the second wings 166 may be coupled to the inner surface of the outer frame 132.

One end of the first wings 165 that face the inner surface of the outer frame 132 may be spaced apart from one end of the second wings 166 that face the outer surface of the inner frame 131 by a predetermined gap.

The first wings 165 and the second wings 166 may be alternately placed.

In the cross-section Q in which the return channel 130 is cut in the horizontal direction Y perpendicular to the axial direction X of the impeller 110, one end of the second wings 166 that face the outer surface of the inner frame 131 is not placed in a straight line J that connects one end of the first wings 165 that face the inner surface of the outer frame 132 and the center O of the return channel 130.

Figure 38:
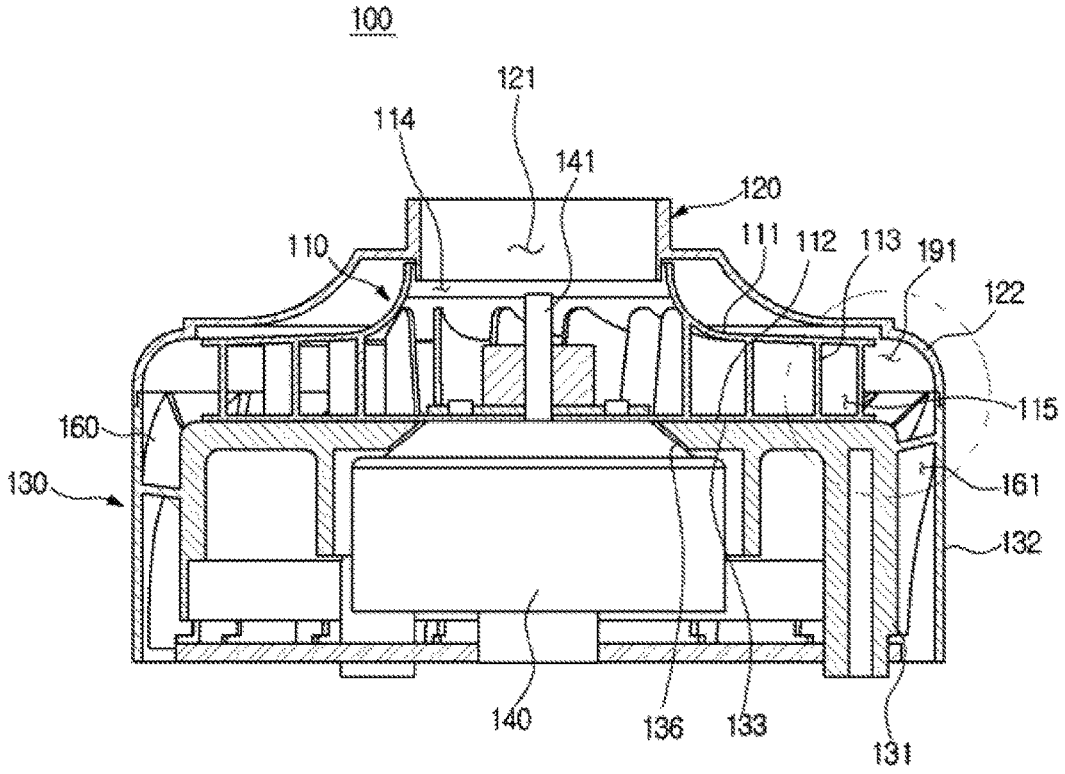
FIG. 38 is a cross-sectional view of an inhalation unit of a cleaning device according to still another embodiment of the present invention.

FIG. 38 is a cross-sectional view of an inhalation unit of a cleaning device according to still another embodiment of the present invention. Repeated descriptions with FIGS. 15 through 36 will be omitted.

As illustrated in FIG. 38, the return channel 130 may be placed at a lower part of the impeller 110, and the mounting portion 133 on which the impeller 110 is mounted, may be formed on a top surface of the inner frame 131.

The mounting portion 133 may have a flat surface. That is, the protrusion portion (133*a*, see FIG. 20) that is formed along edges of the mounting portion 133 may be omitted.

Figure 39:
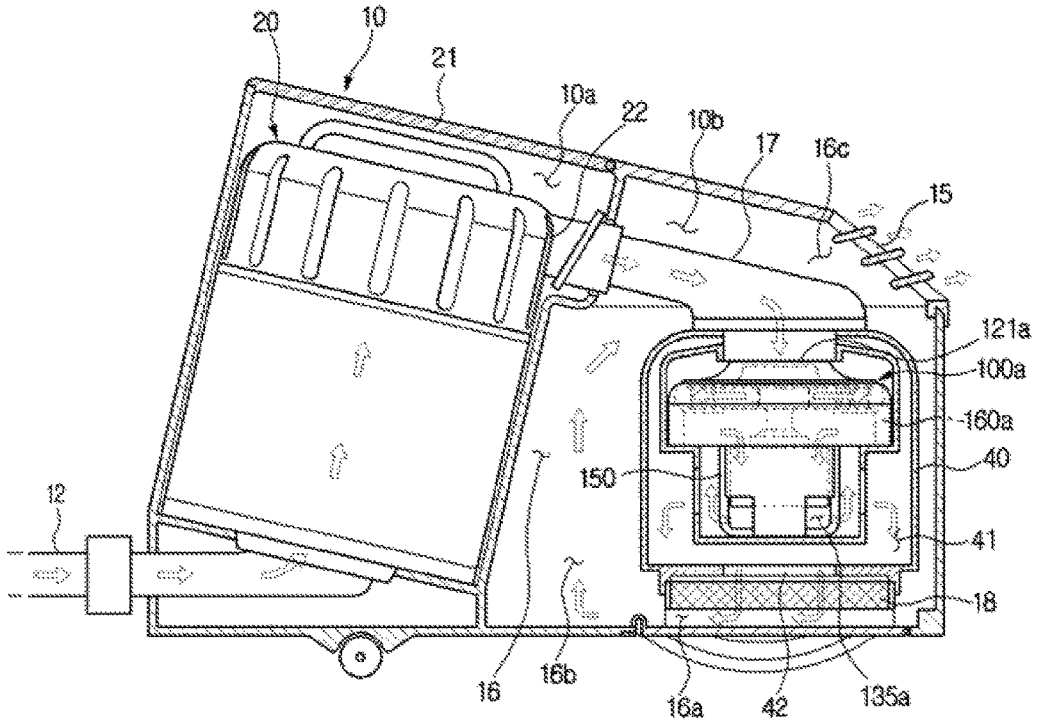
FIG. 39 is a cross-sectional view illustrating a main body of the cleaning device illustrated in FIG. 38.
Figure 40:
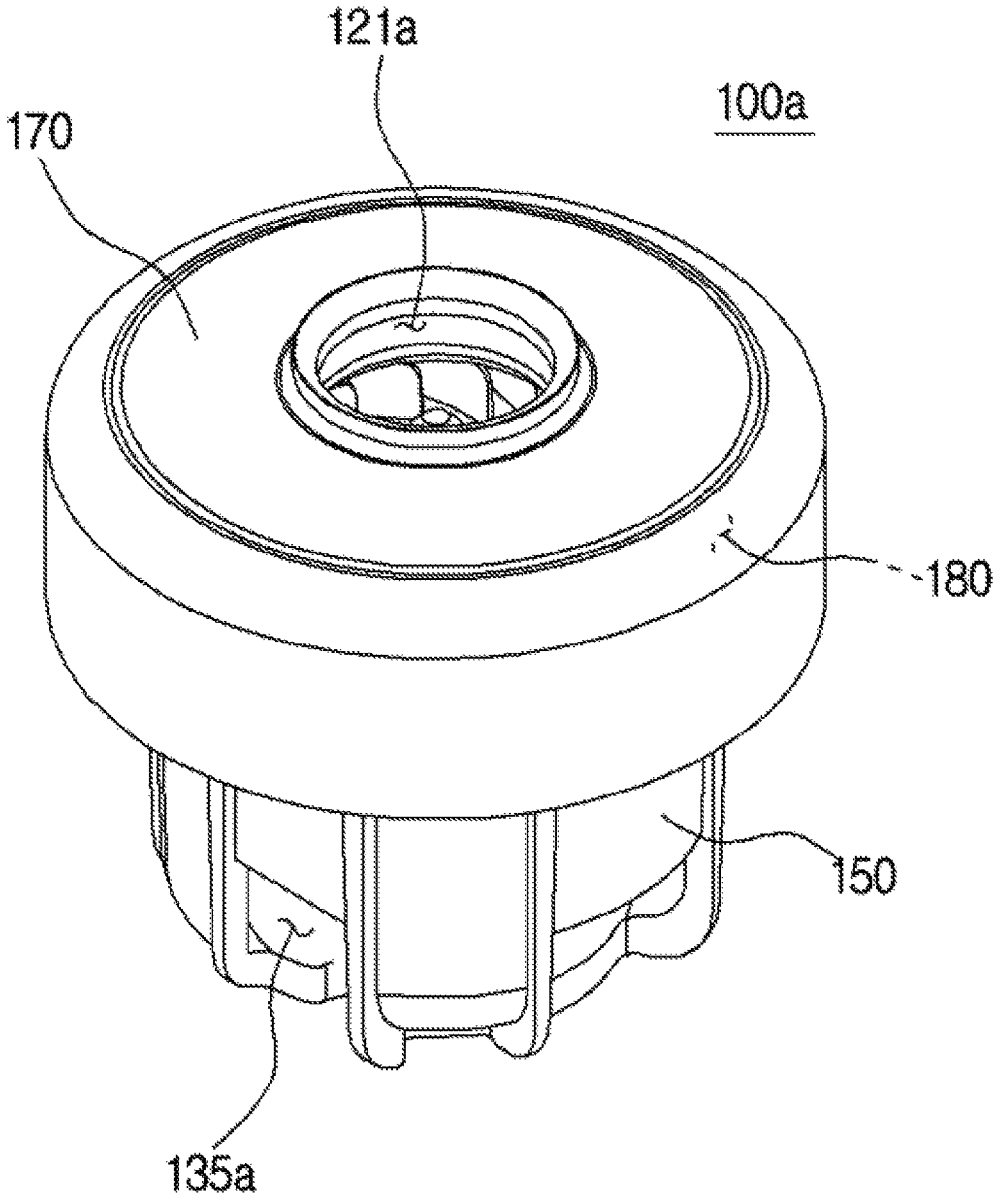
FIG. 40 is a perspective view of the inhalation unit of the cleaning device of FIG. 38.
Figure 41:
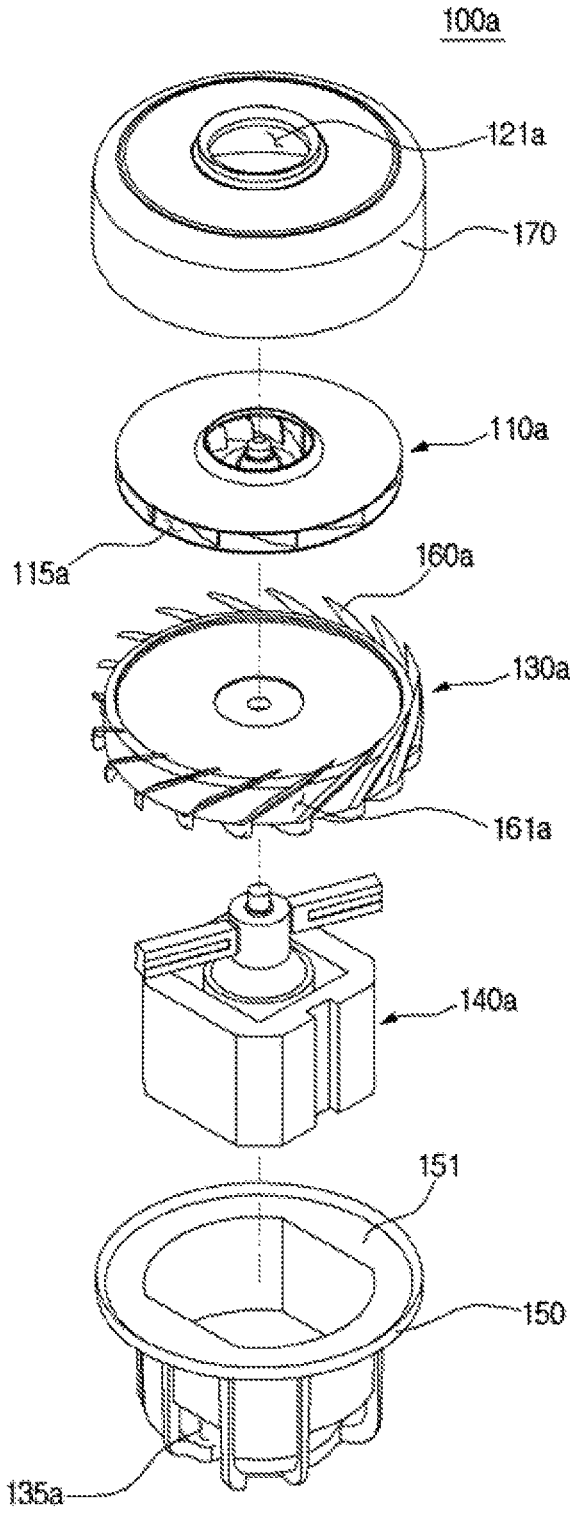
FIG. 41 is an exploded perspective view of the inhalation unit of the cleaning device of FIG. 38.
Figure 42:
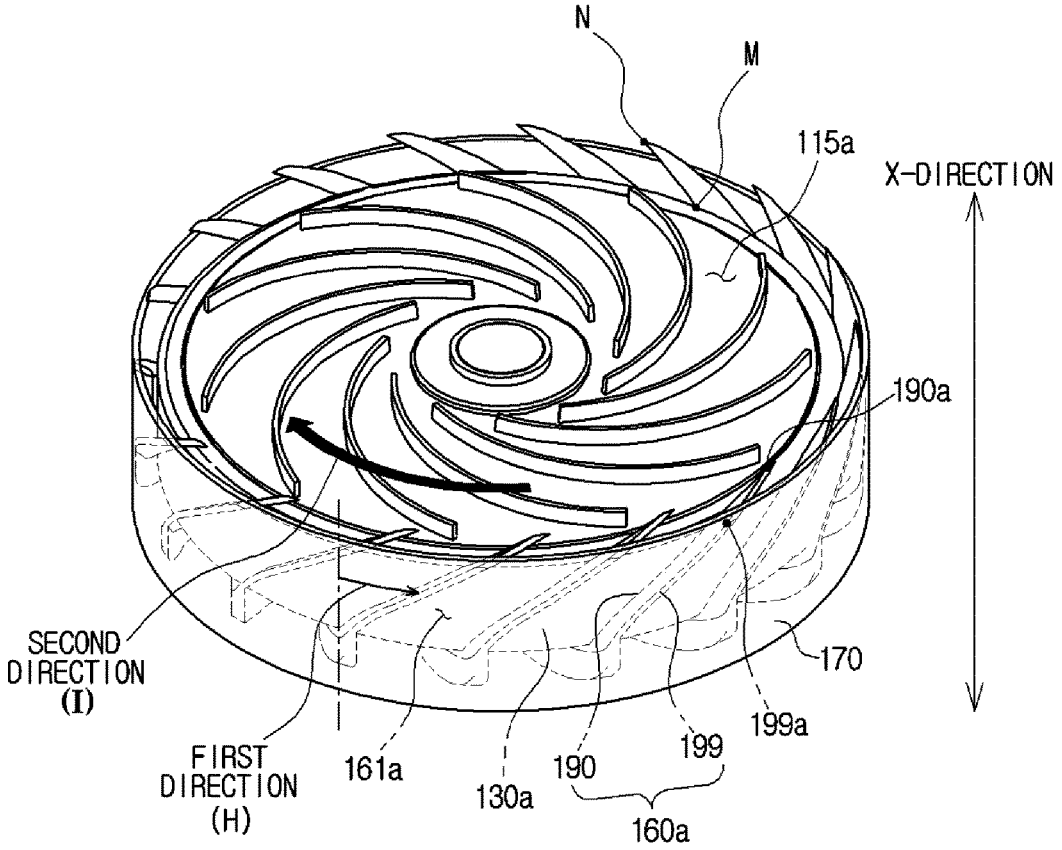
FIG. 42 is an enlarged perspective view of part of the inhalation unit of the cleaning device of FIG. 38.
Figure 43:
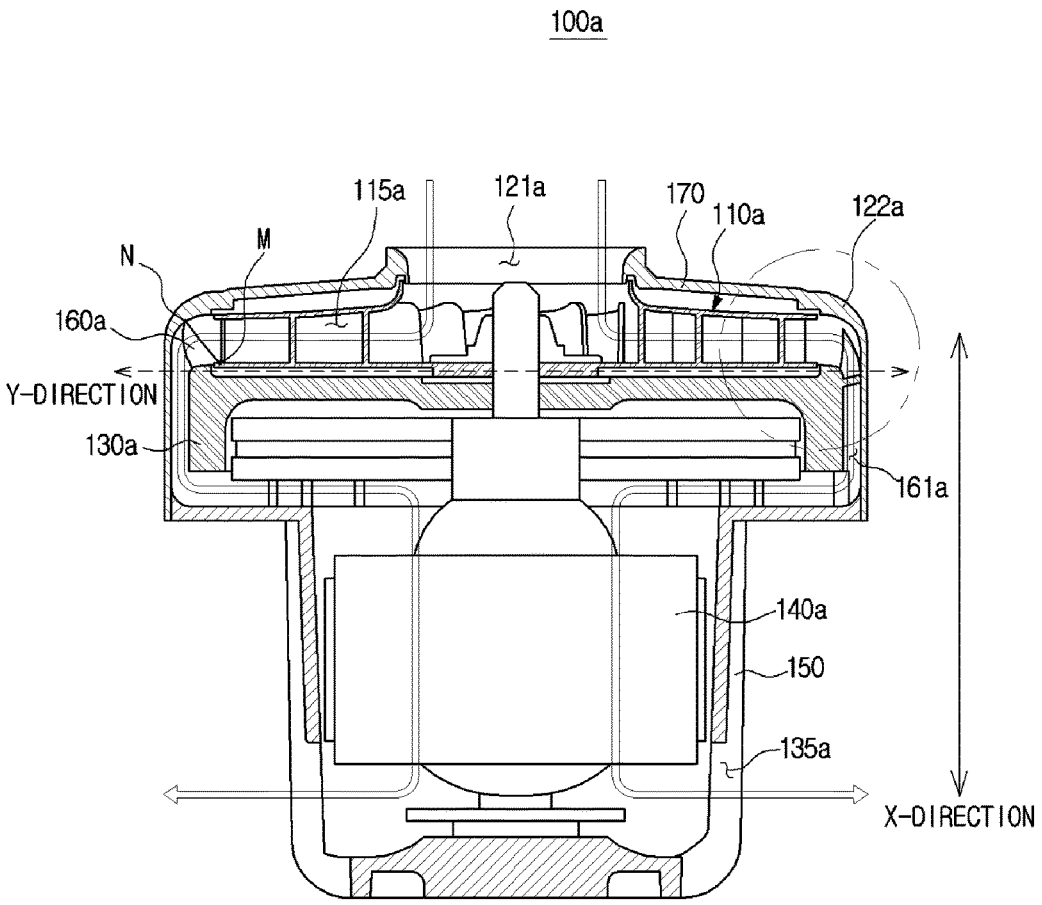
FIG. 43 is a cross-sectional view of the inhalation unit of the cleaning device of FIG. 38.

FIG. 39 is a cross-sectional view illustrating a main body of the cleaning device illustrated in FIG. 38, and FIG. 40 is a perspective view of the inhalation unit of the cleaning device of FIG. 38. FIG. 41 is an exploded perspective view of the inhalation unit of the cleaning device of FIG. 38, and FIG. 42 is an enlarged perspective view of part of the inhalation unit of the cleaning device of FIG. 38. FIG. 43 is a cross-sectional view of the inhalation unit of the cleaning device of FIG. 38. Hereinafter, repeated descriptions with FIGS. 15 through 38 will be omitted.

As illustrated in FIGS. 39 through 43, an inhalation unit 100*a* of a cleaning device 1*a* may include an impeller 110*a*, a return channel 130*a*, and a cover 170.

An inlet damper 121*a* may be formed on a top surface of the cover 170. The rotatable impeller 110*a* and the return channel 130*a* may be disposed at an inner side of the cover 170.

The return channel 130*a* may be disposed at a lower side of the impeller 110*a*.

The return channel 130*a* may directly be connected to the impeller 110*a* so that air passing through the impeller 110*a* can directly be introduced into the return channel 130*a*.

The inhalation unit 100*a* may further include a motor 140*a* and a motor housing 150.

The motor 140*a* provides driving force for rotating the impeller 110*a* and is provided in the motor housing 150. The motor housing 150 may be placed at a lower part of the return channel 130*a*, may be coupled to the cover 170, and may define an accommodation space 180 in which the impeller 110*a* and the return channel 130*a* can be accommodated.

At least one outlet 135*a* may be formed at the motor housing 150. The at least one outlet 135*a* may be formed at a bottom end of the motor housing 150. However, the position of the outlet 135*a* is not limited thereto.

A plurality of wings 160*a* may be disposed between the return channel 130*a* and the cover 170 along an outer circumferential surface of the return channel 130*a*. The plurality of wings 160*a* may form a slope with respect to an axial direction X of the impeller 110*a*. In detail, when the impeller 110*a* is rotated in a second direction I, the plurality of wings 160*a* may be inclined with respect to the axial direction X of the impeller 110*a* in a first direction H that is opposite to the second direction I.

The plurality of wings 160*a* may be formed lengthwise in the axial direction X of the impeller 110*a* so as to form a slope in the second direction I.

The plurality of wings 160*a* may be fixed to an extension portion 151 that extends to the outer side of the motor housing 150 so as to face the return channel 130*a*. In detail, the plurality of wings 160*a* may be fixed to the extension portion 151 so that a bottom end of the plurality of wings 160*a* can be placed between the return channel 130*a* and the extension portion 151.

The plurality of wings 160*a* may form convex curved surfaces in the first direction H that is the same as a rotation direction of the impeller 110*a*.

The plurality of wings 160*a* may include a first surface 190 and a second surface 199. The first surface 190 may be coupled to the outer surface of the return channel 130*a*, and the second surface 199 may be coupled to the inner surface of the cover 170. A top end 199*a* of the second surface 199 may further extend in an upward direction than a top end 190*a* of the first surface 190.

Air that is introduced into the inlet damper 121*a* and passes through a flow path 115*a* provided at the impeller 110*a* moves into the motor housing 150 along a discharge flow path 161*a* formed by the plurality of wings 160*a* and cools the motor 140*a* in the motor housing 150. Thereafter, air is ejected through at least one outlet 135*a* provided at the motor housing 150 in a radial direction.

The cover 170 may include a guide portion 122*a* that guides air passing through the flow path 115*a* of the impeller 110*a* to the discharge flow path 161*a*.

Figure 44:
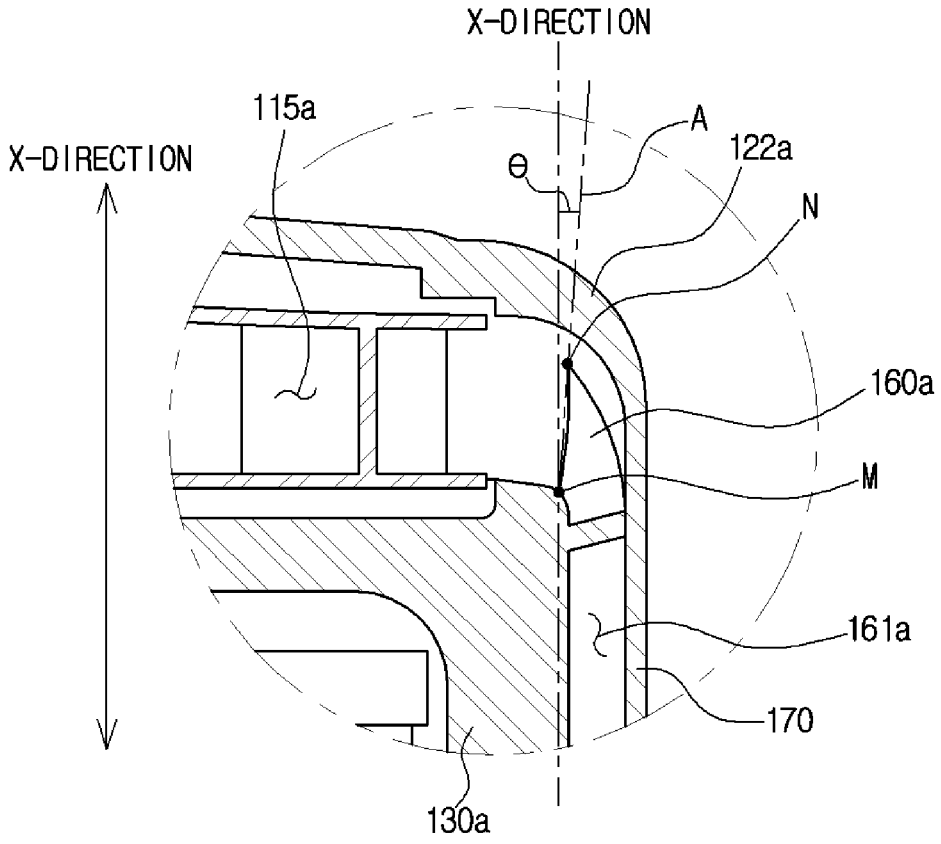
FIG. 44 is an enlarged cross-sectional view of part of the inhalation unit of the cleaning device of FIG. 38.

FIG. 44 is an enlarged cross-sectional view of part of the inhalation unit of the cleaning device of FIG. 38.

As illustrated in FIG. 44, a straight line A that connects a starting point M of the first surface 190 of the plurality of wings 160*a* and a starting point N of the second surface 199 of the plurality of wings 160*a* may form a slope at an angle between approximately 5° and 85° with respect to the axial direction X of the impeller 110*a*.

Figure 45:
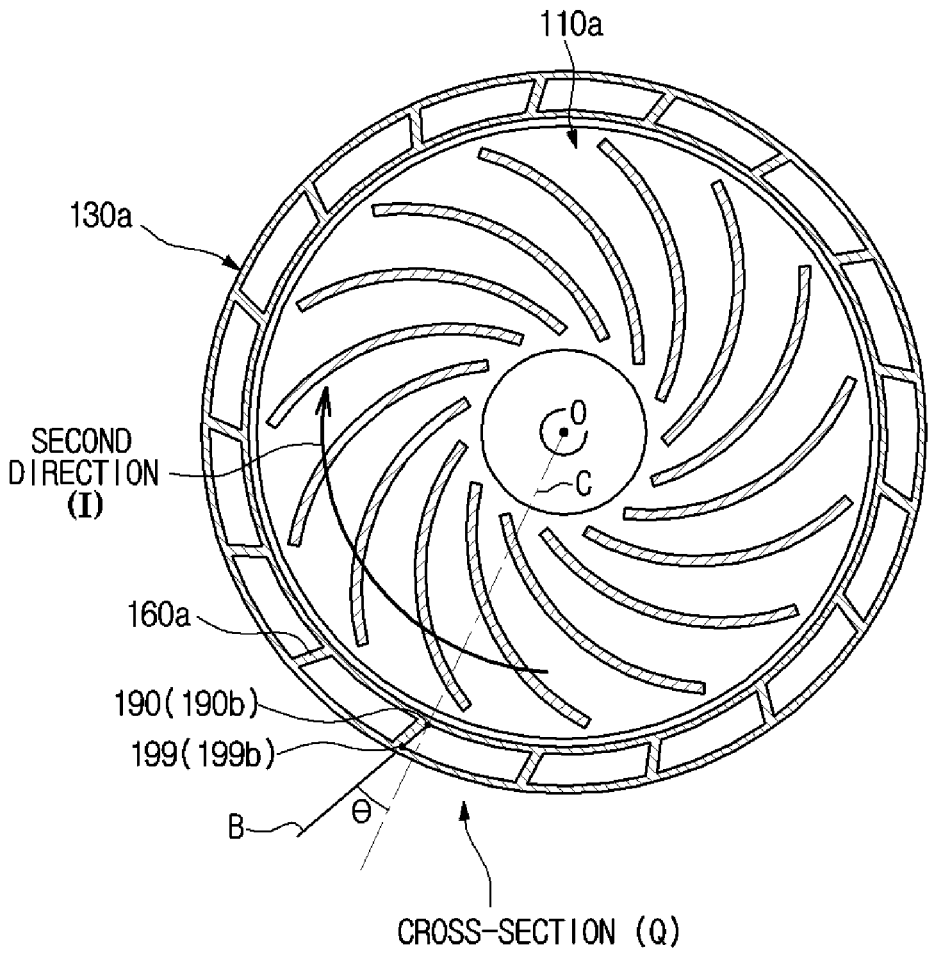
FIG. 45 is an enlarged cross-sectional view of part of a plurality of wings of the cleaning device of FIG. 38.

FIG. 45 is an enlarged cross-sectional view of part of a plurality of wings of the cleaning device of FIG. 38.

As illustrated in FIG. 45, an angle θ between a straight line B that connects a top end 190*b* of the first side 190 and a top end 199*b* of the second surface 199 which face an upward direction and a straight line C that connects a center O of the return channel 130*a* and the top end 190*b* of the first surface 190 in a cross-section Q in which the return channel 130*a* is cut in a horizontal direction Y perpendicular to the axial direction X of the impeller 110*a*, may be between approximately 0° and 80°.

Figure 46:
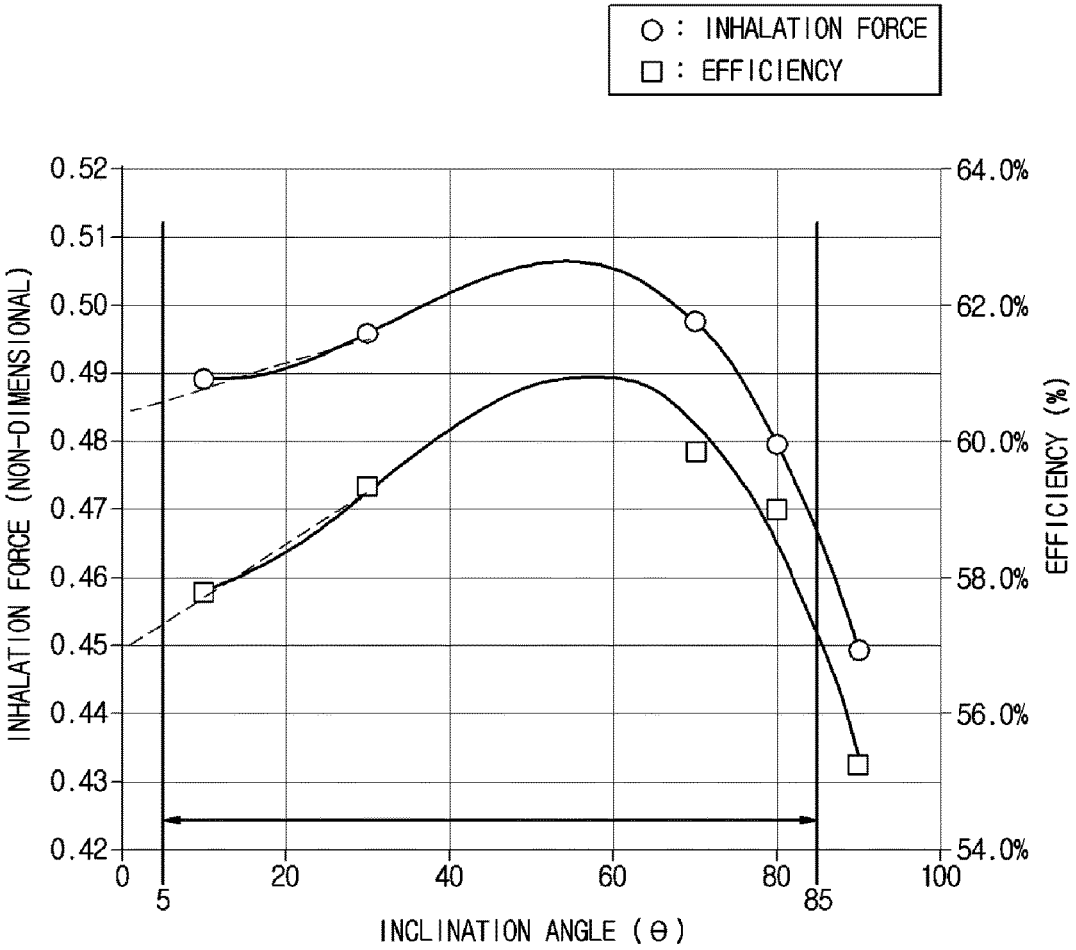
FIG. 46 is a graph showing the relationship between an inclination angle of a straight line that connects a starting point of a first surface and a starting point of a second surface with respect to an axial direction of an impeller and inhalation force of a cleaning device according to an embodiment of the present invention.

FIG. 46 is a graph showing the relationship between an inclination angle of a straight line that connects a starting point M of a first surface and a starting point N of a second surface with respect to the axial direction X of an impeller and inhalation force of a cleaning device according to an embodiment of the present invention.

In the graph of FIG. 46, as a straight line A that connects a starting point M of the first surface 162 or 190 of the plurality of wings 160 or 160*a* and a starting point N of the second surface 163 or 199 of the plurality of wings 160 or 160*a* forms a slope at an angle between approximately 5° and 85° with respect to the axial direction X of the impeller 110 or 110*a*, inhalation force of the inhalation unit 100 or 100*a* is increased.

Figure 47:
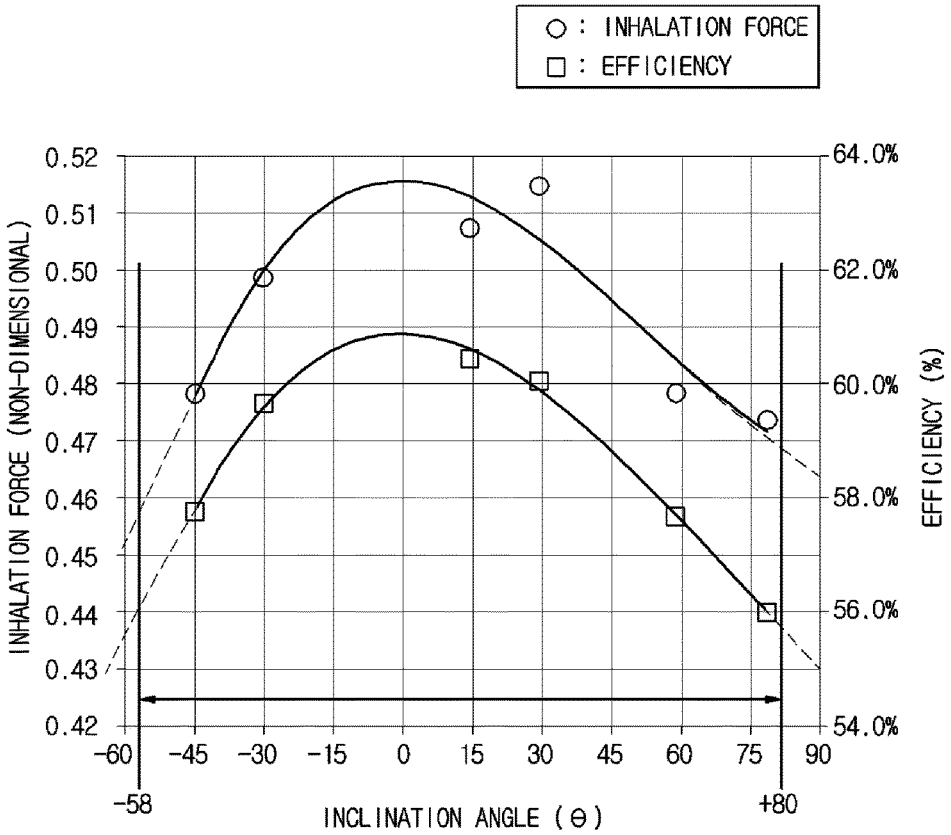
FIG. 47 is a graph showing the relationship between an angle formed by a straight line that connects one end of the first surface and one end of a second surface and a straight line that connects a center of a return channel and one end of the first side in a cross-section in which a return channel is cut in the horizontal direction perpendicular to the axial direction of the impeller and inhalation force of a cleaning device according to an embodiment of the present invention.

FIG. 47 is a graph showing the relationship between an angle formed by a straight line B that connects one end of the first surface and one end of a second surface and a straight line C that connects a center of a return channel and one end of the first surface in a cross-section Q in which a return channel is cut in the horizontal direction Y perpendicular to the axial direction X of the impeller and inhalation force of a cleaning device according to an embodiment of the present invention.

As shown in the graph of FIG. 47, an angle θ between the straight line B that connects the top end 162*b* or 190*b* of the first surface 162 or 190 and the top end 163*b* or 199*b* of the second surface 163 or 199 that face an upward direction and the straight line C that connects the center O of the return channel 130 or 130*a* and the top end 162*b* or 190*b* of the first surface 162 or 190 in the cross-section Q in which the return channel 130 or 130*a* is cut in the horizontal direction Y perpendicular to the axial direction X of the impeller 110 or 110*a*, may be between approximately 0° and 80°.

Also, as the angle θ between the straight line B that connects the top end 162*b* or 190*b* of the first surface 162 or 190 and the top end 163*b* or 199*b* of the second surface 163 or 199 which face an upward direction and the straight line C that connects the center O of the return channel 130 or 130*a* and the top end 162*b* or 190*b* of the first surface 162 or 190 gets closer to 0°, inhalation force and efficiency are excellent.

"−" and "+" of expressions of the angle θ represent the relationship between the angle θ and the rotation direction of the impeller 110 or 110*a*. That is, if the straight line B that connects the top end 162*b* or 190*b* of the first surface 162 or

190 and the top end 163*b* or 199*b* of the second surface 163 or 199 is inclined in the same direction as the rotation direction of the impeller 110 or 110*a* with respect to the straight line C that connects the center O of the return channel 130 or 130*a* and the top end 162*b* or 190*b* of the first surface 162 or 190, "+" is represented. On the other hand, if the straight line B that connects the top end 162*a* or 190*b* of the first surface 162 or 190 and the top end 163*b* or 199*b* of the second surface 163 or 199 is inclined in an opposite direction to the rotation direction of the impeller 110 or 110*a* with respect to the straight line C that connects the center O of the return channel 130 or 130*a* and the top end 162*b* or 190*b* of the first surface 162 or 190, "−" is represented.

The inhalation unit 100, 100*a*, or 100*b* described above may be applied to the cleaning device 1, 1*a*, or 1000 regardless of a type thereof. That is, the inhalation unit 100 may also be applied to a robotic cleaning device, a canister type cleaning device, or an up-right type cleaning device.

As described above, a plurality of wings that form a slope with respect to an axial direction X of an impeller are arranged in a return channel so that a bent shape of a flow path can be alleviated and thus a pressure loss of air can be reduced and inhalation force of a cleaning device can be improved.

The return channel that also serves as a diffuser is used so that a distance between the return channel and the impeller can be made larger than a distance between an existing diffuser and an impeller and thus noise of the cleaning device that occurs due to pressure fluctuation can be reduced.

The return channel in which the plurality of wings that form a slope with respect to the axial direction X of the impeller are arranged, is used so that inhalation force of the cleaning device can be improved and simultaneously miniaturization of the cleaning device can be accomplished.

The return channel is formed by coupling a plurality of units that can be separated from each other so that easiness of manufacturing or mass production of the cleaning device can be improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cleaning device comprising:

an inhalation unit to generate inhalation force to inhale air into a main body, the inhalation unit including:

an impeller that is rotatable;

an impeller cover having an inlet damper formed therein; and a return channel that is coupled to the impeller cover so that the impeller is accommodated in the return channel and that is directly coupled to the impeller so that air passing through the impeller is introduced into the return channel, the return channel including:

an inner frame; and an outer frame at an outer side of the inner frame so as to be spaced apart from the inner frame.

2. The cleaning device of claim 1, wherein a plurality of wings are disposed on the return channel so as to form a slope with respect to an axial direction of the impeller.

3. The cleaning device of claim 2, wherein the plurality of wings comprises curved surfaces.

4. The cleaning device of claim 2, wherein the impeller is rotated in a first direction, and the plurality of wings form a slope with respect to the axial direction of the impeller in a second direction that is opposite to the first direction.

5. The cleaning device of claim 2, wherein the plurality of wings are disposed between the inner frame and the outer frame.

6. The cleaning device of claim 2, wherein the plurality of wings are spaced apart from each other by a predetermined gap and form a discharge flow path through which the air passing through the impeller moves, the discharge flow path comprises:

an inlet formed on one end of the discharge flow path that faces the impeller; and an outlet formed on the other end of the discharge flow path so as to be spaced apart from the inlet, and air introduced into the discharge flow path via the inlet is ejected to an outer side of the inhalation unit via the outlet.

7. The cleaning device of claim 6, wherein the impeller cover comprises a guide portion coupled to the outer frame so as to guide the air passing through the impeller to the inlet, and the guide portion has a curved surface.

8. The cleaning device of claim 1, wherein the return channel is formed so that when a plurality of housings that are separable from each other are coupled to each other.

9. The cleaning device of claim 8, wherein the return channel further comprises at least one rotation prevention member that causes the plurality of housings to be coupled to each other.

10. The cleaning device of claim 9, wherein the at least one rotation prevention member is formed at an inner side of the return channel so as to be spaced apart from each other.

11. The cleaning device of claim 9, wherein the plurality of housings comprise:

a first housing at an upstream side of a direction in which the air passing through the impeller moves; and a second housing at a downstream side of the direction in which the air passing through the impeller moves, and the at least one rotation prevention member comprises a protrusion at an inner side of one of the first housing and the second housing.

* * * * *